US008293439B2

(12) United States Patent
Fujiwara et al.

(10) Patent No.: US 8,293,439 B2
(45) Date of Patent: Oct. 23, 2012

(54) ELECTROPHOTOGRAPHIC PHOTORECPTOR, METHOD OF MANUFACTURING ELECTROPHOTOGRAPHIC PHOTORECPTOR, IMAGE FORMING APPARATUS, AND PROCESS CARTRIDGE

(75) Inventors: Yukio Fujiwara, Numazu (JP); Hidetoshi Kami, Numazu (JP); Kazuhiro Egawa, Numazu (JP); Shinji Nohsho, Numazu (JP); Mayumi Yoshihara, Numazu (JP); Mihoko Matsumoto, Susono (JP); Kohsuke Yamamoto, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 224 days.

(21) Appl. No.: 12/723,058

(22) Filed: Mar. 12, 2010

(65) Prior Publication Data

US 2010/0232831 A1 Sep. 16, 2010

(30) Foreign Application Priority Data

Mar. 13, 2009 (JP) ..... 2009-061268
Mar. 3, 2010 (JP) ..... 2010-046096

(51) Int. Cl.
*G03G 5/147* (2006.01)

(52) U.S. Cl. ..... 430/66; 430/56; 430/58.2; 430/58.7; 399/159

(58) Field of Classification Search ..... 430/56, 430/58.2, 58.7, 66; 399/159
See application file for complete search history.

(56) References Cited

U.S. PATENT DOCUMENTS 6,861,188 B2 3/2005 Ikegami et al.
(Continued)

FOREIGN PATENT DOCUMENTS

JP 57-78402 5/1982
(Continued)

OTHER PUBLICATIONS

"Blade cleaning system for polymerized and small size toner", Hyakutake et al., Japan Hardcopy Fall Meeting, 2001, pp. 24-27.

(Continued)

*Primary Examiner* — Peter Vajda
(74) *Attorney, Agent, or Firm* — Cooper & Dunham LLP

(57) ABSTRACT

An electrophotographic photoreceptor including a conductive substrate, a photosensitive layer, and a surface layer, which satisfies the following inequations:

$$0.005<WRa(LMH)<0.03 \quad \text{(i)}$$

$$0.010<WRa(LHH)<0.03 \quad \text{(ii)}$$

$$0.005<WRa(LML)<0.20 \quad \text{(iii)}$$

$$WRa(LLH)>WRa(LMH) \quad \text{(iv)}$$

$$WRa(LLH)>WRa(LHH) \quad \text{(v)}$$

wherein WRa (μm) represents a center-line average roughness of frequency components LHH, LHL, LMH, LML, LLH, and LLL that are obtained by subjecting a one-dimensional data array of a surface profile of the electrophotographic photoreceptor to wavelet transformation multiresolution analysis so as to be separated into 6 frequency components; thinning a one-dimensional data array of the lowest frequency component so that the number of data array is reduced to 1/40; and subjecting the thinned one-dimensional data array to wavelet transformation multiresolution analysis so as to be separated into the 6 frequency components LHH, LHL, LMH, LML, LLH, and LLL.

12 Claims, 24 Drawing Sheets

U.S. PATENT DOCUMENTS

| | | | |
|---|---|---|---|
| 6,936,388 | B2 | 8/2005 | Suzuki et al. |
| 7,018,755 | B2 | 3/2006 | Ikegami et al. |
| 7,160,658 | B2 | 1/2007 | Suzuki et al. |
| 7,177,570 | B2 | 2/2007 | Nagame et al. |
| 7,267,916 | B2 | 9/2007 | Sugino et al. |
| 7,314,693 | B2 | 1/2008 | Ikegami et al. |
| 7,381,511 | B2 | 6/2008 | Ikegami et al. |
| 2007/0031746 | A1 | 2/2007 | Toshine et al. |
| 2007/0196749 | A1 | 8/2007 | Inaba et al. |
| 2007/0196750 | A1 | 8/2007 | Fujiwara et al. |
| 2007/0212626 | A1 | 9/2007 | Toshine et al. |
| 2008/0085459 | A1 | 4/2008 | Kami et al. |
| 2008/0138725 | A1 | 6/2008 | Fujiwara et al. |
| 2008/0153021 | A1 | 6/2008 | Ikuno et al. |
| 2008/0199217 | A1 | 8/2008 | Iwamoto et al. |
| 2008/0227008 | A1 | 9/2008 | Kami et al. |
| 2008/0311499 | A1 | 12/2008 | Kami et al. |
| 2009/0067891 | A1 | 3/2009 | Kami et al. |
| 2009/0148180 | A1 | 6/2009 | Fujiwara et al. |
| 2009/0208246 | A1 | 8/2009 | Kami |

FOREIGN PATENT DOCUMENTS

| | | |
|---|---|---|
| JP | 5-88392 | 4/1993 |
| JP | 7-104497 | 4/1995 |
| JP | 7-292095 | 11/1995 |
| JP | 2509292 | 4/1996 |
| JP | 8-248663 | 9/1996 |
| JP | 3040540 | 3/2000 |
| JP | 2000-162881 | 6/2000 |
| JP | 2000-171990 | 6/2000 |
| JP | 2001-265014 | 9/2001 |
| JP | 2001-289630 | 10/2001 |
| JP | 2001-343771 | 12/2001 |
| JP | 2002-82468 | 3/2002 |
| JP | 2002-196645 | 7/2002 |
| JP | 2002-251029 | 9/2002 |
| JP | 2002-296994 | 10/2002 |
| JP | 2002-311613 | 10/2002 |
| JP | 2002-341572 | 11/2002 |
| JP | 2003-131537 | 5/2003 |
| JP | 2003-241408 | 8/2003 |
| JP | 2003-270840 | 9/2003 |
| JP | 2004-54001 | 2/2004 |
| JP | 2004-61359 | 2/2004 |
| JP | 2004-258588 | 9/2004 |
| JP | 2006-53576 | 2/2006 |
| JP | 2006-53577 | 2/2006 |
| JP | 2006-79102 | 3/2006 |
| JP | 3782680 | 3/2006 |
| JP | 3789081 | 4/2006 |
| JP | 2006-163302 | 6/2006 |
| JP | 2006-308743 | 11/2006 |
| JP | 3878425 | 11/2006 |
| JP | 3878427 | 11/2006 |
| JP | 3878428 | 11/2006 |
| JP | 2007-79230 | 3/2007 |
| JP | 2007-79244 | 3/2007 |
| JP | 2007-86319 | 4/2007 |
| JP | 3943476 | 4/2007 |
| JP | 3938209 | 6/2007 |
| JP | 3938210 | 6/2007 |
| JP | 4003914 | 8/2007 |
| JP | 4011790 | 9/2007 |
| JP | 2007-292772 | 11/2007 |
| JP | 2008-70540 | 3/2008 |
| JP | 4110116 | 4/2008 |
| JP | 2008-122869 | 5/2008 |
| JP | 4136567 | 6/2008 |
| JP | 4194973 | 10/2008 |
| JP | 4400704 | 11/2009 |

OTHER PUBLICATIONS

"Measuring Non-Electrostatic Adhesive Force between Solid Surfaces and Particles by Means of Atomic Force Microscopy", Mizuguchi et al., Konica Minolta Technology Report vol. 1 (2004) pp. 19-22.

ELECTROPHOTOGRAPHIC PHOTORECPTOR, METHOD OF MANUFACTURING ELECTROPHOTOGRAPHIC PHOTORECPTOR, IMAGE FORMING APPARATUS, AND PROCESS CARTRIDGE

CROSS-REFERENCE TO RELATED APPLICATIONS

This document claims priority from and contains subject matter related to Japanese Patent Applications Nos. 2009-061268 and 2010-046096, filed on Mar. 13, 2009 and Mar. 3, 2010, respectively, the entire contents of each of which are hereby incorporated herein by reference.

BACKGROUND OF THE INVENTION

1. Field of the Invention

The present invention relates to an electrophotographic photoreceptor for use in copiers, facsimile machines, laser printers, and direct digital platemakers. In addition, the present invention also relates to a method of manufacturing electrophotographic photoreceptor, and an image forming apparatus and a process cartridge using the electrophotographic photoreceptor.

2. Discussion of the Related Art

Recently, the mainstream of electrophotographic photoreceptor (hereinafter simply "photoreceptor") has switched from inorganic photoreceptor that uses inorganic materials such as selenium, zinc oxide, and cadmium sulfide, to organic photoreceptor that uses organic materials. Organic photoreceptors are more advantages than inorganic photoreceptors in reduction of environmental load and manufacturing cost and flexibility in compositional designing. Nowadays, the production of organic photoreceptors comes close to 100% of the total production of photoreceptors. Recently, organic photoreceptors are sought to be mechanical components rather than consumable supplies in accordance with increasing momentum of global environmental protection.

Various attempts have been made to improve durability of organic photoreceptors. For example, Japanese Patent Application Publication No. (hereinafter "JP-A") 2000-66424 and JP-A 2000-171990 have proposed forming a cross-linked resin layer and a zol-gel cured resin layer, respectively, on the surface of a photoreceptor. The former is more productive because the layer is likely to neither fracture nor crack even when an electron transport material is added thereto. In particular, radical-polymerized acrylic resins are advantages because of having high stiffness and providing the resultant photoreceptor with high photosensitivity. Because of including plural chemical bonds, such cross-linked or cured resin layers may not be immediately brought into abrasion even when a part of chemical bonds are cut by application of mechanical stress.

On the other hand, the mainstream of electrophotographic toner (hereinafter simply "toner") is switching from irregular-shaped toner to spherical toner. Spherical toners have an advantage in production of high quality image.

Generally, spherical toners are manufactured by chemical manufacturing methods such as a suspension polymerization method, an emulsion aggregation polymerization method, an ester elongation method, and a dissolution suspension method. Spherical toners may be hereinafter referred to as "polymerization toners" as appropriate. For example, a typical polymerization toner for use in an electrophotographic image forming apparatus may have an average circularity of from 0.95 to 0.99 and shape factors SF-1 and SF-2 of from 110 to 140. A true sphere has a circularity of 1.0 and shape factors of 100.

Because of having a uniform shape, each polymerization toner particles has a uniform charge quantity. Therefore, polymerization toner particles develop a latent image into a toner image with high sharpness, resolution, and gradation. In addition to this high developability, polymerization toner particles also have high transfer efficiency. Also, because polymerization toner particles are easy to include wax, advantageously, oil is not needed when fixed on recording media such as paper.

At the same time, disadvantageously, polymerization toner particles are difficult to be removed when remaining on a photoreceptor. To solve this problem, a greater amount of external additives are required on the surfaces of the polymerization toner particles. As a result, the external additives may form undesired films thereof on the photoreceptor.

In order to more effectively remove residual polymerization toner particles from a photoreceptor, one proposed approach involves applying a solid lubricant (e.g., zinc stearate) to a surface of a photoreceptor to reduce the surface friction coefficient thereof, as described in a technical document entitled "Blade cleaning system for polymerized and small size toner, Hyakutake et al., Japan Hardcopy Fall Meeting, 2001, 24-27".

However, a solid lubricant (e.g., zinc stearate) may not be sufficiently applied to a surface of a photoreceptor when the surface is relatively smooth.

In view of this, JP-A 2007-79244 proposed to roughen a surface of a photoreceptor so that a lubricant is reliably applied thereto, in other words, receptivity of the surface to a lubricant is improved. It is disclosed therein that a surface of a photoreceptor preferably has a surface roughness Rz (defined in JIS B0601-1994) of from 0.4 to 1.0 μm, which can be achieved by addition of a filler to the surface layer.

Although having the same Rz value, the surface profile of a photoreceptor may vary. For example, even when the average distance between the highest peak and lowest valley is extremely different, the Rz value may be the same. Therefore, receptivity of the surface to zinc stearate may not be improved only by controlling the Rz value.

In addition to Rz (ten points average roughness), Ra (arithmetical average roughness), Rmax (the maximum height), etc., all defined in JIS B0601, are also widely used for evaluation of surface roughness. However, these parameters are not satisfactory to evaluate surface roughness of photoreceptors, and various proposals have been made as follows.

JP-A 07-104497 discloses a method in which a divisional breadth X having an average line 2 at center is assumed on a cross section curve 1 obtained through the measurement of surface contour with a surface roughness measuring device, and the surface contour is evaluated on the basis of the number of peaks 4 of a pair of adjacent crest and trough outside the breadth X per unit length L. In this case, a substrate having the number of the peaks 4 equal to or less than 100 with the breadth X kept at 20 μm and the unit length L at 1 cm is used to fabricate an organic photoreceptor.

To form high quality image by solving the problem of insufficient cleaning of small-size toner, JP-A 2002-196645 discloses an image forming device in which a cleaning roll having bias voltage applied to separate electrified toner from a photoreceptor is provided on the upstream side of a cleaning blade, and a photoreceptor having a surface roughness Rz of 0.1 μm to 2.5 μm in an average of ten points is provided.

JP-A 2006-163302 discloses an electrophotographic photoreceptor which satisfies $\Delta T > Rz$ and $0\ \mu m < \Delta T + Rz < 5\ \mu m$, wherein ΔT and Rz represent the wear amount and the surface roughness, respectively, per kilocycle of the electrophotographic photoreceptor.

JP-A 2007-86319 discloses an electrophotographic photoreceptor in which the surface of the photosensitive layer is subjected to surface roughening treatment, and when the glossiness of the surface of the photosensitive layer after the surface roughening treatment is measured, a standard deviation of the measurement value is ≦4.

Japanese Patent No. 3040540 (corresponding to JP-A 04-243265) discloses an image forming system which includes a blade, an image forming member, and a toner composition. The image forming member has a surface on which the toner composition forms an image, and the surface has surface roughnesses defined by the following inequations:

$$R/ann^4 > KB(1-\sigma^2)/32\pi Et^2 af$$

$$R/ann^2 > \sqrt{3}/8\pi^2 \cdot (1+\mu^2)/\mu \cdot KB/\Gamma \cdot t/af \cdot \theta$$

wherein R is the average height of the projecting parts of the surface; ann is half the nearest adjacent distance between the projecting parts on the surface; KB is the bulk elastic modulus of the blade; σ in the Poisson's ratio of the toner composition; E is the Young's modulus of the toner composition; t is the average thickness of flat particles in the toner composition; of is the average radius of the flat particles; μ is the average between the coefficient of friction of the toner blade and the coefficient of friction of toner surfaces; Γ is the Dupre' work of the adhesion between the surface and the flat particles; and θ is a blade tip angle.

Japanese Patent No. 3938209 (corresponding to WO 05/093518) discloses a cylindrical electrophotography photosensitive body having a cylindrical support and an organic photosensitive layer provided on the cylindrical support. The circumferential surface of the electrophotography photosensitive body has recesses of dimple shape. The ten point average height Rzjis (A) measured by scanning in the circumferential direction of the circumferential surface of the electrophotography photosensitive body is 0.3 to 2.5 μm, and the ten point average height Rzjis (B) measured by scanning in the direction of the generating line of the circumferential surface of the electrophotography photosensitive body is 0.3 to 2.5 μm. The average interval RSm (C) of the irregularities measured by scanning in the circumferential direction of the circumferential surface of the electrophotography body is 5 to 120 μm, and the average interval RSm (D) of the irregularities measured by scanning in the direction of the generating line of the circumferential surface of the electrophotography photosensitive body is 5 to 120 μm. The ratio (D/C) of the average interval RSm (D) of the irregularities to the average interval RSm (C) of the irregularities is 0.5 to 1.5.

Japanese Patent No. 3938210 (corresponding to WO 05/093520) discloses an electrophotographic photosensitive member having a support and an organic photosensitive layer provided on the support. A plurality of dimple-shaped concavities are formed on the surface of the surface layer of the electrophotographic photosensitive member and a plurality of recesses corresponding to the dimple-shaped concavities formed on the surface of the surface layer are formed on the interface between the surface layer and a layer directly under the surface layer.

JP-A 2005-345788 discloses an image forming apparatus having a plurality of image carriers which are each obtained by disposing a photosensitive layer on a conductive support and on which electrostatic latent images are formed by surface exposure, a plurality of development devices, and a plurality of cleaning means. At least a pair of development devices among a plurality of developing devices house developers having the same hue but different from each other in luminosity. The compositions or physical values of surface layers of the image carriers are set according to the luminosity of the developers housed in the plurality of development devices.

JP-A 2004-258588 discloses an image forming apparatus including a photoreceptor having a surface performance that the ten-point average roughness RzJIS is ≧0.1 μm and ≦1.5 μm or the maximum height Rz is 2.5 μm or less, and the frictional resistance Rf is ≧45 gf and ≦200 gf.

JP-A 2004-054001 discloses an image forming method including a primary transferring process transferring a toner image visualized by developing onto an intermediate transfer body, a secondary transferring process transferring the toner image transferred onto the intermediate transfer body onto a recording medium, and a cleaning process in which residue toner on an electrophotographic photoreceptor is eliminated after transferring the toner image onto the recording material. The surface roughness Ra of the electrophotographic photoreceptor is 0.02 to 0.1 μm, the surface roughness Rz of the intermediate transfer body is 0.4 μm to 2.0 μm, and image formation is carried out by feeding surface energy lowering agent to the surface of the electrophotographic photoreceptor.

JP-A 2003-270840 discloses an image forming apparatus including an organic photoreceptor in which the average cycle of the surface irregularity is 10 times or more the volume average particle diameter of the toner used therefor.

JP-A 2003-241408 discloses an electrophotographic device including an electrophotographic photoreceptor rotating at a peripheral speed of 200 mm/sec or more and a cleaning means. The electrophotographic photoreceptor has a photosensitive layer and a surface protection layer on a conductive base. The surface protection layer contains 35.0 to 45.5 mass % fluorine atom containing resin particles for the total mass of the protection layer and is of 0.1 to 5.0 μm in 10-point mean surface roughness, 0.1 to 10.0 in surface hardness by a Taber's abrasion resistant test method, and 0.1 to 0.7 in surface friction coefficient. The cleaning means is a rubber elastic body blade and the linear pressure of the blade to the electrophotographic photoreceptor is 0.294 to 0.441 N/cm. The glass transition point (Tg) of toner in use is 40 to 55° C. The tensile modulus (Young's modulus) as a blade property value is 784 to 980 N/cm$^2$. The value of repulsive elasticity is 35 to 55%. Fluorine atom resin particulates are incorporated in the surface of the base material.

JP-A 2003-131537 discloses an image forming method including and image forming body on which a toner forms an image, which satisfies the equation $d/t \times 0.01 \leqq Ra \leqq 0.5$, wherein d/t represents the degree of flatness of the toner particle (d represents the volume average particle diameter of the toner and t represents the thickness t of the toner particle) and Ra (μm) represents a surface roughness of the image forming body.

JP-A 2002-296994 and JP-A 2002-258705 each disclose an image forming apparatus including an image bearing member on which a spherical toner forms an image, the surface of which has convexities and concavities which are smaller than the volume average particle of the toner.

JP-A 2002-082468 discloses an electrophotographic device having an electrophotographic photoreceptor which is rotated above 200 mm/sec in circumferential speed and a cleaning means. The photoreceptor has a photosensitive layer and a surface protective layer on a conductive substrate. The surface protective layer contains 15.0 to 40.0 mass % fluorine atom-containing resin particles. Its surface roughness is 0.1 to 5.0 μm in ten-point mean roughness, its surface hardness is 0.1 to 20.0 in a taper wear test method, and its surface friction coefficient is 0.001 to 1.2.

JP-As 2001-265014, 2001-289630, 2002-251029, 2002-296822, 2002-296823, 2002-296824, 2002-341572, 2006-53576, 2006-53577, and 2006-79102 disclose methods of evaluating surface profile using Fourier transform. In Fourier transform, a variation which occurs with high frequency in a signal can be transformed into a frequency distribution, however, a variation which occurs with low frequency cannot. Further, disadvantageously, it is not clearly determined from the results of Fourier transform where the variation occurred.

JP-A 2004-117454 discloses a method for evaluating the surface roughness of a base body for an electrophotographic photoreceptor. A cross section curve stipulated by JIS B0601 from an arbitrary position of the base body surface is obtained in the abscissa direction by a length of 100 μm, positions of the cross section curve in the ordinate direction at equispaced positions in the abscissa direction are measured, variance of the positions stipulated by JIS Z8101 is obtained, one or more measurements selected from surface roughnesses Ra, Rz and Ry stipulated by JIS B0601 are also obtained, and the surface roughness of the base body is evaluated using the variance and the one or more measurements.

JP-A 2004-61359 discloses a surface roughness evaluating method of a component for an image forming device. A cross-section curve defined by JIS B0601 is found on the surface condition of the component to perform multiple resolution analysis on positional data rows in a surface roughness direction at equally spaced positions on the cross-section curve, and the state of the surface roughness is evaluated at least based on the result.

JP-A 2007-292772 discloses a surface roughness evaluating method of a component for an image forming device. A profile curve defined in JIS B0601 is calculated on a surface condition of the image forming apparatus component such as the electrophotographic photoreceptor substratum. Multiple resolution analysis such as wavelet transformation of a positional data row in the surface roughness direction at equal intervals on the profile curve is performed, and the surface roughness condition is evaluated based on the results.

JP-A 2008-70540 discloses a latent electrostatic image bearing member having a cross-linked surface layer which comprises a reactive silicone material. It is disclosed therein that such a surface layer is smooth and has a low surface energy, providing good cleanability of toners.

However, none of the above-described methods of evaluating surface roughness is sufficient to evaluate cleanability (removability) of small-size toners and polymerization (spherical) toners from photoreceptor.

In view of this situation, surface roughness may be evaluated from a surface profile recorded on a chart by a surface roughness & profile shape measuring instrument. However, it requires skill to evaluate surface roughness from the chart.

Namely, any of the parameters (Ra, Rmax, Rz, etc.) does not sufficiently represent cleanability (removability) of small-size toners and polymerization (spherical) toners from photoreceptor.

In the above-cited reference JP-A 2007-79244, a photoreceptor including alumina particles as a filler is disclosed. Since alumina particles are difficult to be uniformly dispersed in a coating material, it requires a special technique to form a uniform coating layer. A photoreceptor including polymethylsilsesquioxane particles is also disclosed therein. Such a photoreceptor does not always sufficiently hold a solid lubricant hereon because of having too large convexities and concavities on the surface thereof.

Although a coating material for forming a cross-linked resin surface layer has a low viscosity because of being comprised primarily of monomer components, silicon-containing particles such as silica particles and silicone resin particles can be stably dispersed therein. Accordingly, silicon-containing particles have a great advantage over various filler materials in manufacturing photoreceptors. However, silicon-containing particles do not always provide the resultant photoreceptor with high receptivity to solid lubricants, as seen in Example 2 of JP-A 2005-99688. This is because the surface of the photoreceptor has too large convexities and concavities to hold solid lubricants.

JP-A 08-248663 discloses a photoreceptor in which a photosensitive layer is provided on a conductive base. Surface roughness of the conductive base is 0.01-2.0 μm while surface roughness of the outermost surface side layer is 0.1-0.5 μm. And in the outermost surface side layer, inorganic grains with an average grain diameter of 0.05-0.5 μm are contained.

As described therein, the inorganic grain such as silica particle may be hydrophobized in an attempt to improve durability and prevent deterioration of image resolution which occurs by adhesion of contaminants such as corona products. However, the hydrophobized inorganic grain may not prevent adhesion of corona products while preventing adhesion of water, thereby causing image blurring.

In view of this situation, JP-A 2004-138643 proposed to use alumina as a filler to prevent image blurring. However, a special technique is required to disperse alumina in a cross-linked resin surface layer, as described above.

As seen above, the receptivity of a photoreceptor to solid lubricants may affect abrasion rate of the photoreceptor and/or cleanability (removability) of toner, i.e., printing quality. However, any technique to improve the receptivity of a highly-durable photoreceptor having a cross-linked resin surface layer has not been proposed so far.

Advantageously, such a photoreceptor having a surface layer such as a cross-linked resin layer has extremely high durability. On the other hand, disadvantageously, such a surface layer has a low receptivity to solid lubricants and therefore cleanability (removability) of polymerization toners is poor. As a result, highly-durable photoreceptors having a surface layer cannot be practically used in combination with polymerization toners under the current situation.

SUMMARY OF THE INVENTION

Accordingly, exemplary embodiments of the present invention provide an electrophotographic photoreceptor having good receptivity to solid lubricants, a method of manufacturing such an electrophotographic photoreceptor having good receptivity to solid lubricants, and an image forming apparatus and a process cartridge having a long lifespan.

These and other features and advantages of the present invention, either individually or in combinations thereof, as hereinafter will become more readily apparent can be attained by exemplary embodiments described below.

One exemplary embodiment provides an electrophotographic photoreceptor including a conductive substrate, a photosensitive layer located overlying the conductive substrate, and a surface layer located overlying the photosensitive layer. The electrophotographic photoreceptor satisfies the following inequations:

$$0.005 < WRa(LMH) < 0.03 \quad \text{(i)}$$

$$0.010 < WRa(LHH) < 0.03 \quad \text{(ii)}$$

$$0.005 < WRa(LML) < 0.20 \quad \text{(iii)}$$

$$WRa(LLH)>WRa(LMH) \quad \text{(iv)}$$

$$WRa(LLH)>WRa(LHH) \quad \text{(v)}$$

wherein WRa (μm) represents a center-line average roughness of frequency components LHH, LHL, LMH, LML, LLH, and LLL that are obtained by: subjecting a one-dimensional data array of a surface profile of the electrophotographic photoreceptor, which is measured with a surface roughness & profile shape measuring instrument, to wavelet transformation multiresolution analysis so as to be separated into 6 frequency components each having a cycle length (μm) of 0 to 3, 1 to 6, 2 to 13, 4 to 25, 10 to 50, and 24 to 99; thinning a one-dimensional data array of the lowest frequency component having a cycle length of from 24 to 99 (μm) so that the number of data array is reduced to 1/40; and subjecting the thinned one-dimensional data array to wavelet transformation multiresolution analysis so as to be separated into the 6 frequency components LHH, LHL, LMH, LML, LLH, and LLL each having a cycle length (μm) of 26 to 106, 53 to 183, 106 to 318, 214 to 551, 431 to 954, and 867 to 1,654, respectively.

Another exemplary embodiment provides a method of manufacturing electrophotographic photoreceptor including coating and curing a surface layer coating liquid on a photosensitive layer. The surface layer coating liquid may be either a cross-linked resin surface layer coating liquid or a thermoplastic resin surface layer coating liquid.

Yet another exemplary embodiment provides an image forming apparatus including the above-described electrophotographic photoreceptor configured to bear an electrostatic latent image, a brush roller configured to apply a solid lubricant to a surface of the electrophotographic photoreceptor, a blade configured to extend the solid lubricant on the surface of the electrophotographic photoreceptor, and a developing device configured to develop the electrostatic latent image with a toner to form a toner image.

Yet another exemplary embodiment provides a process cartridge detachably mountable on image forming apparatus, including the above-described electrophotographic photoreceptor configured to bear an electrostatic latent image, a brush roller configured to apply a solid lubricant to a surface of the electrophotographic photoreceptor, and a blade configured to extend the solid lubricant on the surface of the electrophotographic photoreceptor.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

First, a general application mechanism of a solid lubricant to a surface of a photoreceptor in an electrophotography is described in detail.

A lubricant in a powder state is applied to a surface of a photoreceptor in a small amount. More specifically, for example, a block-shaped solid lubricant is scraped with a brush-shaped applicator and is applied to a surface of a photoreceptor, as described in JP-A 2000-162881, the disclosure thereof being incorporated herein by reference. Such a procedure can be performed by a simple apparatus and is able to reliably apply a lubricant to the entire surface of a photoreceptor.

Figure 1:
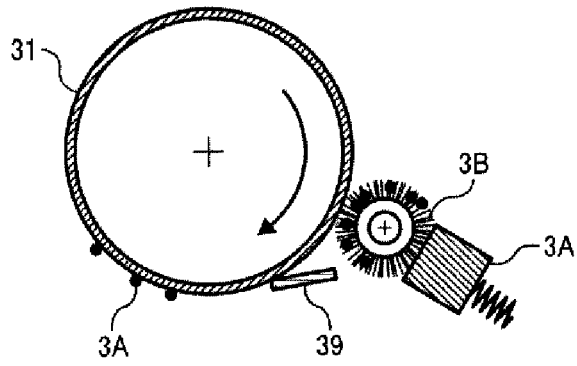
FIG. 1 is a schematic view illustrating an example embodiment of a lubricant applicator.

FIG. 1 is a schematic view illustrating an example embodiment of a lubricant applicator. An application brush 3B, such as a fur brush, rotates so as to scrape a solid lubricant 3A and apply it to a photoreceptor 31. The application brush 3B rotates while contacting the solid lubricant 3A so that a part of the solid lubricant 3A is scraped off. The scraped solid lubricant 3A adheres to the application brush 3B, and the application brush 3B applies the scraped solid lubricant 3A to the photoreceptor 31 by rotation. Because the scraped solid lubricant 3A that is in a powder state may not express lubricity, the scraped solid lubricant 3A is drawn or extended with an application blade 39 to form a thin film thereof on the photoreceptor 31.

The solid lubricant 3A may be a higher fatty acid metal salt such as zinc stearate, for example. Zinc stearate is a lamella crystal, which is preferably used as the lubricant. Lamella crystals generally have a layered structure in which amphiphilic molecules are self-assembled, and easily fracture along the interfaces between the layers upon application of shear force. Accordingly, a lamella crystal may cover the entire surface of a photoreceptor upon application of shear force to reduce the friction coefficient even in a small amount.

There are various methods of controlling lubricant application conditions. One example method includes increasing the contact pressure of the solid lubricant 3A with the application brush 3B. Another example method includes controlling the revolution speed of the application brush 3B.

The surface roughness of a photoreceptor cannot be satisfactorily controlled only by monitoring conventional parameters such as Ra and RSm which are measureable with a surface roughness & profile shape measuring instrument, as described above. In view of this situation, the inventors of the present invention found that the surface roughness of a photoreceptor can be satisfactorily controlled by wavelet transformation multiresolution analysis of a one-dimensional data array of a cross-sectional curve of the photoreceptor.

More specifically, the inventors of the present invention found that there is a relation between application conditions of a solid lubricant and a center-line average roughness WRa of a photoreceptor. In the present specification, the center-line average roughness WRa is calculated as follows. First, a one-dimensional data array of a surface profile of a photoreceptor measured with a surface roughness & profile shape measuring instrument is subjected to wavelet transformation multiresolution analysis so as to be separated into plural frequency components, ranging from high-frequency components to low-frequency components. A one-dimensional data array of the lowest-frequency component is thinned and further subjected to wavelet transformation multiresolution analysis so as to be separated into plural frequency components. Each of the frequency components are subjected to calculation of the center-line average roughness WRa, based on a method of calculating the center-line average roughness Ra that is defined in JIS B0601-1982.

Accordingly, an exemplary embodiment of the present invention provides an electrophotographic photoreceptor including a conductive substrate, a photosensitive layer located overlying the conductive substrate, and a surface layer located overlying the photosensitive layer, which satisfies the following inequations:

$$0.005 < WRa(LMH) < 0.03 \quad \text{(i)}$$

$$0.010 < WRa(LHH) < 0.03 \quad \text{(ii)}$$

$$0.005 < WRa(LML) < 0.20 \quad \text{(iii)}$$

$$WRa(LLH) > WRa(LMH) \quad \text{(iv)}$$

$$WRa(LLH) > WRa(LHH) \quad \text{(v)}$$

wherein WRa (μm) represents a center-line average roughness of frequency components LHH, LHL, LMH, LML, LLH, and LLL that are obtained by: subjecting a one-dimensional data array of a surface profile of the electrophotographic photoreceptor, which is measured with a surface roughness & profile shape measuring instrument, to wavelet transformation multiresolution analysis so as to be separated into 6 frequency components each having a cycle length (μm) of 0 to 3, 1 to 6, 2 to 13, 4 to 25, 10 to 50, and 24 to 99; thinning a one-dimensional data array of the lowest frequency component having a cycle length of from 24 to 99 (μm) so that the number of data array is reduced to 1/40; and subjecting the thinned one-dimensional data array to wavelet transformation multiresolution analysis so as to be separated into the 6 frequency components LHH, LHL, LMH, LML, LLH, and LLL each having a cycle length (μm) of 26 to 106, 53 to 183, 106 to 318, 214 to 551, 431 to 954, and 867 to 1,654, respectively.

When the inequations (i) to (v) are satisfied, a solid lubricant is applied to the surface layer in very good condition. The reason for this may be considered that the surface profile of the surface layer matches the application mechanism of the solid lubricant.

Photoreceptors are generally required to be sensitive to adhesion of solid lubricants. Such a sensitivity of photoreceptors to adhesion of solid lubricants may be influenced by 1) the adhesion force between a photoreceptor and a solid lubricant and/or 2) the ease of formation of a thin film of a solid lubricant with an application blade.

For example, the adhesion force between two substances is studied in a technical document entitled "Measuring Non-Electrostatic Adhesive Force between Solid Surfaces and Particles by Means of Atomic Force Microscopy, Mizuguchi et al., KONICA MINOLTA TECHNOLOGY REPORT VOL. 1 (2004), 19-22". It is considered therein that the adhesion force between two substances is influenced by non-electrostatic attraction force, electrostatic attraction force, and the contact area therebetween. The electrostatic attraction force may be generated from a contact potential difference. The non-electrostatic attraction force may be generated from a difference in surface energy (e.g., wettability).

Generally, solid lubricants have low adhesive property. Therefore, the adhesion force between a solid lubricant and a photoreceptor is unlikely to drastically increase even if various surface controlling agents are included in the surface of the photoreceptor. In view of this situation, the inventors of the present invention focused on the contact area therebetween.

Figure 2:
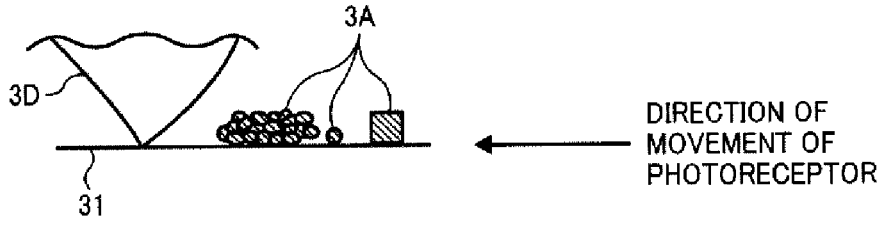
FIGS. 2 to 7 are schematic views illustrating various application conditions of a solid lubricant to a photoreceptor.
Figure 3:
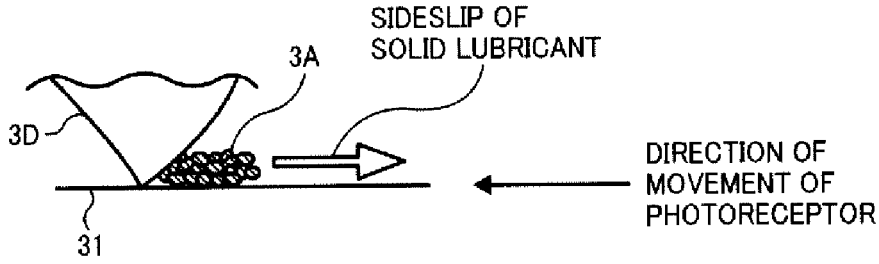
Figure 4:
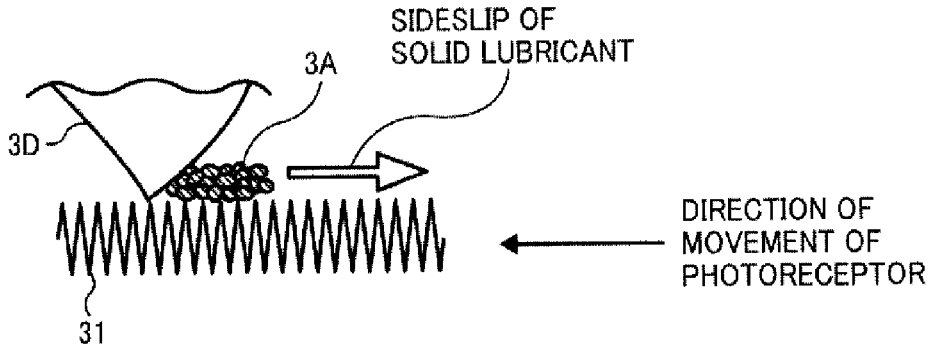

FIGS. 2 to 7 are schematic views illustrating various application conditions of a solid lubricant to a photoreceptor. As illustrated in FIG. 2, the solid lubricant 3A adhering to the photoreceptor 31 is in the form of a powder, an aggregation, or a solid block. When the surface of the photoreceptor 31 is smooth as illustrated in FIG. 3, the solid lubricant 3A cannot pass through an edge 3D of the application blade 39 and sideslips on the photoreceptor 31, and consequently releases from the surface of the photoreceptor 31. By contrast, when the surface of the photoreceptor 31 has an extreme irregularity as illustrated in FIG. 4, the solid lubricant 3A point-contacts the photoreceptor 31 and consequently releases from the surface of the photoreceptor 31 as well.

Figure 5:
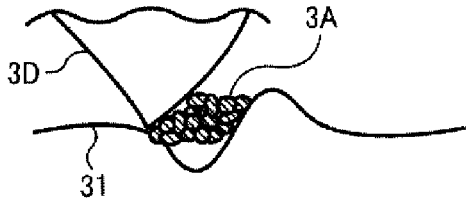

When the irregularity is not cyclic, sideslip of the solid lubricant 3A is prevented. However, in this case, an aggregation of the solid lubricant 3A point-contacts an edge of a convexity or concavity, as illustrated in FIG. 5, and consequently releases from the surface of the photoreceptor 31 as well.

Figure 6:
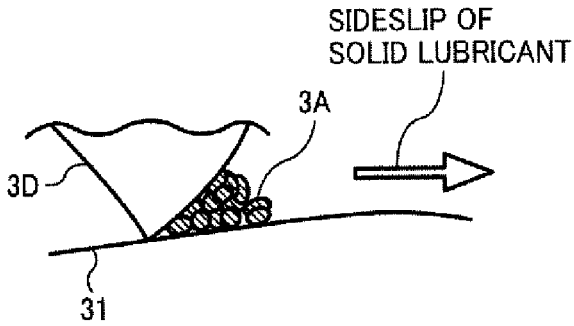
Figure 7:
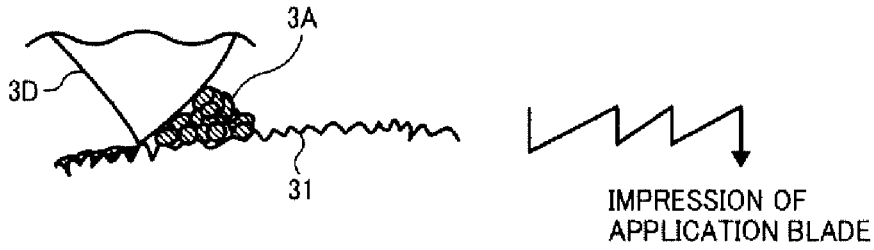

When the surface has a gentle irregularity as illustrated in FIG. 6, the solid lubricant 3A may pass through the edge 3D of the application blade 39 or may be extended on the surface of the photoreceptor 31, depending on the linear pressure of the application blade 39. When a high-frequency irregularity is further superimposed on the gentle irregularity that prevents sideslip of the solid lubricant 3A, as illustrated in FIG. 7, the solid lubricant 3A more strongly adheres to the photoreceptor 31. Namely, when the following inequations are satisfied, it means that the surface has a gentle (i.e., low-frequency) irregularity so that the solid lubricant 3A is extended thereon:

$$0.005 < WRa(LML) < 0.20$$

$$0.005 < WRa(LMH) < 0.03$$

and when the following inequation is satisfied, it means that the surface has a high-frequency irregularity so that the solid lubricant 3A strongly adheres thereto:

$$0.010 < WRa(LHH) < 0.03$$

A procedure for measuring WRa is described in detail below.

First, a surface of a photoreceptor is subjected to a measurement of a one-dimensional data array of a primary profile that is defined in JIS B0601.

The one-dimensional data array may be a digital signal directly obtained from a surface roughness & profile shape measuring instrument or that obtained by analog-digital conversion of an analog output of a surface roughness & profile shape measuring instrument.

According to JIS B0601, the evaluation length is preferably from 8 to 25 mm.

The sampling length is preferably 1 μm or less, and more preferably from 0.2 to 0.5 μm.

For example, when the evaluation length is 12 mm and the number of sampling points is 30,720, the sampling length becomes 0.390625 μm, which is within the above preferable range.

The one-dimensional data array is subjected to wavelet transformation multiresolution analysis so as to be separated into plural frequency components, ranging from high-frequency components to low-frequency components. A one-dimensional data array of the lowest-frequency component is thinned and further subjected to wavelet transformation multiresolution analysis so as to be separated into plural frequency components. The center-line average roughness WRa is calculated from each of the frequency components based on a method of calculating the center-line average roughness Ra that is defined in JIS B0601-1982.

As described above, wavelet transformation multiresolution analysis is performed twice. For the sake of simplicity, the first and second wavelet transformation multiresolution analysis may be hereinafter represented as MRA-1 and MRA-2, respectively. The frequency components are distinguished by prefixes H and L indicating the results of the first and second wavelet transformation, respectively.

Mother wavelet functions usable for the first and second wavelet transformation may be the Daubecies function, Harr function, Meyer function, Symlet function, or Coiflet function, for example. In the present embodiment, the Harr function is used as the mother wavelet function.

As a result of the wavelet transformation multiresolution analysis, the number of resultant frequency components is preferably from 4 to 8. In the present embodiment, the number of resultant frequency components is 6.

In the first wavelet transformation, a one-dimensional data array is separated into plural frequency components. Another one-dimensional data array is created from the lowest-frequency component and is thinned. The thinned one-dimensional data array is subjected to the second wavelet transformation so as to be separated into plural frequency components.

The lowest-frequency component obtained in the first wavelet transformation is thinned so that the number of data array is reduced to from 1/10 to 1/100. In other words, the thinning factor is from 1/10 to 1/100.

Such a thinning treatment of data increases the frequency of data. For example, when a one-dimensional data array including 30,000 data arrays obtained in the first wavelet transformation is thinned so that the number of data arrays is reduced to 1/10, the thinned one-dimensional data array includes 3,000 data arrays.

When the thinning factor is less than 1/10, for example, 1/5, the frequency of data may not increase. In this case, the second wavelet transformation multiresolution analysis may result in insufficient data separation.

When the thinning factor is greater than 1/100, for example, 1/200, the frequency of data may increase too much. In this case, the second wavelet transformation multiresolution analysis may result in insufficient data separation such that the resulting frequency components concentrate at high frequencies.

In the present embodiment, the thinning factor is 1/40.

Figure 8:
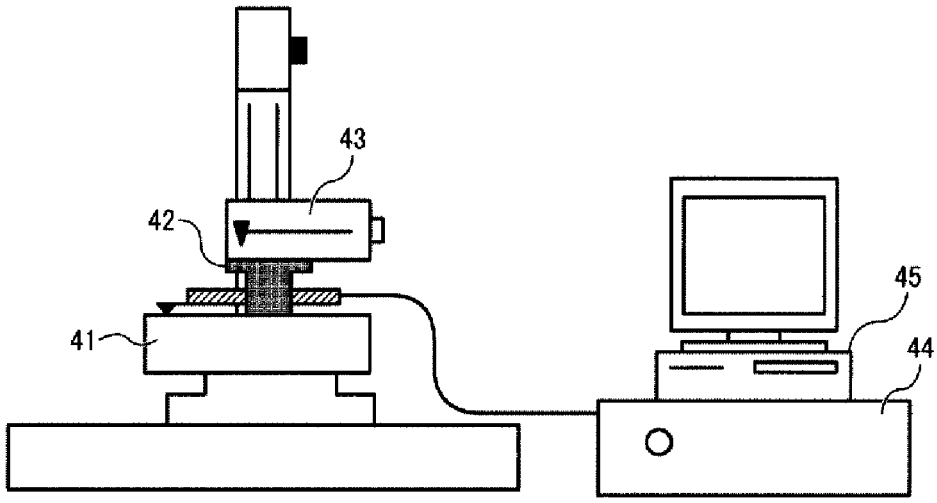
FIG. 8 is a schematic view illustrating an example embodiment of a surface profile evaluating device.

FIG. 8 is a schematic view illustrating an example embodiment of a surface profile evaluating device. In FIG. 8, a numeral 41 denotes a photoreceptor, a numeral 42 denotes a jig equipped with a probe for measuring surface roughness, a numeral 43 denotes a unit for moving the jig 42 along a measuring object, a numeral 44 denotes a surface roughness & profile shape measuring instrument, and a numeral 45 denotes a personal computer for analyzing data signals. The personal computer 45 performs the multiresolution analysis. When the photoreceptor 41 has a cylindrical shape, the measurement can be performed both in the peripheral and longitudinal directions.

The embodiment of the surface profile evaluation device is not limited to that illustrated in FIG. 8. For example, the multiresolution analysis may be preformed by a numerical calculation processor. Alternatively, the multiresolution analysis may be performed by the surface roughness & profile shape measuring instrument itself.

The analysis results may be displayed on a CRT or a liquid crystal display or may be print-outputted. Alternatively, the analysis results may be transmitted to another device as electric signals or stored on a USB memory or a MO disc.

In the present embodiment, a surface texture and contour measuring instrument SURFCOM 1400D (from Tokyo Seimitsu Co., Ltd.) is used as the surface roughness & profile shape measuring instrument 44 and a personal computer from IBM is used as the personal computer 45, and the SURFCOM 1400D and the personal computer are connected with RS-232-C cable. Surface roughness data is transmitted from the SURFCOM 1400D to the personal computer and is subjected to data processing and multiresolution analysis using a software program written in C language by the inventors of the present invention.

The procedure for the multiresolution analysis of a surface profile of a photoreceptor is described in detail below.

First, a primary profile of a photoreceptor is measured with a surface texture and contour measuring instrument SURFCOM 1400D (from Tokyo Seimitsu Co., Ltd.). The evaluation length per measurement is 12 mm. The total number of sampling points is 30,720, and 4 sampling points are measured per measurement. The measurement results are transmitted to a personal computer and subjected to the first wavelet transformation with a software program written by the inventors. The lowest-frequency component is subjected to a thinning treatment with a thinning factor of 1/40, and then subjected to the second wavelet transformation.

Figure 9A:
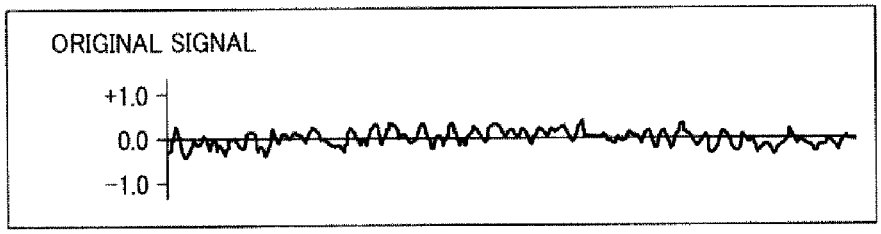
FIGS. 9A to 9C show example results of the wavelet transformation multiresolution analysis.
Figure 9B:
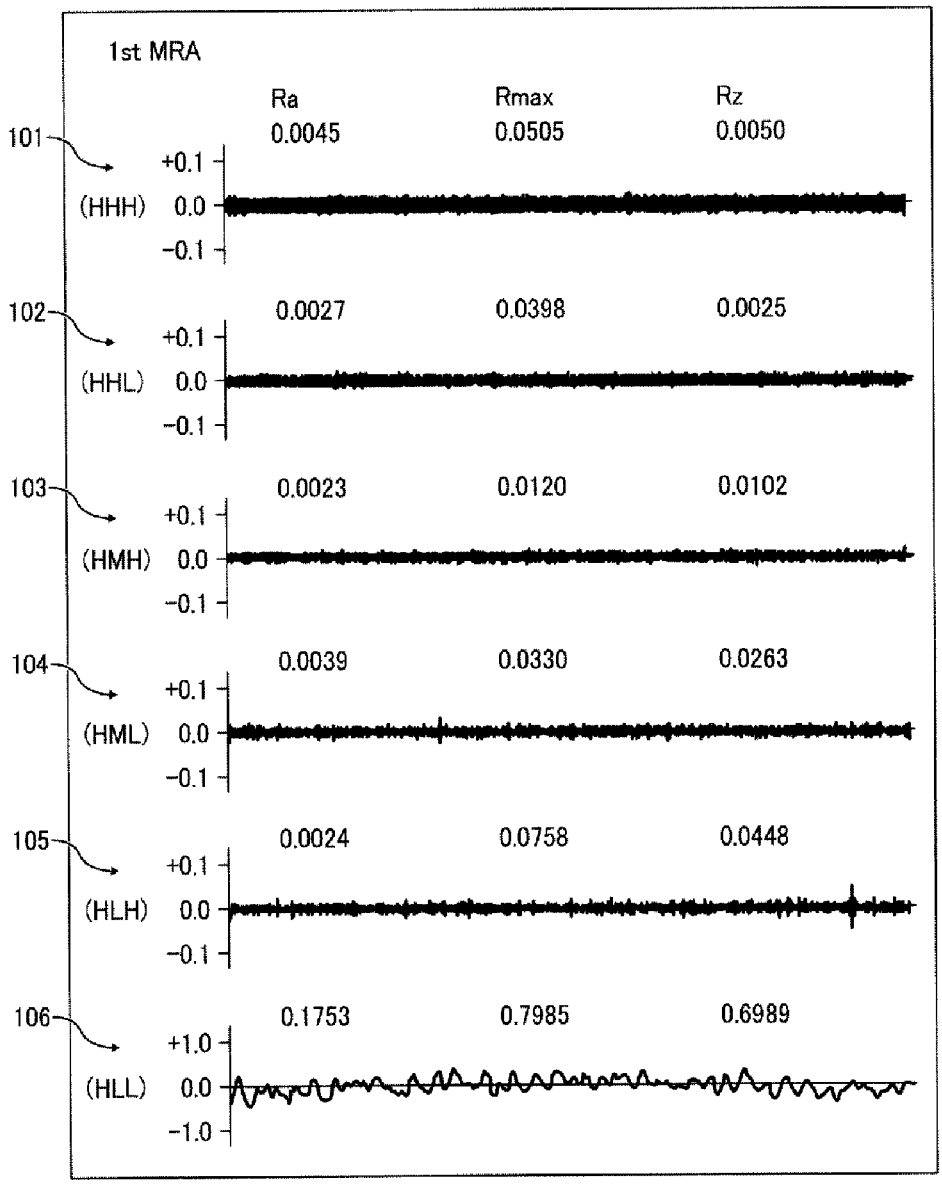
Figure 9C:
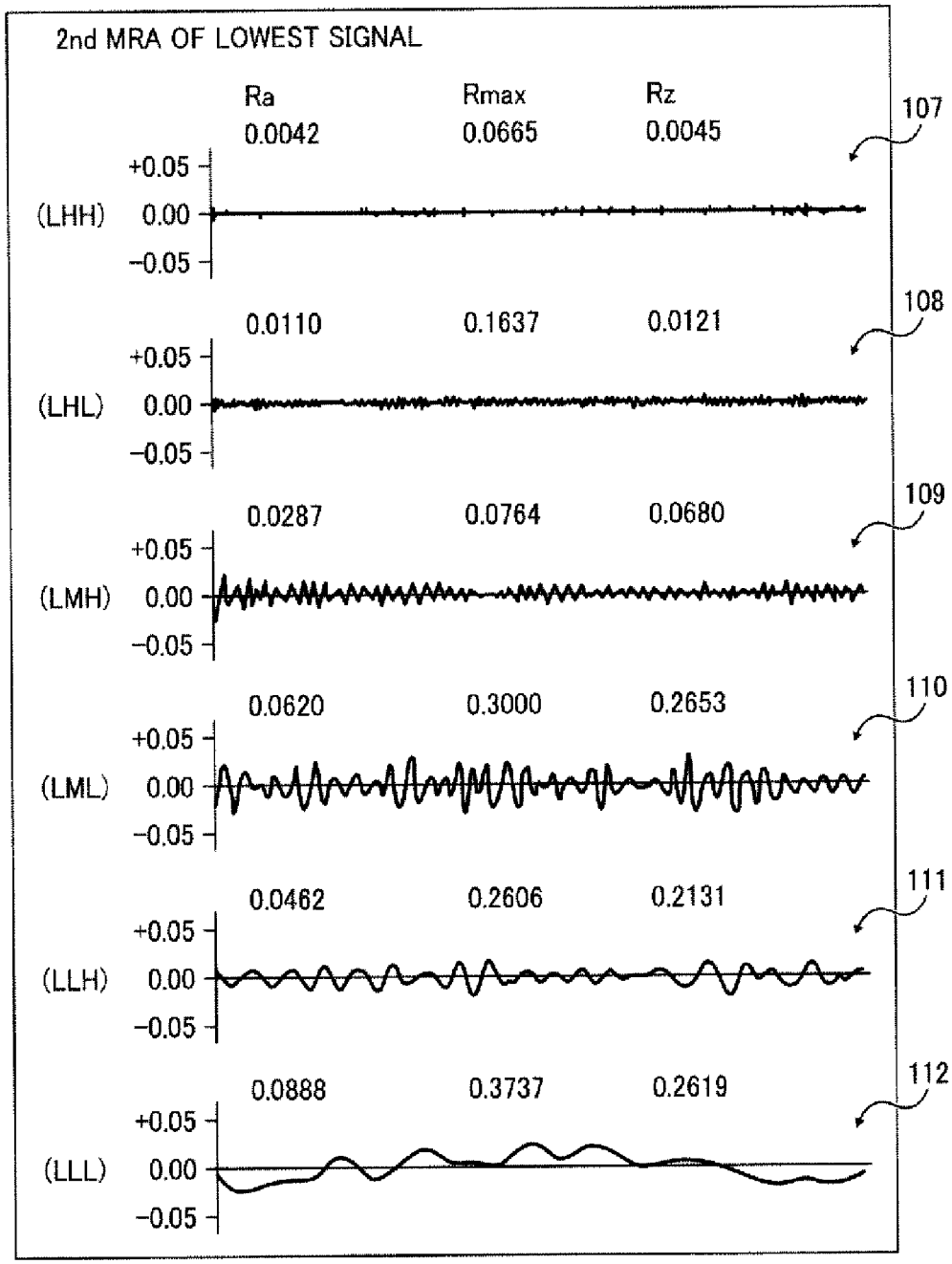

The resultant curves of the first and second multiresolution analysis are subjected to calculation of the center-line average roughness Ra, maximum height, Rmax, and ten points average roughness Rz according to JIS B0601-1982. FIGS. 9A to 9C show example results of the wavelet transformation multiresolution analysis.

In FIGS. 9A to 9C, the vertical axes are displacement scales (μm) of surface profile. The lateral axes are evaluation length scales. In the present embodiment, the evaluation length is 12 mm.

FIG. 9A is a primary profile obtained with the SURFCOM 1400D. Conventionally, the center-line average roughness Ra, maximum height, Rmax, and ten points average roughness Rz according to JIS B0601-1982 are calculated only from this primary profile.

FIG. 9B shows 6 frequency components obtained in the first multiresolution analysis. A curve 101 is the highest-frequency component and a curve 106 is the lowest-frequency component.

The curve 101 is the highest-frequency component having a frequency of from 0 to 3 μm obtained in the first multiresolution analysis, which may be hereinafter represented as HHH.

The curve 102 is the second highest-frequency component having a frequency of from 1 to 6 μm obtained in the first multiresolution analysis, which may be hereinafter represented as HHL.

The curve 103 is the third highest-frequency component having a frequency of from 2 to 13 μm obtained in the first multiresolution analysis, which may be hereinafter represented as HMH.

The curve 104 is the fourth highest-frequency component having a frequency of from 4 to 25 μm obtained in the first multiresolution analysis, which may be hereinafter represented as HML.

The curve 105 is the fifth highest-frequency component having a frequency of from 10 to 50 μm obtained in the first multiresolution analysis, which may be hereinafter represented as HLH.

The curve 106 is the lowest-frequency component having a frequency of from 24 to 99 μm obtained in the first multiresolution analysis, which may be hereinafter represented as HLL.

The primary profile illustrated in FIG. 9A is separated into 6 curves that are illustrated in FIG. 9B based on the frequency.

Figure 10:
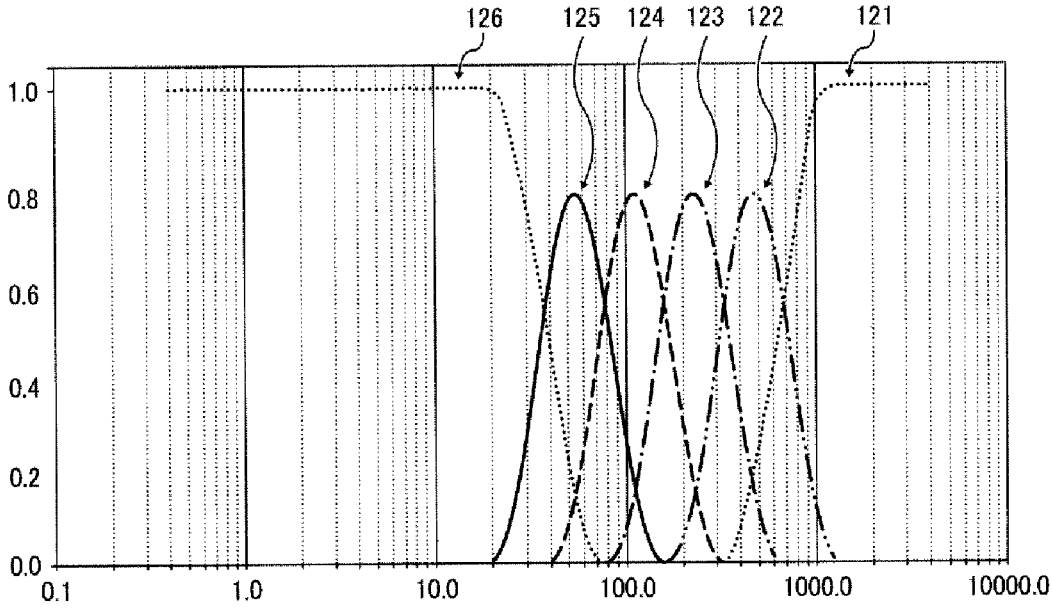
FIG. 10 is a graph showing frequency bands separated in the first multiresolution analysis.

FIG. 10 is a graph showing frequency bands separated in the first multiresolution analysis. The lateral axis represents the number of peaks and valleys per 1 mm when assuming a profile as a sine curve. The vertical axis represents the ratio of each of the frequency bands.

In FIG. 10, a curve 121 is a band of the highest-frequency component in the first multiresolution analysis. A curve 122 is a band of the second highest-frequency component in the first multiresolution analysis. A curve 123 is a band of the third highest-frequency component in the first multiresolution analysis. A curve 124 is a band of the fourth highest-frequency component in the first multiresolution analysis. A curve 125 is a band of the fifth highest-frequency component in the first multiresolution analysis. A curve 126 is a band of the lowest-frequency component in the first multiresolution analysis.

FIG. 10 indicates that when the number of peaks and valleys per 1 mm is 20 or less, it appears in the curve 126 only.

When the number of peaks and valleys per 1 mm is 110, it most strongly appears in the curve 124 corresponding to the curve 104 (HML) in FIG. 9B.

When the number of peaks and valleys per 1 mm is 220, it most strongly appears in the curve 123 corresponding to the curve 103 (HMH) in FIG. 9B.

When the number of peaks and valleys per 1 mm is 310, it appears in the curves 122 and 123 corresponding to the curves 102 (HHL) and 103 (HM), respectively, in FIG. 9B.

It depends on the frequency of a surface roughness in which curve in FIG. 9B it may appear.

In other words, relatively fine irregularities appear in the curves in the upper side of FIG. 9B while relatively coarse irregularities appear in the curves in the lower side of FIG. 9B.

Namely, a surface profile measured with a surface roughness & profile shape measuring instrument is separated into the plural curves 101 to 106 based on the frequency, as illustrated in FIG. 9B. Therefore, the number of peaks and valleys in each frequency band can be separately measured.

The curves 101 to 106 are further subjected to the calculation of the center-line average roughness Ra, maximum height, Rmax, and ten points average roughness Rz according to JIS B0601-1982. The calculated values thereof are shown in FIG. 9B.

The lowest-frequency component, i.e., the curve 106 (HLL) is further subjected to a thinning treatment.

How to thin the curve, in other words, how many datum are thinned in the thinning treatment may be experimentally optimized. The optimization of the thinning treatment may result in the optimization of the separation of frequency bands in the first multiresolution analysis so that a desired frequency appears in the center of a band.

Figure 11:
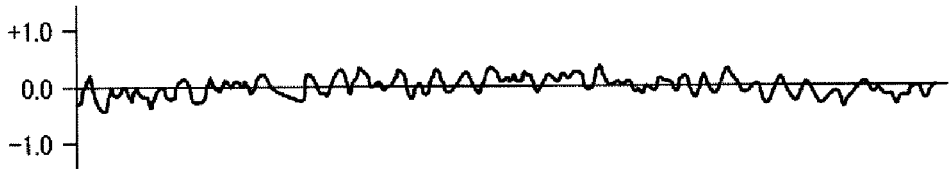
FIG. 11 is the result of the thinning treatment of the curve 106 (HLL) in FIG. 9.

In the present embodiment, 1 datum is removed from 40 data in the thinning treatment. FIG. 11 is the result of the thinning treatment of the curve 106 (HLL) in FIG. 9B. The vertical axis is a displacement scale (μm) of surface profile. The lateral axis is an evaluation length scale. In the present embodiment, the evaluation length is 12 mm.

The thinned curve 106 (HLL) shown in FIG. 11 is further subjected to the second multiresolution transformation.

FIG. 9C shows 6 frequency components obtained in the second multiresolution analysis.

A curve 107 is the highest-frequency component having a frequency of from 26 to 106 μm obtained in the second multiresolution analysis, which may be hereinafter represented as LHH.

A curve 108 is the second highest-frequency component having a frequency of from 53 to 183 μm obtained in the second multiresolution analysis, which may be hereinafter represented as LHL.

A curve 109 is the third highest-frequency component having a frequency of from 106 to 318 μm obtained in the second multiresolution analysis, which may be hereinafter represented as LMH.

A curve 110 is the fourth highest-frequency component having a frequency of from 214 to 551 μm obtained in the second multiresolution analysis, which may be hereinafter represented as LML.

A curve 111 is the fifth highest-frequency component having a frequency of from 431 to 954 μm obtained in the second multiresolution analysis, which may be hereinafter represented as LLH.

A curve 112 is the lowest-frequency component having a frequency of from 867 to 1654 μm obtained in the second multiresolution analysis, which may be hereinafter represented as LLL.

Figure 12:
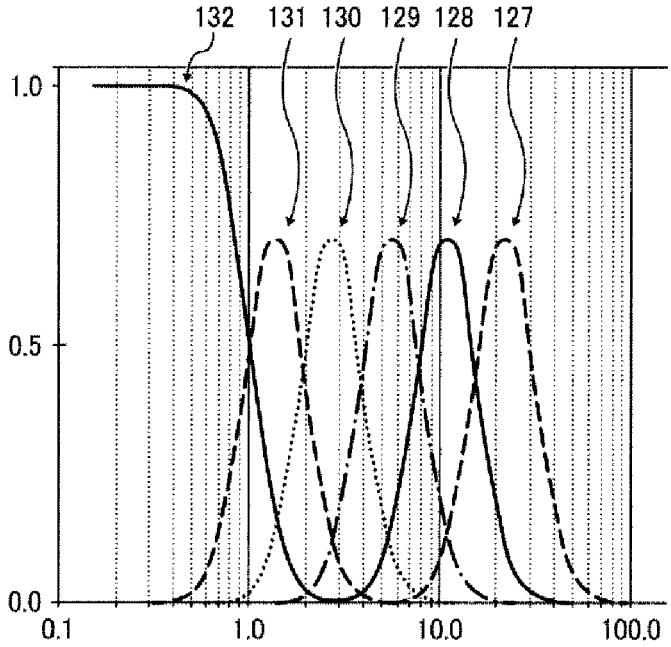
FIG. 12 is a graph showing frequency bands separated in the second multiresolution analysis.

FIG. 12 is a graph showing frequency bands separated in the second multiresolution analysis. The lateral axis represents the number of peaks and valleys per 1 mm when assuming a profile as a sine curve. The vertical axis represents the ratio of each of the frequency bands.

In FIG. 12, a curve 127 is a band of the highest-frequency component in the second multiresolution analysis. A curve 128 is a band of the second highest-frequency component in the second multiresolution analysis. A curve 129 is a band of the third highest-frequency component in the second multiresolution analysis. A curve 130 is a band of the fourth highest-frequency component in the second multiresolution analysis. A curve 131 is a band of the fifth highest-frequency component in the second multiresolution analysis. A curve 132 is a band of the lowest-frequency component in the second multiresolution analysis.

FIG. 12 indicates that when the number of peaks and valleys per 1 mm is 0.2 or less, it appears in the curve 132 only.

When the number of peaks and valleys per 1 mm is 11, it most strongly appears in the curve 128 corresponding to the curve 110 (LML) in FIG. 9C.

It depends on the frequency of a surface roughness in which curve in FIG. 9C it may appear.

In other words, relatively fine irregularities appear in the curves in the upper side of FIG. 9C while relatively coarse irregularities appear in the curves in the lower side of FIG. 9C.

Namely, a surface profile is separated into the plural curves 107 to 112 based on the frequency, as illustrated in FIG. 9C. Therefore, the number of peaks and valleys in each frequency band can be separately measured.

The curves 107 to 112 are further subjected to the calculation of the center-line average roughness Ra (i.e., WRa), maximum height, Rmax, and ten points average roughness Rz according to JIS B0601-1982. The calculated values thereof are shown in the chart (c).

The results of the above example are shown in Table 1.

TABLE 1

| Multiresolution | | Surface Roughness (μm) | | |
|---|---|---|---|---|
| Analysis | Signals | Ra | Rmax | Rz |
| $1^{st}$ | HHH | 0.0045 | 0.0505 | 0.0050 |
| | HHL | 0.0027 | 0.0398 | 0.0025 |
| | HMH | 0.0023 | 0.0120 | 0.0102 |
| | HML | 0.0039 | 0.0330 | 0.0263 |
| | HLH | 0.0024 | 0.0758 | 0.0448 |
| | HLL | 0.1753 | 0.7985 | 0.6989 |
| $2^{nd}$ | LHH | 0.0042 | 0.0665 | 0.0045 |
| | LHL | 0.0110 | 0.1637 | 0.0121 |
| | LMH | 0.0287 | 0.0764 | 0.0680 |
| | LML | 0.0620 | 0.3000 | 0.2653 |
| | LLH | 0.0462 | 0.2606 | 0.2131 |
| | LLL | 0.0888 | 0.3737 | 0.2619 |

In the same manner as above, photoreceptors prepared in the later-described Examples and Comparative Examples are subjected to the wavelet transformation multiresolution analysis to calculate WRa of each frequency component. The photoreceptors are further subjected to a solid lubricant receptivity test described later. A relation between WRa and solid lubricant receptivity, more specifically, contributing rate of each frequency component to solid lubricant receptivity, is estimated by multivariate analysis using a statistical software program JMP Ver. 5.01a (from SAS Institute).

Roughening of a surface of a photoreceptor can be achieved by adding a material (e.g., a filler) capable of controlling surface profile to a surface layer coating liquid, controlling photoreceptor manufacturing conditions, or undergoing a mechanical treatment, for example.

Next, the electrophotographic photoreceptor of the present invention is described in detail.

Figure 13:
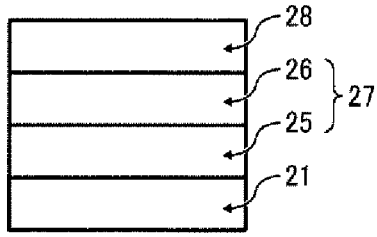
FIG. 13 is a schematic view illustrating an embodiment of the photoreceptor of the present invention.

FIG. 13 is a schematic view illustrating an embodiment of the photoreceptor of the present invention which includes, in order from an innermost side thereof, a conductive substrate 21, a photosensitive layer 27 including a charge generation layer 25 and a charge transport layer 26, and a surface layer 28.

Figure 14:
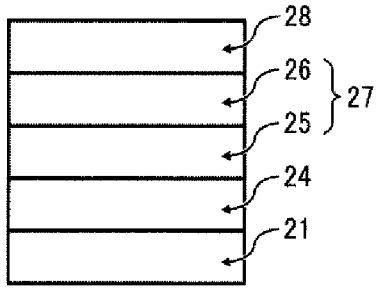
FIG. 14 is a schematic view illustrating another embodiment of the photoreceptor of the present invention.

FIG. 14 is a schematic view illustrating another embodiment of the photoreceptor of the present invention which includes, in order from an innermost side thereof, a conductive substrate 21, an undercoat layer 24, a photosensitive layer 27 including a charge generation layer 25 and a charge transport layer 26, and a surface layer 28.

Suitable materials for the conductive substrate 21 include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate 21, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments.

The undercoat layer 24 may be provided between the conductive substrate 21 and the photosensitive layer 27, as illustrated in FIG. 14, for the purpose of improving adhesion and coating properties of the upper layer and preventing the occurrence of moiré and charge injection from the conductive substrate 21.

The undercoat layer 24 is comprised primarily of a resin. Because the photosensitive layer 27 is coated on the undercoat layer 24, the undercoat layer 24 preferably comprises a thermosetting resin that has poor solubility in organic solvents. Specific preferred examples of such resins include, but are not limited to, polyurethane resins, melamine resins, and alkyd-melamine resins. The undercoat layer 24 may be formed by coating a coating liquid in which a resin is dissolved in a solvent such as tetrahydrofuran, cyclohexane, dioxane, dichloroethane, and butanone.

The undercoat layer 24 may include fine particles of a metal or a metal oxide for the purpose of controlling conductivity and preventing the occurrence of moiré. Specifically, titanium oxides are preferable.

The fine particles may be subjected to a dispersion treatment using a ball mill, an attritor, a sand mill, or the like, with a solvent such as tetrahydrofuran, cyclohexanone, dioxane, dichloroethane, and butanone, and then mixed with a resin to prepare a coating liquid.

The undercoat layer 24 is formed by applying the coating liquid to the conductive substrate 21 by a dip coating method, a spray coating method, a bead coating method, or the like, upon application of heating, if needed.

The undercoat layer 24 generally has a thickness of from 2 to 5 μm, and preferably less than 3 μm to reduce residual potential.

The photosensitive layer 27 may be a multilayer including the charge generation layer 25 and the charge transport layer 26.

The charge generation layer 25 has a function of generating charge upon exposure to light. The charge generation layer 25 includes a charge generation material as the main component and may include a binder resin, if needed. Suitable charge generation materials include both inorganic materials and organic materials.

Specific examples of usable inorganic materials for the charge generation material include, but are not limited to, crystalline selenium, amorphous selenium, selenium-tellurium, selenium-tellurium-halogen, selenium-arsenic compounds, and amorphous silicon. An amorphous silicon in which dangling bonds are terminated with a hydrogen or halogen atom and an amorphous silicon doped with a boron or phosphor atom are also preferable.

Specific examples of usable organic materials for the charge generation material include, but are not limited to, metal phthalocyanines such as titanyl phthalocyanine and chlorogallium phthalocyanine; metal-free phthalocyanines; azulenium salt pigments; squaric acid methine pigments; symmetric or asymmetric azo pigments having a carbazole skeleton; symmetric or asymmetric azo pigments having a triphenylamine skeleton; symmetric or asymmetric azo pigments having a fluorenone skeleton; and perylene pigments.

Among these materials, metal phthalocyanines, symmetric or asymmetric azo pigments having a fluorenone skeleton, symmetric or asymmetric azo pigments having a triphenylamine skeleton, and perylene pigments are preferable because they have a high charge generation quantum efficiency. These materials can be used alone or in combination.

Specific examples of usable binder resins for the charge generation layer 25 include, but are not limited to, polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, and polyacrylamide. Additionally, charge transport polymers, to be described in detail later, are also usable as the binder resin. Among these resins, polyvinyl butyral is preferable. These resins can be used alone or in combination.

The charge generation layer 25 may be formed by a vacuum method or a casting method.

The former includes a vacuum deposition method, a glow discharge decomposition method, an ion plating method, a sputtering method, a reactive sputtering method, and a CVD (chemical vapor deposition) method, for example. These methods can form a layer comprising the above-described inorganic or organic material in good condition.

In the latter, first, the above-described inorganic or organic material, optionally along with a binder resin, is dispersed in a solvent such as methyl ethyl ketone, tetrahydrofuran, cyclohexanone, dioxane, dichloroethane, and butanone, using a ball mill, an attritor, a sand mill, or the like. The resultant dispersion may be diluted as appropriate. Among these solvents, methyl ethyl ketone, tetrahydrofuran, and cyclohexanone are more preferable compared to chlorobenzene, dichloromethane, toluene, or xylene, because of being environmentally-friendly. The dispersion is coated by a dip coating method, a spray coat method, a bead coat method, or the like.

The charge generation layer 25 preferably has a thickness of from 0.01 to 5 μm. Reduction of residual potential and increase of sensitivity may be achieved by thickening the charge generation layer 25. At the same time, deterioration of chargeability (such as charge retention ability and formation of space charge) is caused by thickening of the charge generation layer 25. To balance these properties, the charge generation layer 25 more preferably has a thickness of from 0.05 to 2 μm.

The charge generation layer 25 may optionally include a low-molecular-weight compound such as an antioxidant, a plasticizer, a lubricant, and an ultraviolet absorber, and/or a leveling agent. These compounds can be used alone or in combination. Because too large an amount of a low-molecular-weight compound and/or a leveling agent may cause deterioration of sensitivity, the content thereof in the charge generation layer 25 is preferably from 0.1 to 20 parts by weight, more preferably from 0.1 to 10 parts by weight, and most preferably from 0.001 to 0.1 parts by weight, based on 100 parts by weight of resins.

The charge transport layer 26 has a function of transporting charges generated in the charge generation layer 25 so as to neutralize charges on the surface of the photoreceptor. The charge transport layer 26 is comprised primarily of a charge transport material and a binder resin.

Charge transport materials include low-molecular-weight electron transport materials, hole transport materials, and charge transport polymers.

Specific examples of usable electron transport materials include, but are not limited to, electron accepting materials such as asymmetric diphenoquinone derivatives, fluorene derivatives, and naphthalimide derivatives. These electron transport materials can be used alone or in combination.

Specific examples of usable hole transport materials include, but are not limited to, electron releasing materials such as oxazole derivatives, oxadiazole derivatives, imidazole derivatives, triphenylamine derivatives, butadiene derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. These hole transport materials can be used alone or in combination.

Specific examples of usable charge transport polymers include, but are not limited to, polymers having a carbazole ring such as poly-N-vinylcarbazole; polymers having a hydrazone structure described in JP-A 57-78402, the disclosure thereof being incorporated herein by reference; polysilylene polymers described in JP-A 63-285552, the disclosure thereof being incorporated herein by reference; and aromatic polycarbonates represented by the general formulae (1) to (6) in JP-A 2001-330973, the disclosure thereof being incorporated herein by reference. These charge transport polymers can be used alone or in combination. Among these compounds, aromatic polycarbonates described in JP-A 2001-330973 are preferable because of having good electrostatic properties.

Compared to low-molecular-weight charge transport materials, charge transport polymers are more advantageous because they can prevent migration of materials composing the charge transport layer 26 to the surface layer 28 such as a cross-linked resin surface layer and a thermoplastic resin surface layer, which may cause insufficient hardening of the cross-linked resin surface layer. Additionally, because charge transport polymers (i.e., high-molecular-weight charge transport materials) have excellent heat resistance, the charge transport layer 26 is unlikely to deteriorate due to hardening heat of the surface layer 28 such as a cross-linked resin surface layer and a thermoplastic resin surface layer.

Specific examples of usable binder resins for the charge transport layer 26 include, but are not limited to, thermoplastic and thermosetting resins such as polystyrene, polyester, polyvinyl, polyarylate, polycarbonate, acrylic resins, silicone resins, fluorocarbon resins, epoxy resins, melamine resins, urethane resins, phenol resins, and alkyd resins. Among these materials, polystyrene, polyester, polyarylate, and polycarbonate are preferable because of having excellent charge transportability. The charge transport layer 26 is not required to have mechanical strength because the surface layer 28 is provided thereon. Therefore, materials with high transparency and low mechanical strength, such as polystyrene, which have not been practically used, can also be used as the binder resin for the charge transport layer 26.

The above-described binder resins can be used alone or in combination. Alternatively, 2 or more monomers of the binder resins may be copolymerized with each other, or further copolymerized with a charge transport material.

Electrically-inactive polymers that include no photoconductive chemical structure (e.g., a triarylamine structure) may be added to the charge transport layer 26 for its reformulation. For example, the following compounds are usable: Cardo polyesters having a bulky skeleton such as a fluorene skeleton; polyesters such as polyethylene terephthalate and polyethylene naphthalate; polycarbonates in which the 3,3' position of the phenol composition of a bisphenol-type polycarbonate is substituted with an alkyl group (e.g., C-type poly carbonates); polycarbonates in which a geminal methyl group of bisphenol A is substituted with a long-chain alkyl group having 2 or more carbon atoms; polycarbonates having a biphenyl or biphenyl ether skeleton; polycaprolactones; polycarbonates having a long-chain alkyl skeleton similar to a polycaprolactone, described in JP-A 07-292095, the disclosure thereof being incorporated herein by reference; acrylic resin; polystyrenes; and hydrogenated butadienes.

When the above compounds are used in combination with the binder resins, the content thereof in the charge transport layer 26 is preferably 50% or less by weight based on solid contents so as not to deteriorate sensitivity to light attenuation.

When the charge transport layer 26 includes a low-molecular-weight charge transport material, the content thereof is preferably from 40 to 200 parts by weight, more preferably from 70 to 100 parts by weight, based on 100 parts by weight of resins.

When the charge transport layer 26 includes a charge transport polymer (i.e., a high-molecular-weight charge transport material), the charge transport polymer is preferably a copolymer in which 100 parts by weight of a charge transport component and 0 to 200 parts by weight, more preferably from 80 to 150 parts by weight, of a resin component are copolymerized.

When the charge transport layer 26 includes 2 or more charge transport materials, the difference among the charge transport materials in ionization potential is preferably as small as possible. More specifically, the difference in ionization potential is preferably 0.10 eV or less. Within such a range, one charge transport material is prevented from trapping other transport materials.

Similarly, when the charge transport layer 26 includes a charge transport material and a curable charge transport material, to be described in detail later, the difference in ionization potential is preferably 0.10 eV or less.

The ionization potential of charge transport materials can be measured with an atmospheric photoemission yield spectroscopic instrument AC-1 from Riken Keiki Co., Ltd.

To achieve high sensitivity, the charge transport layer 26 preferably includes a charge transport material in an amount of 70 parts or more by weight based on 100 parts by weight of resins. In particular, monomers and dimers of α-phenylstilbene compounds, benzidine compounds, and butadiene compounds, and charge transport polymers having a main chain or a side chain with the structure of the above monomers and dimers, are preferable for the charge transport material because of having high charge transportability.

Specific examples of usable solvents for coating the charge transport layer 26 include, but are not limited to, ketones (e.g., methyl ethyl ketone, acetone, methyl isobutyl ketone, cyclohexanone); ethers (e.g., dioxane, tetrahydrofuran, ethyl cellosolve); aromatic solvents (e.g., toluene, xylene); halogen-containing solvents (e.g., chlorobenzene, dichloromethane); and esters (e.g., ethyl acetate, butyl acetate).

The charge transport layer 26 may be formed by coating a coating liquid in which a mixture or a copolymer comprised primarily of a charge transport material and a binder resin is dissolved or dispersed in the above-described solvent, followed by drying. The coating liquid may be coated by a dip coating method, a spray coating method, a ring coating method, a roll coater method, a gravure coating method, a nozzle coating method, or a screen printing method, for example.

Because the surface layer 28 is provided on the charge transport layer 26, the charge transport layer 26 may not be abraded. Therefore, it is not necessary to thicken the charge transport layer 26.

Accordingly, the charge transport layer 26 preferably has a thickness of from 10 to 40 μm, and more preferably from 15 to 30 μm, to have satisfactory sensitivity and chargeability.

The charge transport layer 26 may optionally include a low-molecular-weight compound such as an antioxidant, a plasticizer, a lubricant, and an ultraviolet absorber, and/or a leveling agent. These compounds can be used alone or in combination.

Because too large an amount of a low-molecular-weight compound and/or a leveling agent may cause deterioration of sensitivity, the content thereof in the charge transport layer 26 is preferably from 0.1 to 20 parts by weight, more preferably from 0.1 to 10 parts by weight, and most preferably from 0.001 to 0.1 parts by weight, based on 100 parts by weight of resins.

Preferably, the surface layer 28 is a cross-linked resin surface layer or a thermoplastic resin surface layer.

The cross-linked resin surface layer is a layer for protecting the surface of the photoreceptor. The cross-linked resin surface layer is formed by coating a coating liquid, upon which a polycondensation reaction takes place to form a resin having a cross-linked structure. Such a resin having a cross-liked structure has high abrasion resistance.

The cross-linked resin surface layer preferably includes a cross-linked body of a cross-linkable charge transport material. Specific examples of usable cross-linkable charge transport materials include, but are not limited to, polymerizable or cross-linkable monomers and oligomers such as chain-growth-polymerizable compounds having an acryloyloxy or styrene group; and step-growth-polymerizable compounds having a hydroxyl, alkoxysilyl, or isocyanate group. In view of electrophotographic properties, versatility, and manufacturing stability of the resultant photoreceptor, a combination of a hole transport material and a chain-growth-polymerizable compound is preferable. In particular, a cross-linked body of a compound including both a hole transport group and an acryloyloxy group is more preferable. Cross-linkable materials may be cross-linked upon application of heat, light, or radial ray. The cross-linked body preferably has a three-dimensional cross-linking structure.

Specific examples of usable polymerizable or cross-linkable materials further include compounds having a charge transport structure and 1 or more methacryloyloxy or acryloyloxy groups. Such compounds may be optionally used in combination with monomers or oligomers having no charge transport structure and 1 or more methacryloyloxy or acryloyloxy groups.

A coating liquid in which at least one compound described above is included is subjected to cross-linking and curing reactions upon application of energy such as heat, light, or radial ray such as electron beam and γ ray.

Preferably, the cross-linkable charge transport materials have a triarylamine structure. More preferably, the cross-linkable charge transport materials have a triarylamine structure having a monofunctional radical-polymerizable group, to cross-link with binder resins.

The following compound (A) is one preferred example for the cross-linkable charge transport material:

(A)

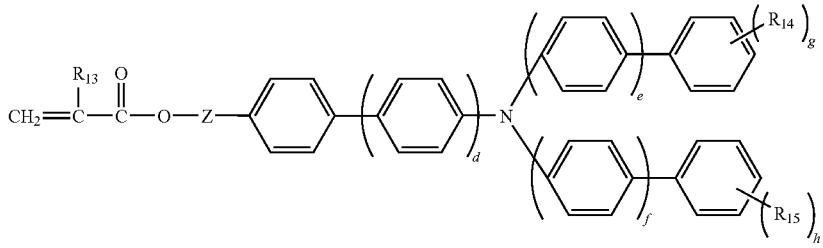

wherein each of d, e, and f independently represents an integer of 0 or 1; each of g and h independently represents an integer of from 0 to 3; $R_{13}$ represents a hydrogen atom or a methyl group; each of $R_{14}$ and $R_{15}$ independently represents an alkyl group having 1 to 6 carbon atoms, wherein multiple $R_{14}$ and $R_{15}$ may be, but need not necessarily be, the same; and Z represents a single bond, a methylene group, an ethylene group, —$CH_2CH_2O$—,

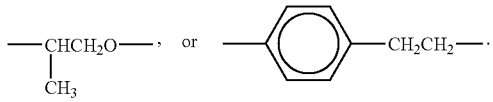

The following compounds (B) and (C) are also preferred examples for the cross-linkable charge transport material.

(B)

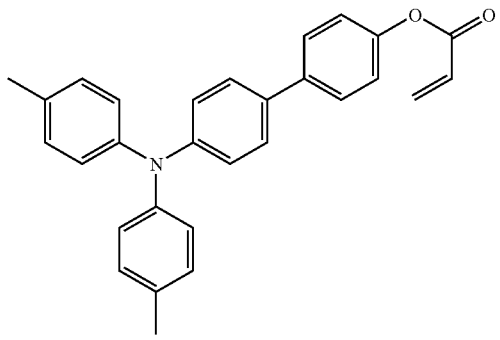

(2-[4'-(di-p-tolyl-amino)-biphenyl-4-yl]-ethyl acrylate)

(C)

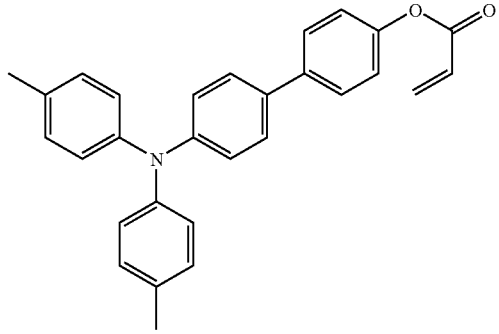

(2-[4'-(di-p-tolyl-amino)-biphenyl-4-yl]acrylate)

The following compounds No. 1 to No. 26 are also preferred examples for the cross-linkable charge transport material.

No. 1

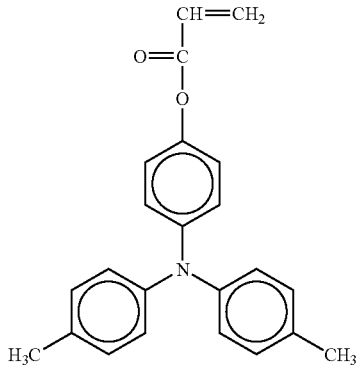

-continued
No. 2
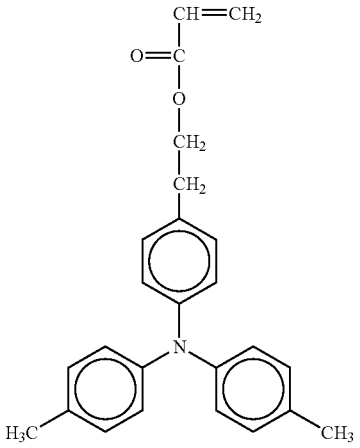
No. 3
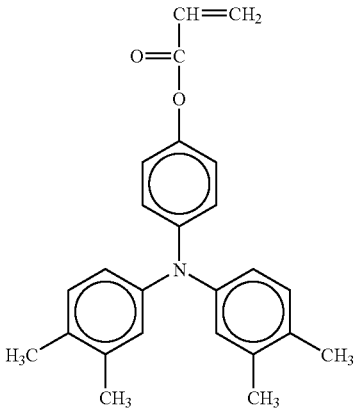
No. 4
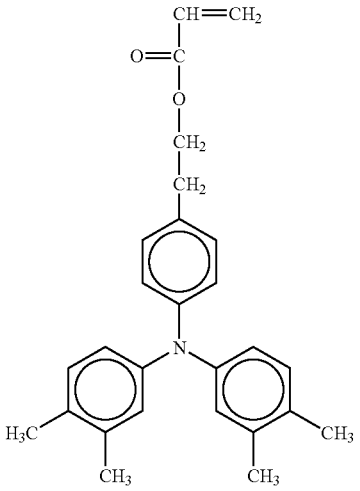
-continued
No. 5
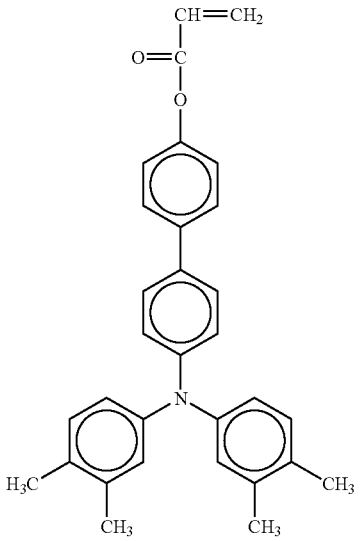
No. 6
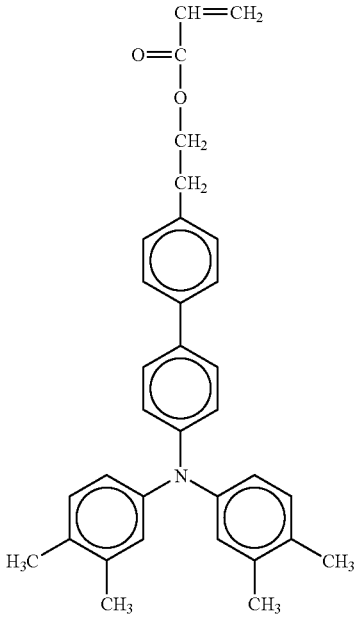

-continued
No. 7
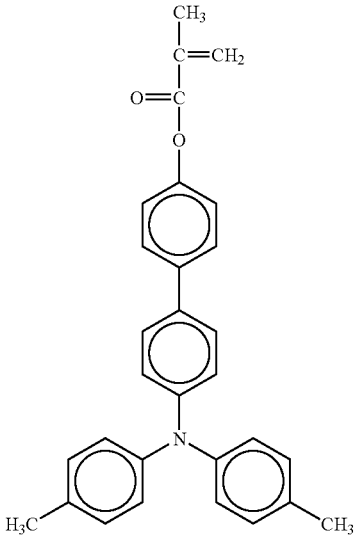
-continued
No. 9
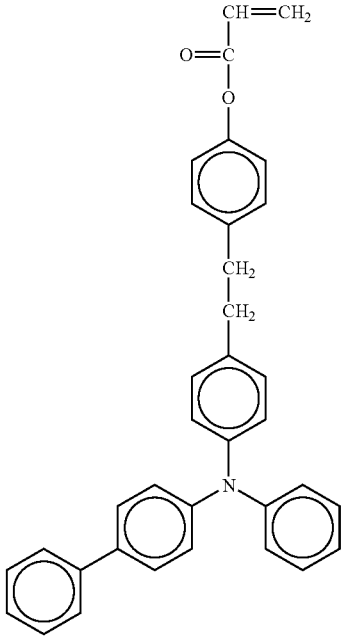
No. 8
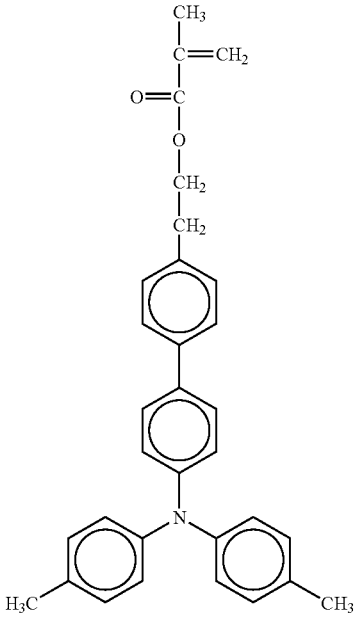
No. 10
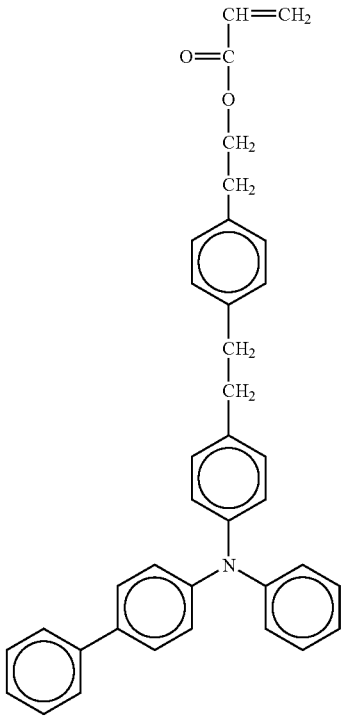

-continued
No. 11
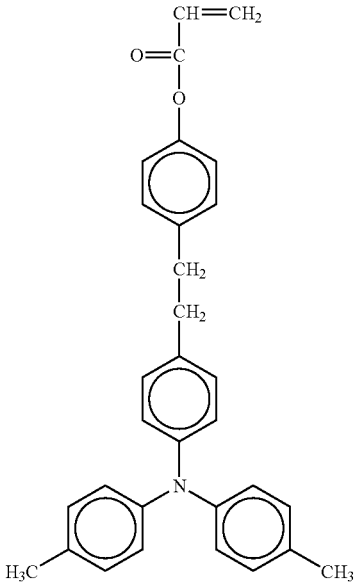
No. 12
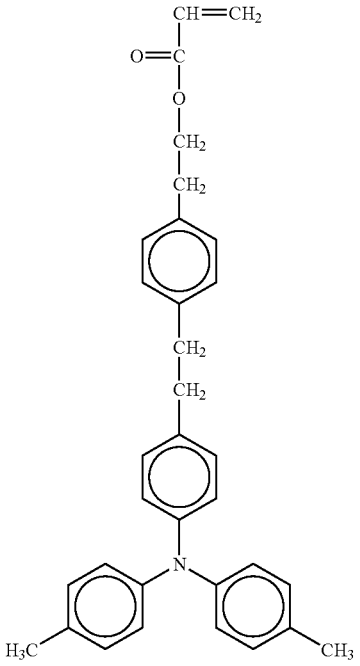
-continued
No. 14
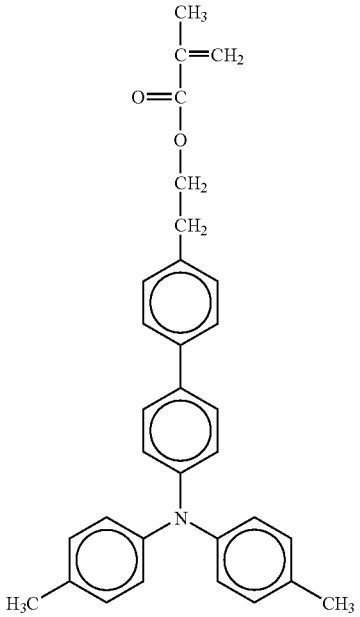
No. 15
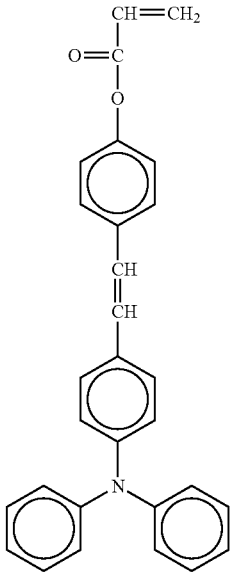

-continued
No. 16
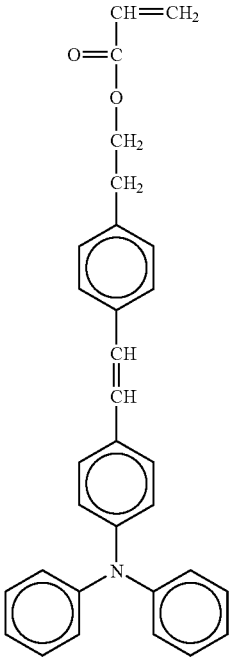
-continued
No. 18
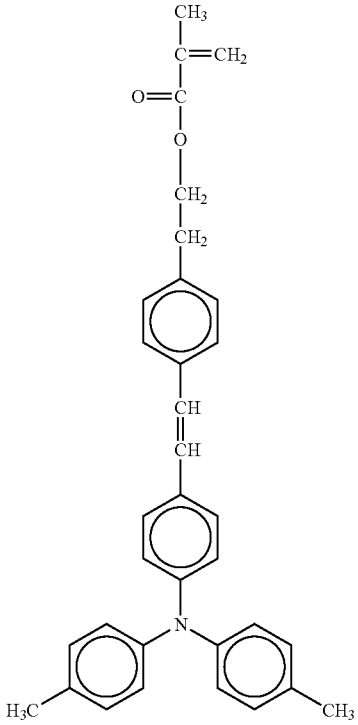
No. 17
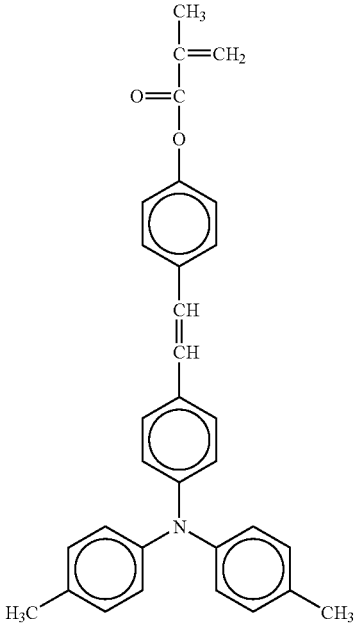
No. 19
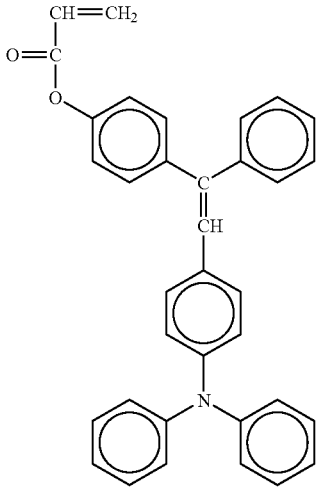

-continued
No. 20
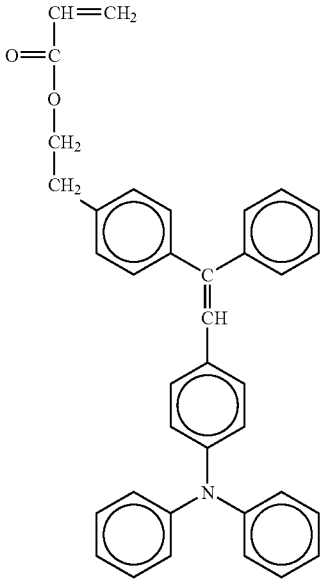
No. 21
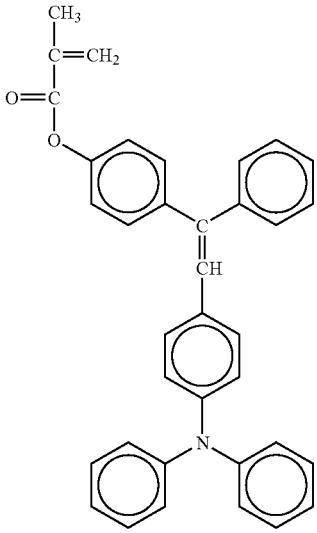
-continued
No. 22
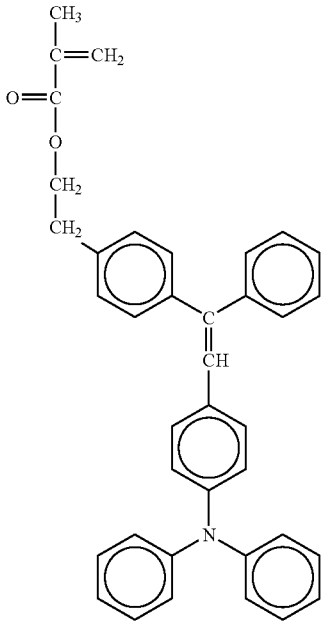
No. 23
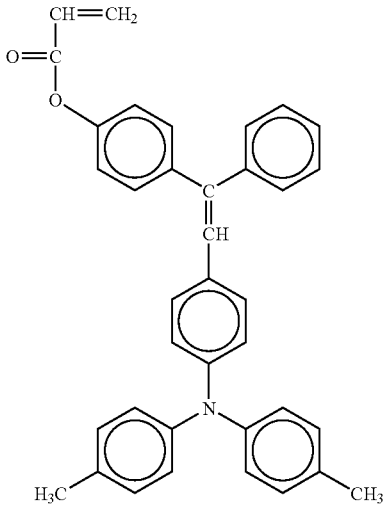

-continued

No. 24

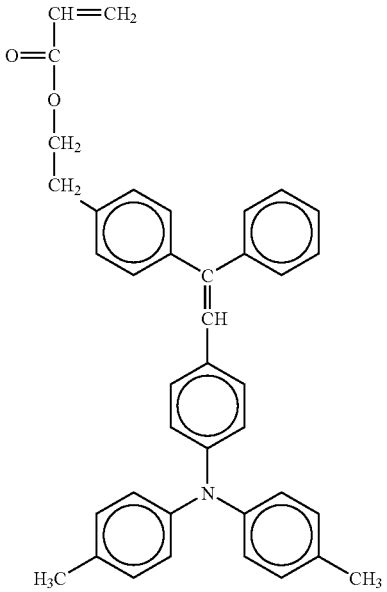

-continued

No. 26

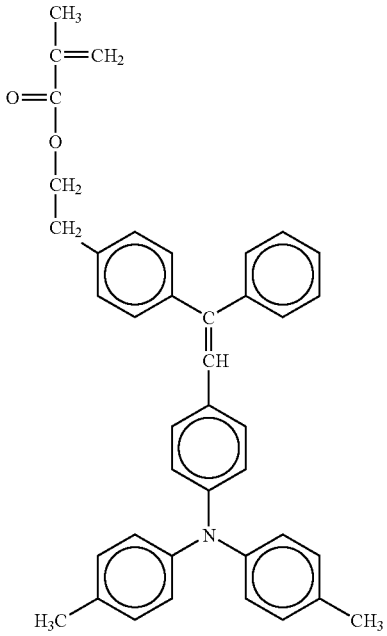

No. 25

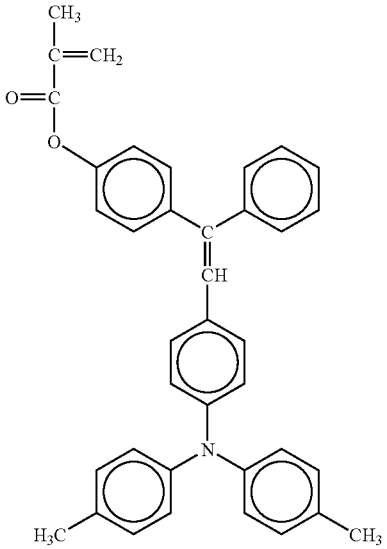

From the viewpoint of protection of the photosensitive layer 27, the cross-linked resin surface layer preferably has a thickness of from 3 to 15 μm, and more preferably from 2 to 10 μm. When the thickness is too small, the cross-linked resin surface layer may not protect the photosensitive layer 27 from mechanical abrasion applied from contacting members and electric discharge from a closely-disposed charger. Moreover, because such a thin layer is hard to level, an irregular surface with a texture like an orange peel may be produced. By contrast, when the thickness is too large, reproducibility of image may decrease due to the occurrence of charge diffusion. Additionally, when the thickness of the cross-linked resin surface layer is greater than that of the charge transport layer 26, bright section potential is likely to increase, which is not preferable.

In consideration of a case in which the surface of a photoreceptor has plural convexities and the thickness of the layer cannot be determined unambiguously, the thickness of the layer may be measured with a film thickness meter using the eddy current FISHERSCOPE® MMS® (from Fischer Instruments K.K.). The measurement may be performed at 4 or more points on a photoreceptor in the axial direction, and the measured values are averaged.

The cross-linked resin surface layer preferably includes the above-described cross-linkable charge transport material (A) in an amount of from 50 to 60% by weight. When the amount is too small, charge transportability may be poor and electric properties may deteriorate with repeated use, causing deterioration of sensitivity and increase of residual potential. When the amount is too large, the cross-linking density may decrease, resulting in poor abrasion resistance.

To more improve abrasion resistance, the cross-linked resin surface layer preferably includes a cross-linked body of a radical-polymerizable monomer having 3 or more radical-polymerizable functional groups, such as a cross-linked body of a trimethylolpropane triacrylate having 3 radical-polymerizable functional groups, as a binder material.

As another example, a cross-linked body of a caprolactone-modified dipentaerythritol hexaacrylate or a dipentaerythritol hexaacrylate may also be included in the cross-linked resin surface layer as the cross-linked body of a radical-polymerizable monomer having 3 or more radical-polymerizable functional groups. These materials may improve abrasion resistance and toughness of the layer.

The cross-linked resin surface layer preferably includes a cross-linked body of a trimethylolpropane triacrylate in an amount of 10% by weight or more and less than 50% by weight. When the amount is too small, the cross-linking density may be too low, resulting in poor mechanical strength. When the amount is too large, electric properties may be poor.

Specific examples of usable radical-polymerizable monomers having 3 or more functional groups which have no charge transport structure include, but are not limited to, trimethylolpropane triacrylate, caprolactone-modified dipentaerythritol hexaacrylate, and dipentaerythritol hexaacrylate.

These materials are available from Tokyo Chemical Industry Co., Ltd., or Nippon Kayaku Co., Ltd. under the trade name of KAYARD DPCA series and KAYARD DPHA series.

To accelerate or stabilize curing, an initiator such as IRGACURE® 184 (from Ciba) in an amount of from 5 to 10% by weight (based on solid contents) may be added to the cross-linked resin surface layer.

The cross-linked resin surface layer is preferably formed by coating and curing a coating liquid comprising a cross-linkable charge transport material, a trimethylolpropane triacrylate, a cross-linkable silicone material, and a non-cross-linkable silicone material on the photosensitive layer 27.

Specific examples of usable solvents for preparing the coating liquid for the cross-linked resin surface layer include, but are not limited to, ethers (e.g., dioxane, tetrahydrofuran, ethyl cellosolve); aromatic solvents (e.g., toluene, xylene); halogen-containing solvents (e.g., chlorobenzene, dichloromethane); esters (e.g., ethyl acetate, butyl acetate); cellosolves (e.g., ethoxyethanol); and propylene glycols (e.g., 1-methoxy-2-propanol). In particular, methyl ethyl ketone, tetrahydrofuran, cyclohexanone, and 1-methoxy-2-propanol are more preferable compared to chlorobenzene, dichloromethane, toluene, or xylene, because of being environmentally-friendly. These solvents can be used alone or in combination.

The coating liquid of the cross-linked resin surface layer may be coated by a dip coating method, a spray coating method, a ring coating method, a roll coater method, a gravure coating method, a nozzle coating method, or a screen printing method, for example. Because coating liquids generally have a relatively short pot life, methods capable of coating with a small amount of a coating liquid are advantages from the viewpoint of environmental consciousness and cost. Among the above coating methods, a spray coating method and a ring coating method are preferable.

When forming the cross-linked resin surface layer, UV emitting light sources having the emission wavelength in the ultraviolet region, such as high-pressure mercury lamps and metal halide lamps, are usable. Additionally, visible light emitting light sources are also usable, depending on the absorption wavelength of radical-polymerizable compounds, photopolymerization initiators, etc. The amount of emission light is preferably from 50 to 1,000 mW/cm$^2$. When the amount emission light is too small, it takes too long a time for the curing reaction. When the amount of emission light is too large, the curing reaction may proceed unevenly, generating local wrinkles on the cross-linked resin surface layer and/or a lot of residual groups which have not been reacted and terminal ends which have lost reactivity. Additionally, the cross-linking reaction may proceed so quickly that the inner stress may increase, thereby causing cracks and peeling of the layer.

The cross-linked resin surface layer may optionally include a low-molecular-weight compound such as an antioxidant, a plasticizer, a lubricant, and an ultraviolet absorber, and/or a leveling agent. Also, the cross-linked resin surface layer may optionally include the above-described polymer compounds usable for the charge transport layer 26. These compounds can be used alone or in combination. Because too large an amount of a low-molecular-weight compound and/or a leveling agent may cause deterioration of sensitivity, the content thereof in the cross-linked resin surface layer is preferably from 0.1 to 20% by weight, and more preferably from 0.1 to 10% by weight. In particular, the content of a leveling agent is preferably from 0.1 to 5% by weight.

As described above, the surface layer 28 may be a thermoplastic resin surface layer. The thermoplastic resin surface layer is a layer for protecting the surface of the photoreceptor.

The thermoplastic resin surface layer is preferably formed by coating a coating liquid comprising a charge transport material, a thermoplastic resin, a cross-linkable silicone material, and a non-cross-linkable silicone material on the photosensitive layer 27. The coating liquid is subjected to a cross-linking reaction so that the cross-linkable silicone material is moderately polymerized.

The charge transport materials and thermoplastic resins usable for the charge transport layer 26 are also usable for the thermoplastic resin surface layer.

The thermoplastic resin surface layer preferably has a thickness of from 3 to 15 μm. The lower limit depends on the balance between manufacturing cost and effectiveness of the layer. The upper limit depends on the homogeneity between electrostatic properties (e.g., charge stability, light attenuation sensitivity) and quality of the layer.

In consideration of a case in which the surface of a photoreceptor has plural convexities and the thickness of the layer cannot be determined unambiguously, the thickness of the layer may be measured with a film thickness meter using the eddy current FISHERSCOPE® MMS® (from Fischer Instruments K.K.). The measurement may be performed at 4 or more points on a photoreceptor in the axial direction, and the measured values are averaged.

When moderately curing the cross-linkable silicone material in the thermoplastic resin surface layer, UV emitting light sources having the emission wavelength in the ultraviolet region, such as high-pressure mercury lamps and metal halide lamps, are usable. Additionally, visible light emitting light sources are also usable, depending on the absorption wavelength of radical-polymerizable compounds, photopolymerization initiators, etc. The amount of emission light is preferably from 50 to 1,000 mW/cm$^2$. When the amount emission light is too small, it takes too long a time for the curing reaction. When the amount of emission light is too large, the curing reaction may proceed unevenly, degrading the charge transport material and electric properties.

The surface of the photoreceptor can be roughened by adding a cross-linkable silicone material and a non-cross-linkable material to the surface layer 28.

In order to satisfy the inequations (i) to (v), the surface of the photoreceptor may be roughened. One specific method of roughening the surface of the photoreceptor includes adding materials capable of controlling surface profile to the surface layer 28.

Specific examples of such materials include fillers, zol-gel coating materials, polymer blends comprising various resins with different glass transition points, organic fine particles, foaming agents, and a large amount of silicone oil.

Another specific method includes controlling layer forming conditions by adding a large amount of water or liquid materials having different boiling points to the coating liquid of the surface layer 28.

Another specific method includes spraying an organic solvent or water on a wet layer that is formed immediately after coating the coating liquid and is not yet subjected to curing.

Alternatively, the surface layer 28 may be subjected to a sandblast treatment or a surface abrasion treatment using an abrasion paper such as a lapping film after curing.

The above-described methods can be combined, if needed. In the present embodiment, the inequations (i) to (v) are achieved by adding both a cross-linkable silicone material and a non-cross-linkable silicone material to the coating liquid of the surface layer 28. If a cross-linkable silicone material or a non-cross-linkable silicone material is solely added to the coating liquid, the inequations (i) to (v) may not be achieved.

The cross-linkable silicone material may be, for example, a reactive silicone material in which at least one terminal of a polysiloxane is methacrylate-modified. By adding such a cross-linkable silicone material in the coating liquid of the surface layer 28, the inequation (ii) representing a surface profile at LHH frequency is satisfied. The content of the cross-linkable silicone material in the coating liquid is preferably from 1 to 5% by weight based on solid contents. Such cross-linkable silicone materials may be available from, for example, Shin-Etsu Chemical Co., Ltd. under the trade name of X-22 series.

The non-cross-linkable silicone material may be, for example, a straight-chain polymer comprised of siloxane bonds, more specifically, a phenyl-modified methylphenyl silicone oil in which a part of side chains of a polysiloxane are phenyl groups. By adding such a non-cross-linkable silicone material in the coating liquid of the surface layer 28, the inequation (i) representing a surface profile at LMH frequency is satisfied. The content of the non-cross-linkable silicone material in the coating liquid is preferably from 1 to 5% by weight based on solid contents. Such non-cross-linkable silicone materials may be available from, for example, Shin-Etsu Chemical Co., Ltd. under the trade name of KF series.

Next, the image forming apparatus of the present invention is described in detail. The image forming apparatus of the present invention comprises an image forming unit and a lubricant applicator. For the sake of simplicity, the image forming unit and the lubricant applicator will be described separately.

First, exemplary embodiments of the image forming unit are described in detail.

For the sake of simplicity, the same reference number will be given to identical constituent elements such as parts and materials having the same functions and redundant descriptions thereof omitted unless otherwise stated.

Figure 15:
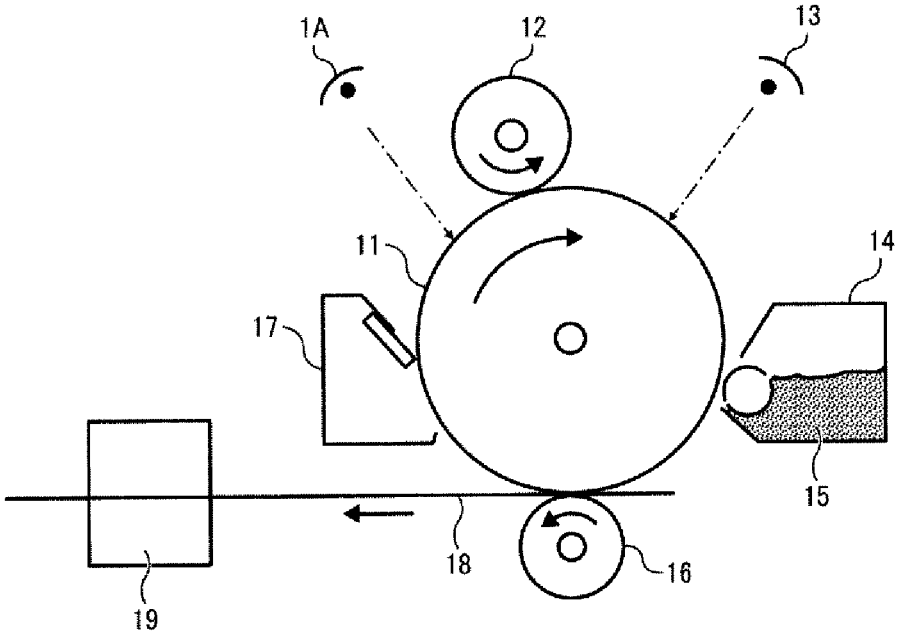
FIG. 15 is a schematic view illustrating an embodiment of the image forming unit.

FIG. 15 is a schematic view illustrating an embodiment of the image forming unit.

A photoreceptor 11 is the photoreceptor of the present invention having the above-described surface layer. The photoreceptor 11 is in the form of a drum in FIG. 15. Alternatively, the photoreceptor 11 may be in the form of a sheet or an endless belt.

A charger 12 may be a corotron, a scorotron, a solid state charger, or a charging roller, for example. From the viewpoint of consumption energy saving, the charger 12 is preferably provided in contact with or proximally to the photoreceptor 11. To prevent contamination of the charger 12, it is more preferable to provide the charger 12 proximally to the photoreceptor 11 so that a reasonable gap is formed between the photoreceptor 11 and the charger 12.

A transferrer 16 may also be a corotron, a scorotron, a solid state charger, or a charging roller, for example. Preferably, the transferrer 16 may be a combination of a transfer charger and a separation charger.

An irradiator 13 and a neutralizer 1A each may be a light source such as a fluorescent lamp, a tungsten lamp, a halogen lamp, a mercury lamp, a sodium lamp, a light-emitting diode (LED), a laser diode (LD), and an electroluminescence (EL). To emit light having a desired wavelength, these light sources can be used with a filter such as a sharp cut filter, a bandpass filter, a near-infrared cut filter, a dichroic filter, an interference filter, and a color temperature conversion filter.

A developing device 14 develops a latent image on the photoreceptor 11 with a toner 15. The toner 15 is transferred from the photoreceptor 11 onto a recording medium 18 such as a printing paper and an OHP sheet. The toner 15 is then fixed on the recording medium 18 in a fixing device 19. Some toner particles may remain on the photoreceptor 11 without being transferred onto the recording medium 18. Such residual toner particles are removed from the photoreceptor 11 with a cleaner 17. The cleaner 17 may be, for example, a rubber blade, a fur brush, or a magnetic fur brush.

When the photoreceptor 11 is positively (or negatively) charged and irradiated with light containing image information, a positive (or negative) electrostatic latent image is formed thereon. When the positive (or negative) electrostatic latent image is developed with a negatively-charged (or positively-charged) toner, a positive image is obtained. By contrast, when the positive (or negative) electrostatic latent image is developed with a positively-charged (or negatively-charged) toner, a negative image is obtained.

Figure 16:
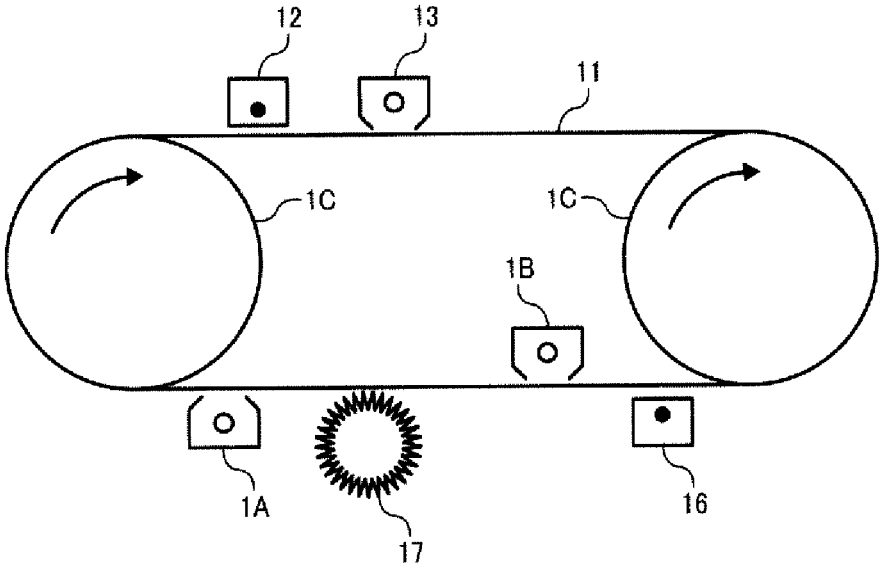
FIG. 16 is a schematic view illustrating another embodiment of the image forming unit.

FIG. 16 is a schematic view illustrating another embodiment of the image forming unit.

A photoreceptor 11 is the photoreceptor of the present invention having the above-described surface layer. The photoreceptor 11 is in the form of a belt in FIG. 16. Alternatively, the photoreceptor 11 may be in the form of a drum or an endless belt.

The photoreceptor 11 is driven by driving members 1C and repeatedly subjected to the processes of charging with a charger 12, image irradiation with an image irradiator 13, development with a developing device (not shown), transfer with a transferrer 16, pre-cleaning irradiation with a pre-cleaning irradiator 1B, cleaning with a cleaner 17, and neutralization with a neutralizer 1A. In FIG. 16, the pre-cleaning irradiator 1B irradiates the photoreceptor 11 from the substrate side thereof because the substrate is transparent in this embodiment.

Alternatively, the pre-cleaning irradiator 1B may irradiate the photoreceptor 11 from the photosensitive layer side thereof. Similarly, the image irradiator 13 and the neutralizer 1A each may irradiate the photoreceptor 11 from the substrate side thereof.

In addition to the image irradiator 13, the pre-cleaning irradiator 1B, and the neutralizer 1A, other members that irradiate the photoreceptor 11 with light, such as a pre-transfer irradiator and a pre-image irradiation irradiator, may be provided.

Figure 17:
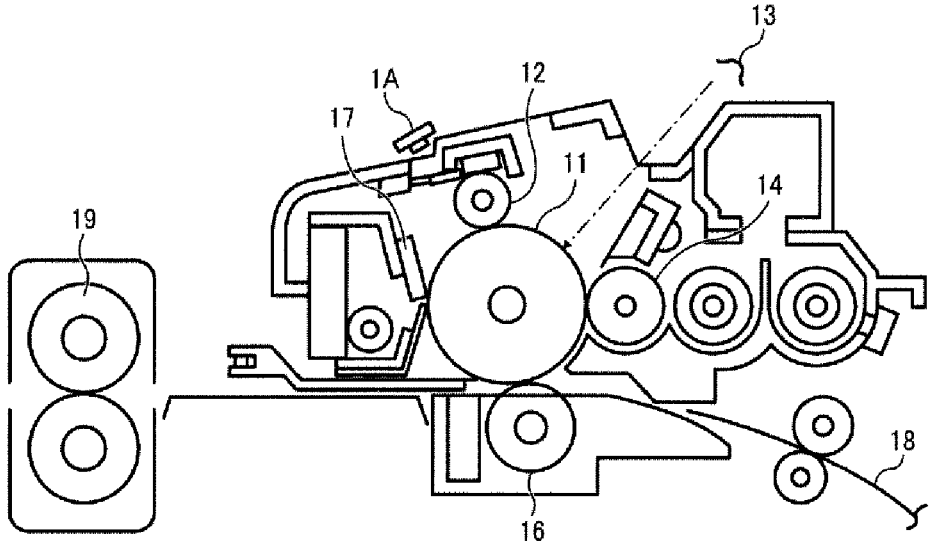
FIG. 17 is a schematic view illustrating an embodiment of the process cartridge of the present invention.

The above-described image forming unit is mountable on image forming apparatuses such as copiers, facsimile machines, and printers. Alternatively, the image forming unit may compose a process cartridge that is mountable on image forming apparatuses. FIG. 17 is a schematic view illustrating an embodiment of the process cartridge of the present invention. A photoreceptor 11 is the photoreceptor of the present invention having the above-described surface layer. The photoreceptor 11 is in the form of a drum in FIG. 17. Alternatively, the photoreceptor 11 may be in the form of a sheet or an endless belt.

Figure 18:
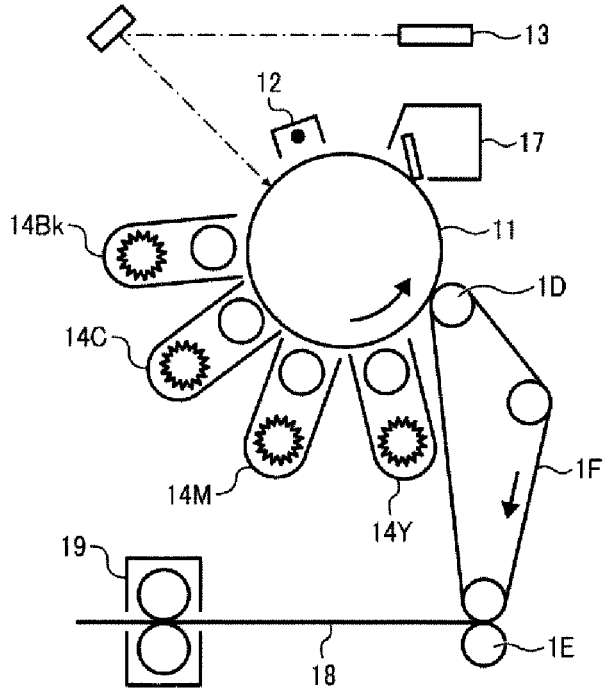
FIG. 18 is a schematic view illustrating another embodiment of the image forming unit.

FIG. 18 is a schematic view illustrating another embodiment of the image forming unit.

Around a photoreceptor 11, a charger 12, an irradiator 13, a black developing device 14Bk, a cyan developing device 14C, a magenta developing device 14M, a yellow developing device 14Y, an intermediate transfer belt 1F, and a cleaner 17 are provided in this order. The additional characters Bk, C, M, and Y representing toner colors of black, cyan, magenta, and yellow, respectively, may be added or omitted as appropriate.

The photoreceptor 11 is the photoreceptor of the present invention having the above-described surface layer. The developing devices 14Bk, 14C, 14M, and 14Y are independently controllable.

A first transferrer 1D transfers a toner image formed on the photoreceptor 11 onto the intermediate transfer belt 1F. The first transferrer 1D is provided inside the intermediate transfer belt 1F, and is movable so that the intermediate transfer belt 1F contacts with/separates from the photoreceptor 11. The intermediate transfer belt 1F is brought into contact with the photoreceptor 11 only during a toner image is transferred from the photoreceptor 11 onto the intermediate transfer belt 1F.

Each color toner image is sequentially formed and superimposed on one another on the intermediate transfer belt 1F to form a composite toner image. A second transferrer 1E transfers the composite toner image from the intermediate transfer belt 1F onto a recording medium 18. The composite toner image is fixed on the recording medium 18 in a fixing device 19. The second transferrer 1E is movable so as to contact with/separate from the intermediate transfer belt 1F. The second transferrer 1E is brought into contact with the intermediate transfer belt 1F only during the transfer of toner image.

A conventional image forming unit employing an intermediate transfer drum has a disadvantage that thick paper is not usable as the recording medium. This is because the recording medium is required to be flexible so as to be electrostatically adsorbed to the drum and each color toner image is superimposed one another directly on the recording medium.

By contrast, in the image forming unit illustrated in FIG. 18 employing the intermediate transfer belt 1F has an advantage that usable recording medium are not limited to any particular material. This is because each color toner image is superimposed one another on the intermediate transfer belt 1F.

Figure 19:
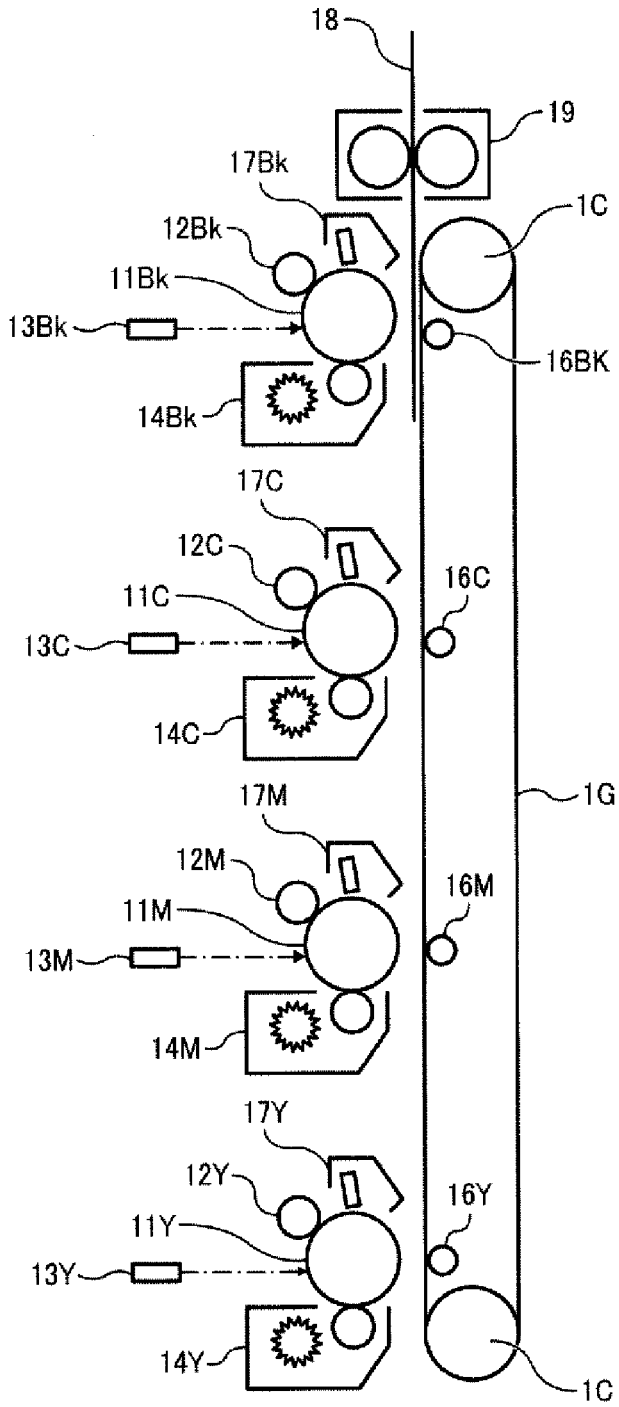
FIG. 19 is a schematic view illustrating another embodiment of the image forming unit.

FIG. 19 is a schematic view illustrating another embodiment of the image forming unit. The image forming unit includes photoreceptors 11Y, 11M, 11C, and 11Bk. Each of the photoreceptors 11Y, 11M, 11C, and 11Bk is the photoreceptor of the present invention having the above-described surface layer. Around the photoreceptor 11Y, a charger 12Y, an irradiator 13Y, a developing device 14Y, and a cleaner 17Y are provided. The same are provided around the photoreceptors 11M, 11C, and 11Bk as well. A conveyance transfer belt 1G is stretched taut between driving members 1C and contacts the photoreceptors 11Y, 11M, 11C, and 11Bk arranged in line. Transferrers 16Y, 16M, 16C, and 16Bk are provided on the opposite sides of the photoreceptors 11Y, 11M, 11C, and 11Bk, respectively, relative to the conveyance transfer belt 1G.

The image forming unit illustrated in FIG. 19 is what is called a tandem image forming unit in which yellow, magenta, cyan, and black toner images are formed on the respective photoreceptors 11Y, 11M, 11C, and 11Bk and are sequentially transferred onto a recording medium 18 on the conveyance transfer belt 1G. Such a tandem image forming unit is capable of printing full-color images at higher speeds compared to an image forming unit including only one photoreceptor.

Figure 20:
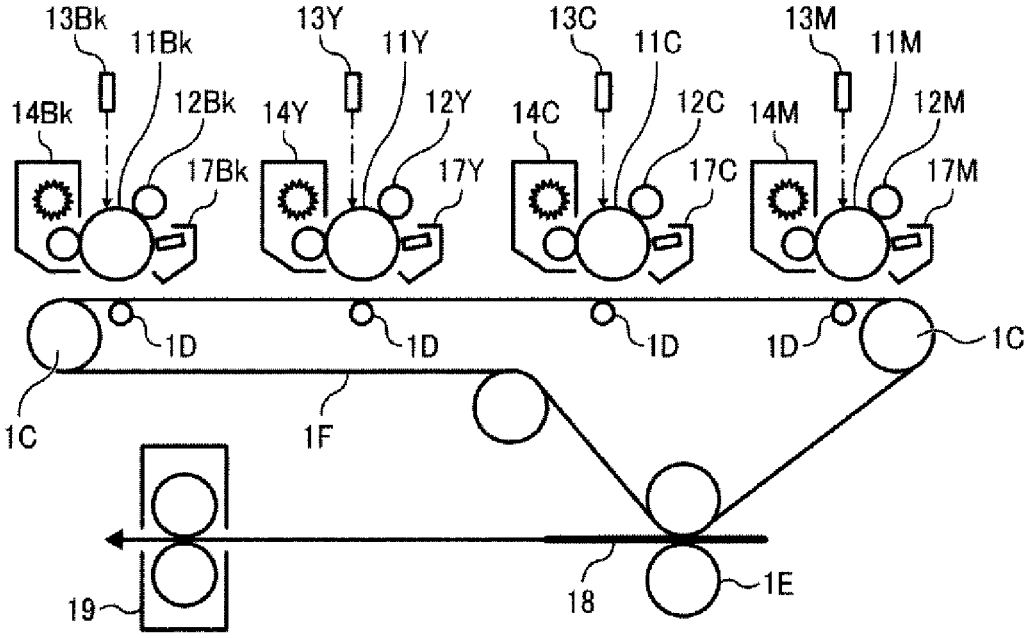
FIG. 20 is a schematic view illustrating another embodiment of the image forming unit.

FIG. 20 is a schematic view illustrating another embodiment of the image forming unit. The image forming unit illustrated in FIG. 20 is a tandem image forming unit which employs an intermediate transfer belt 1F.

Next, exemplary embodiments of the lubricant applicator are described in detail.

Figure 21:
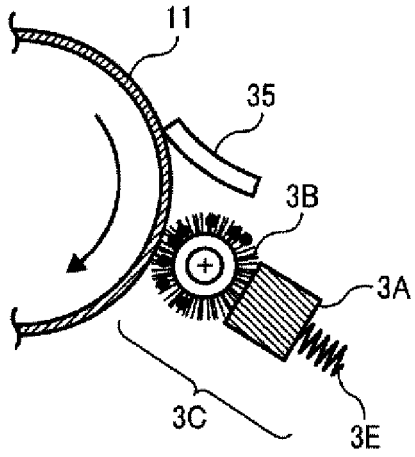
FIG. 21 is a schematic view illustrating an embodiment of the solid lubricant applicator.

FIG. 21 is a schematic view illustrating an embodiment of the solid lubricant applicator. A lubricant applicator 3C includes a fur brush 3B, a solid lubricant 3A, and a pressing spring 3E for pressing the solid lubricant 3A against the fur brush 3B. The solid lubricant 3A is compressed into a bar. The tips of the brush fibers of the fur brush 3B are in contact with the photoreceptor 11. The solid lubricant 3A is drawn up on the fur brush 3B and is conveyed to the contact point of the fur brush 3B with the photoreceptor 11 by rotation of the fur brush 3B. Thus, the solid lubricant 3A is applied to the photoreceptor 11.

The pressing spring 3E presses the solid lubricant 3A against the fur brush 3B at a predetermined pressure so that the solid lubricant 3A is constantly in contact with the fur brush 3B even when the solid lubricant 3A is abraded and reduced in volume with time.

In order to improve fixability of the solid lubricant 3A on the photoreceptor 11, a lubricant fixer may be provided. The lubricant fixer may be, for example, a blade 35 that is provided in contact with the photoreceptor 11 so as to trail the photoreceptor 11. Alternatively, the blade 35 may be provided in contact with the photoreceptor 11 so as to face in the direction of rotation of the photoreceptor 11.

Specific examples of usable materials for the solid lubricant 3A include, but are not limited to, fatty acid metal salts such as lead oleate, zinc oleate, copper oleate, zinc stearate, cobalt stearate, iron stearate, copper stearate, zinc palmitate, copper palmitate, and zinc linolenate; and fluorine-containing resins such as polytetrafluoroethylene, polychlorotrifluoroethylene, polyvinylidene fluoride, polytrifluorochloroethylene, dichlorodifluoroethylene, tetrafluoroethylene-ethylene copolymer, and tetrafluoroethylene-oxafluoropropylene copolymer. Among these materials, metal salts of stearic acids, more specifically, zinc stearate is most preferable because of effectively reducing the friction coefficient of the photoreceptor 11.

The photoreceptor 11 is the photoreceptor of the present invention having the surface layer having a specific surface profile. Therefore, the solid lubricant 3A can be effectively applied to the surface of the photoreceptor 11. Accordingly, the photoreceptor of the present invention expresses excellent cleanability of spherical toners.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, the procedures for evaluation of the below-prepared photoreceptors are described.

(1) Measurement of Surface Profile

A photoreceptor is set to a pickup (E-DT-S02A) and subjected to a measurement using a surface texture and contour measuring instrument SURFCOM 1400D (from Tokyo Seimitsu Co., Ltd.) to obtain text data of a cross-sectional curve of a surface of the photoreceptor. The evaluation length is 12 mm, the measuring speed is 0.06 mm/s, and the sampling length is 0.39 μm.

The text data is subjected to wavelet transformation multiresolution analysis so as to be separated into 6 frequency components each having a cycle length (μm) of 0 to 3, 1 to 6, 2 to 13, 4 to 25, 10 to 50, and 24 to 99.

A one-dimensional data array of the lowest frequency component having a cycle length of from 24 to 99 (μm) is thinned so that the number of data array is reduced to 1/40. The thinned one-dimensional data array is subjected to wavelet transformation multiresolution analysis so as to be separated into the 6 frequency components (LHH, LHL, LMH, LML, LLH, and LLL) each having a cycle length (μm) of 26 to 106, 53 to 183, 106 to 318, 214 to 551, 431 to 954, and 867 to 1,654, respectively.

Randomly selected 4 points on each photoreceptor are subjected to the above measurement. Each text data of a cross-sectional curve is subjected to wavelet transformation and multiresolution analysis, and WRa (μm) is calculated and averaged. The mother wavelet function is Harr function.

(2) Solid Lubricant Receptivity Test

Figure 22:
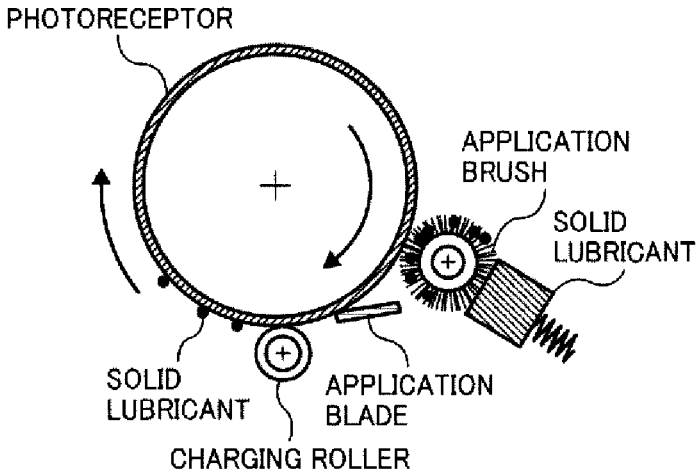
FIG. 22 is a schematic view illustrating a color copier used in a solid lubricant receptivity test.

A photoreceptor is mounted on a color printer IPSIO SP C811 (from Ricoh Co., Ltd.) to be subjected to a solid lubricant receptivity test. As the solid lubricant, zinc stearate is used. The color copier is partially modified so as to have a configuration illustrated in FIG. 22.

To keep the test conditions constant, a zinc stearate bar (i.e., a solid lubricant), an application brush, and an application blade are provided to a photoreceptor-developing device composite unit (hereinafter "PD unit"). To uniformly impregnate the zinc stearate to the application brush in advance, the PD unit is mounted on the color copier and idled for 30 minutes. The developer contained in the PD unit is completely removed.

Before mounting on the PD unit, a photoreceptor is subjected to surface observation with a laser microscope (VK-8500 from Keyence Corporation). After mounting the photoreceptor on the PD unit, the PD unit is mounted on the color copier and idled for 15 seconds. The photoreceptor is taken out of the PD unit and is subjected to the surface observation again to obtain an image of the surface.

Figure 23:
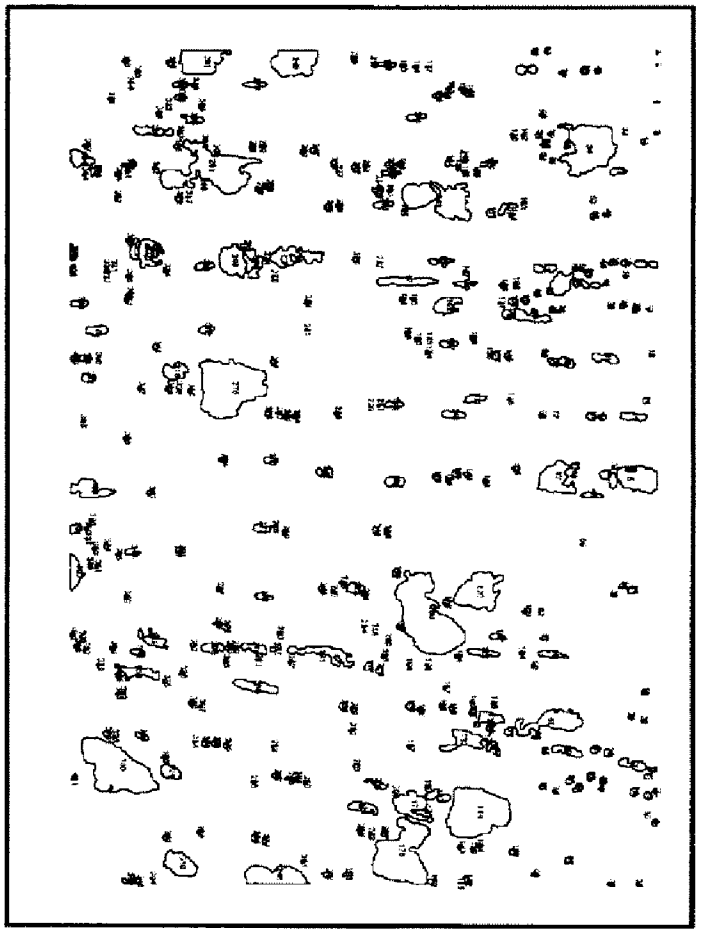
FIG. 23 is an example result of the image analysis in the solid lubricant receptivity test.
Figure 24:
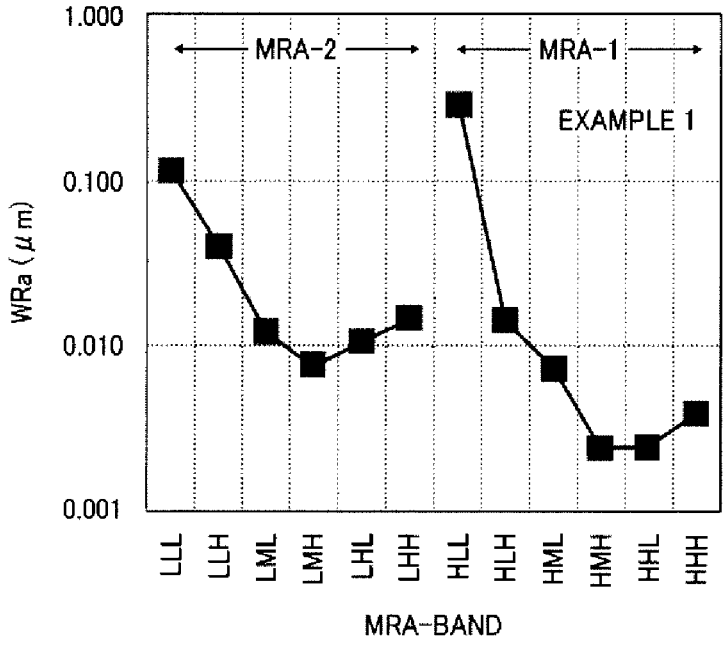
FIGS. 24 to 47 are measurement results of WRa in Examples and Comparative Examples.
Figure 25:
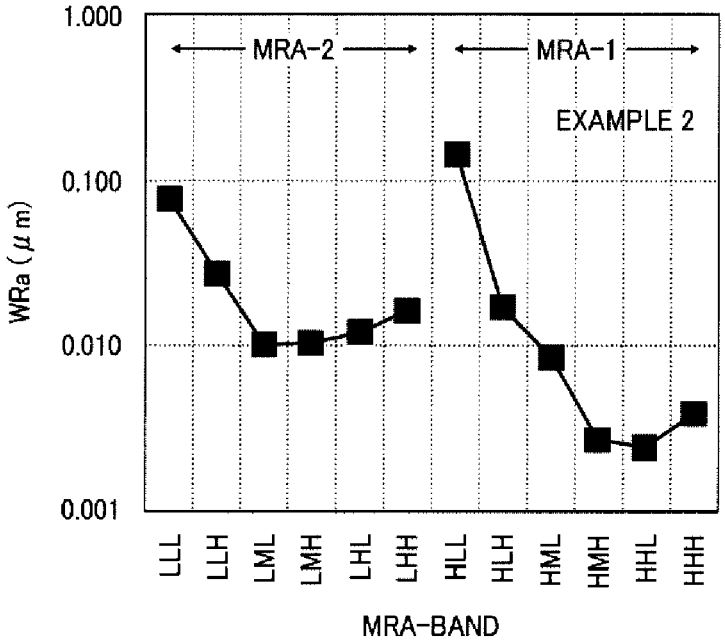
Figure 26:
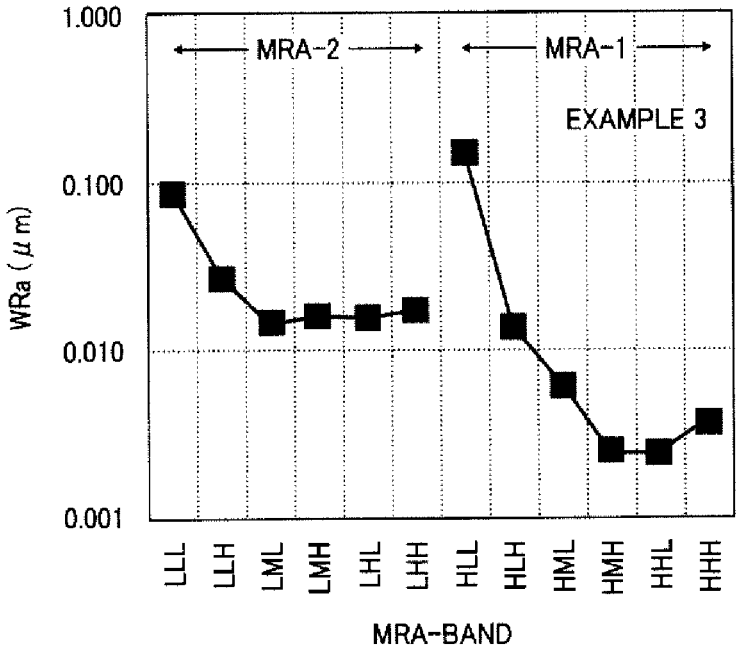
Figure 27:
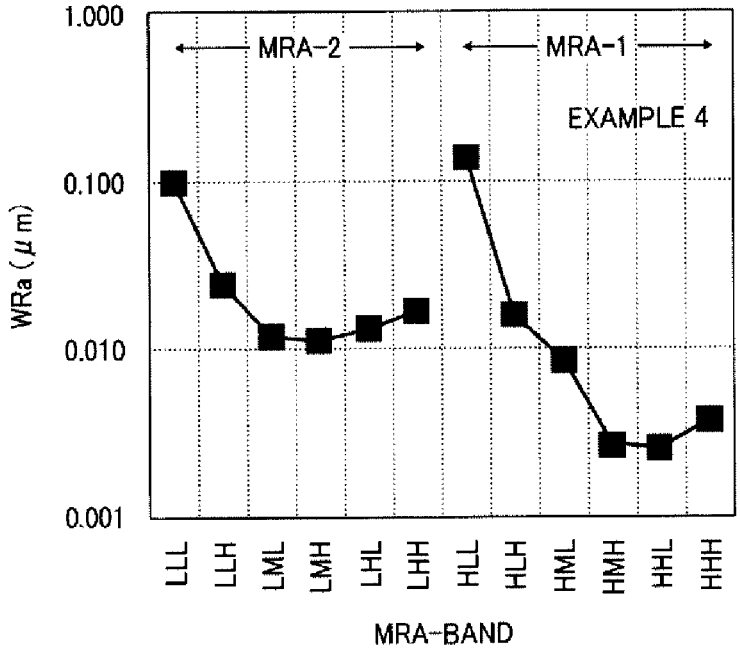
Figure 28:
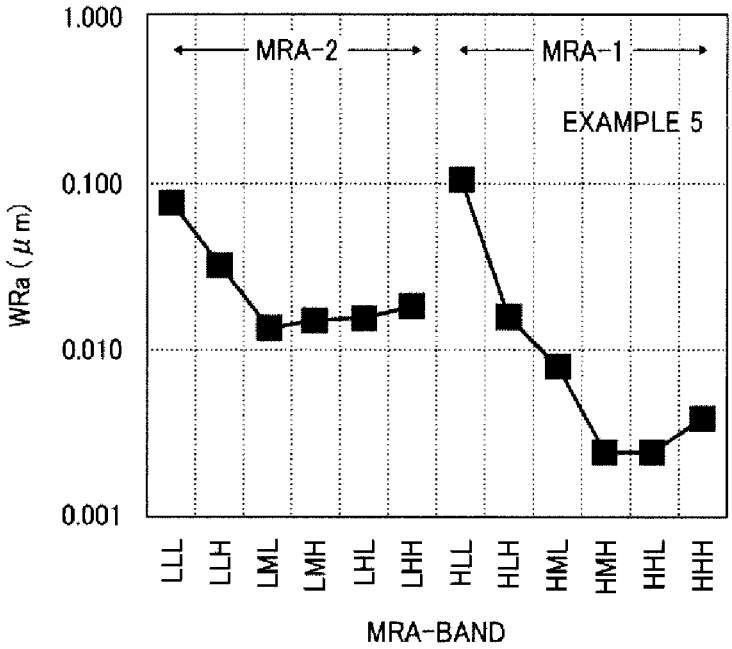
Figure 29:
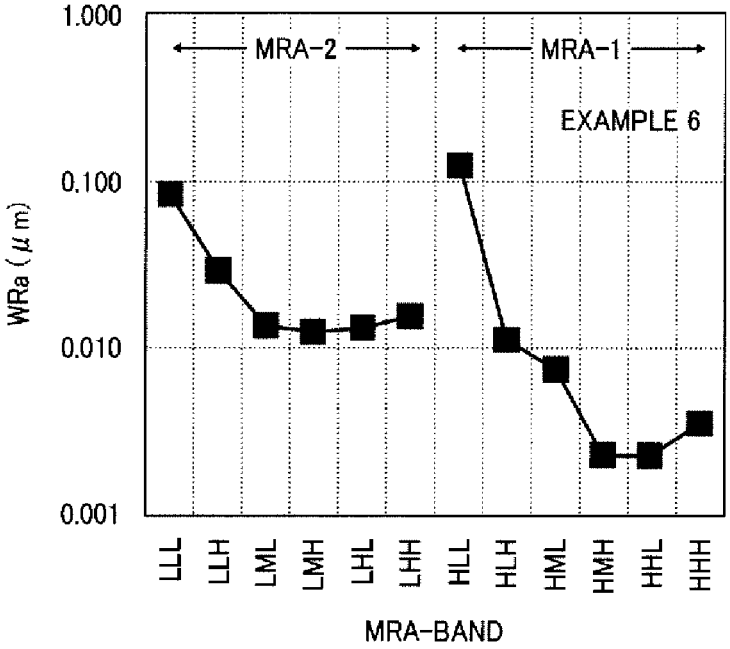
Figure 30:
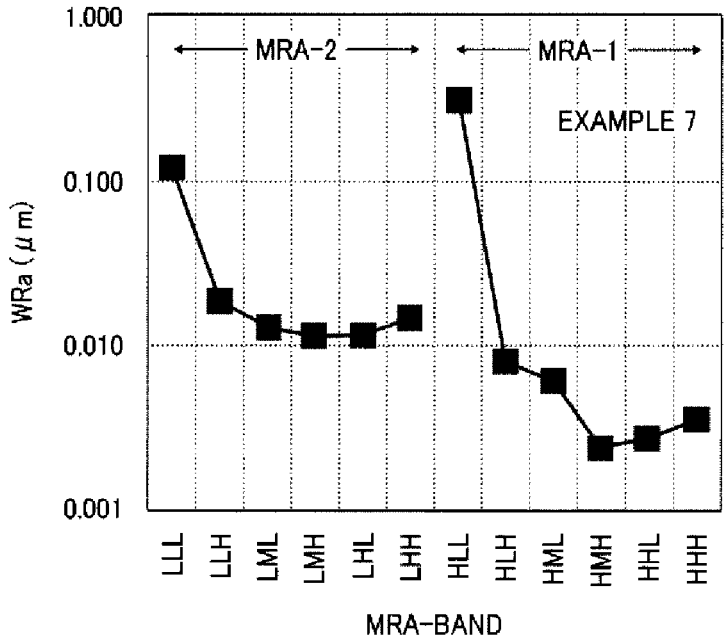
Figure 31:
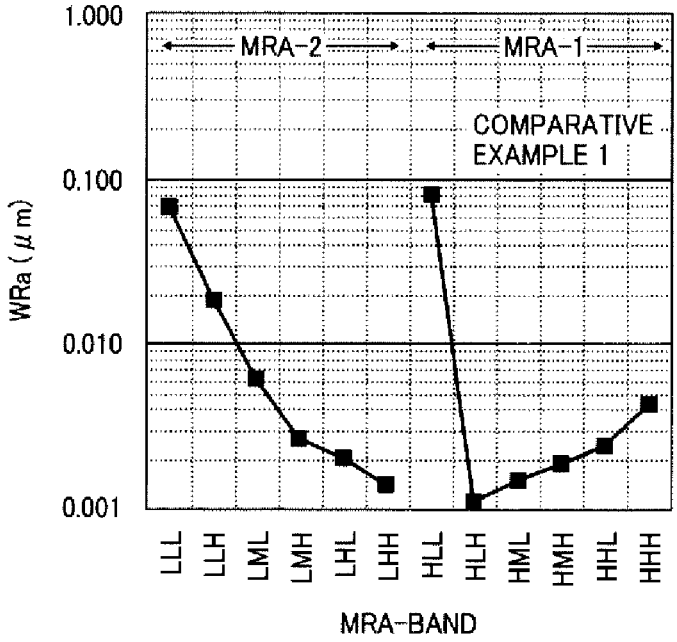
Figure 32:
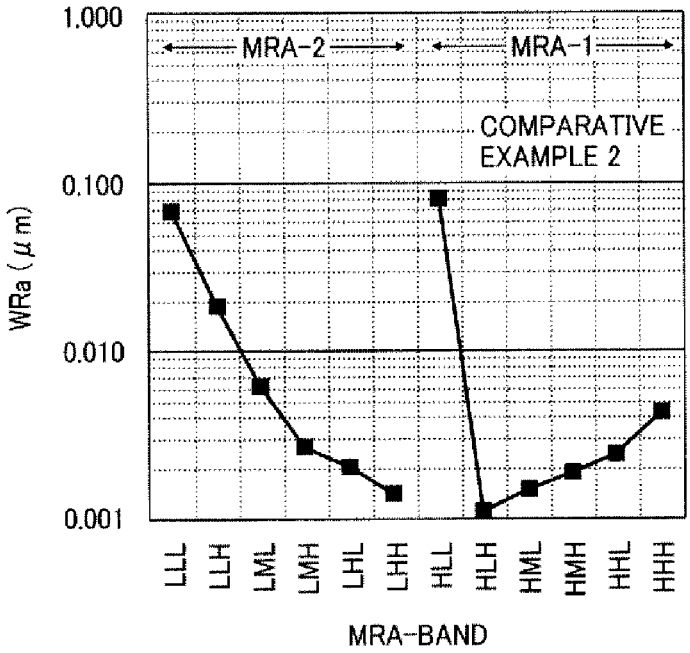
Figure 33:
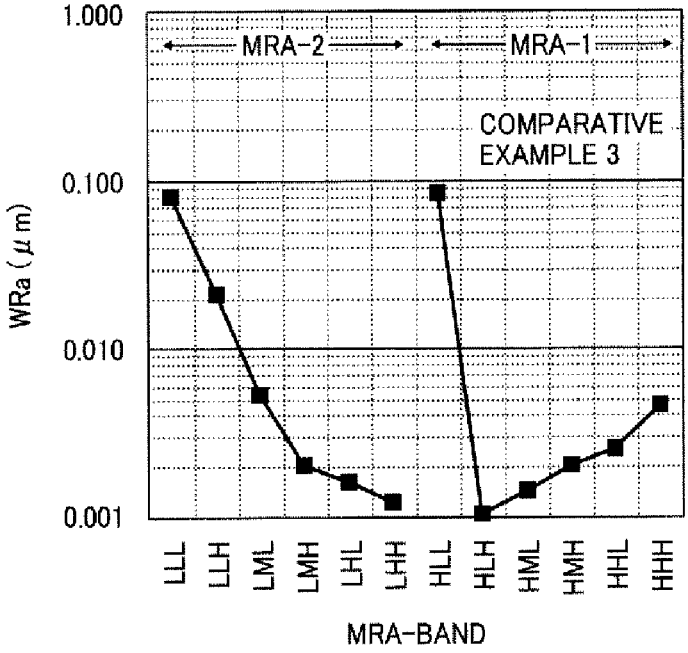
Figure 34:
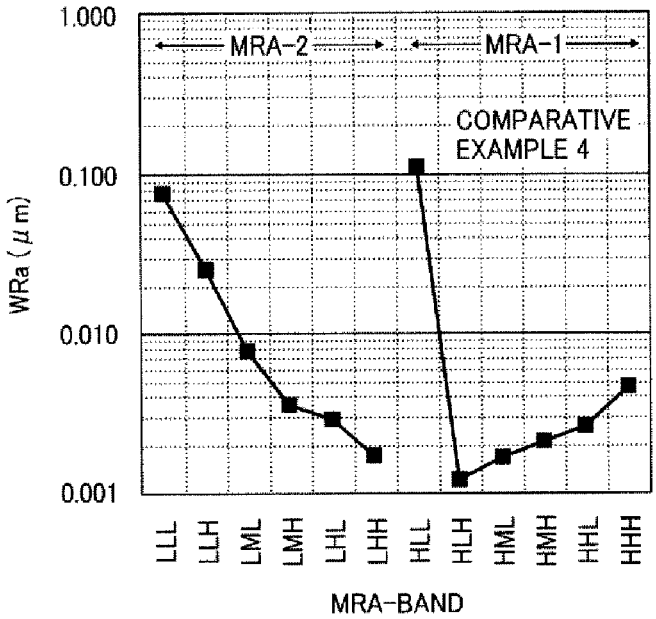
Figure 35:
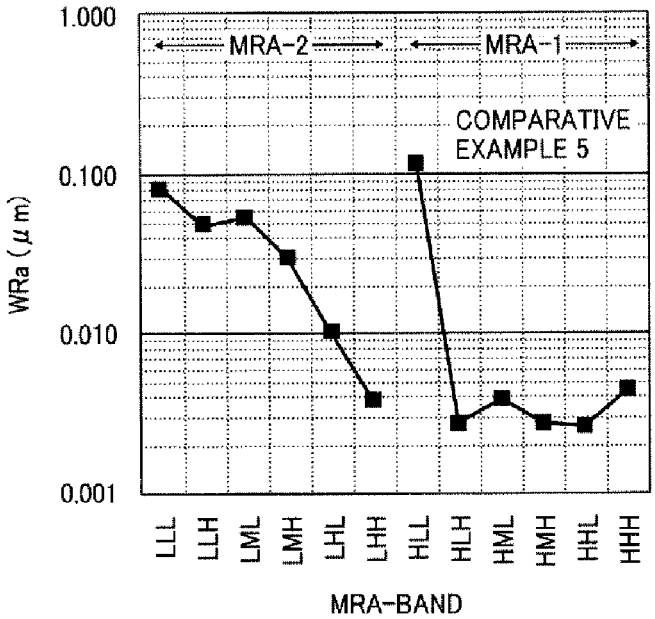
Figure 36:
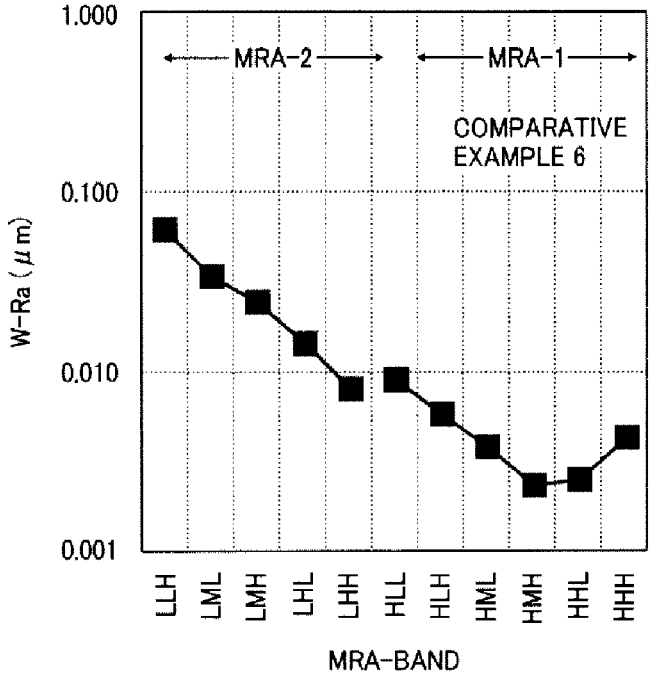
Figure 37:
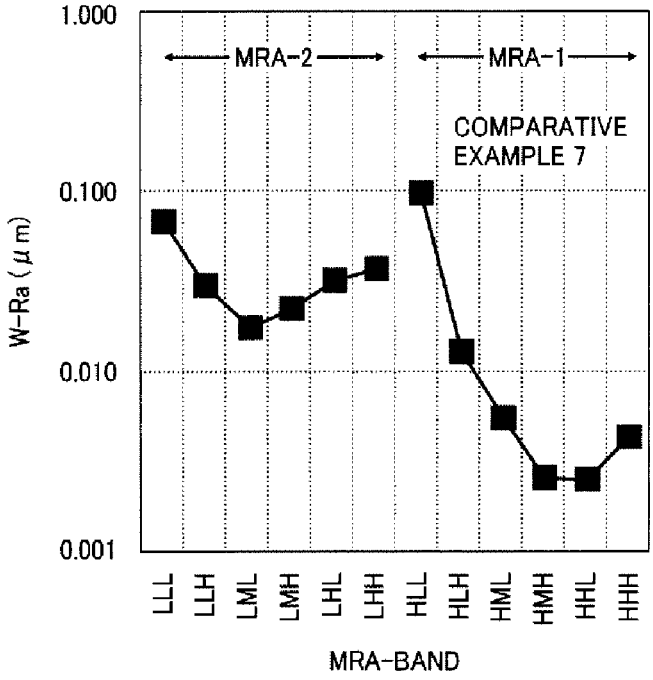
Figure 38:
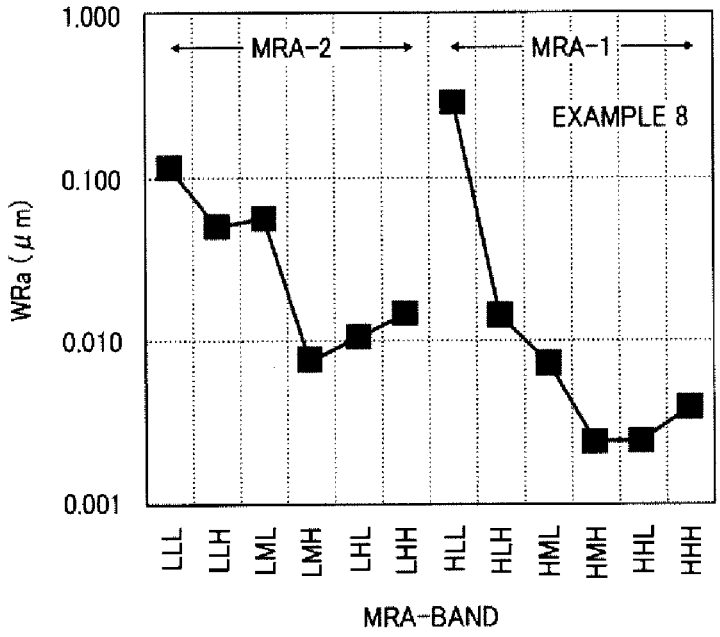
Figure 39:
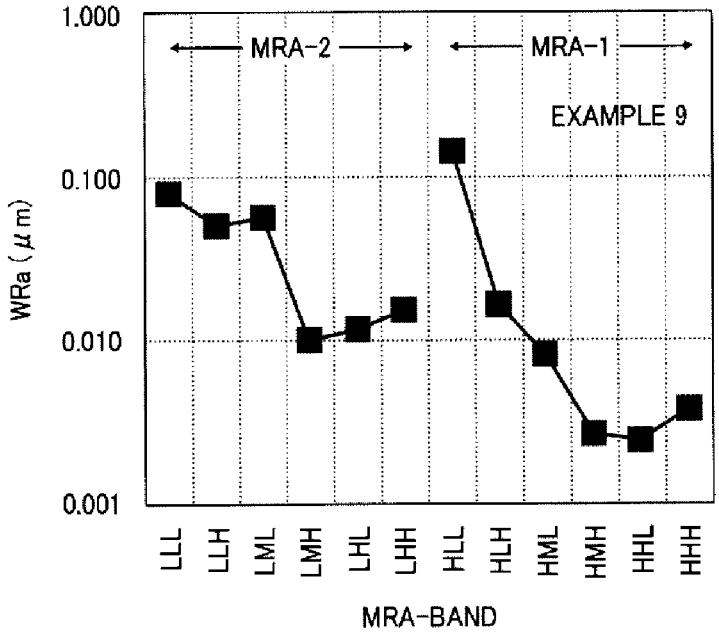
Figure 40:
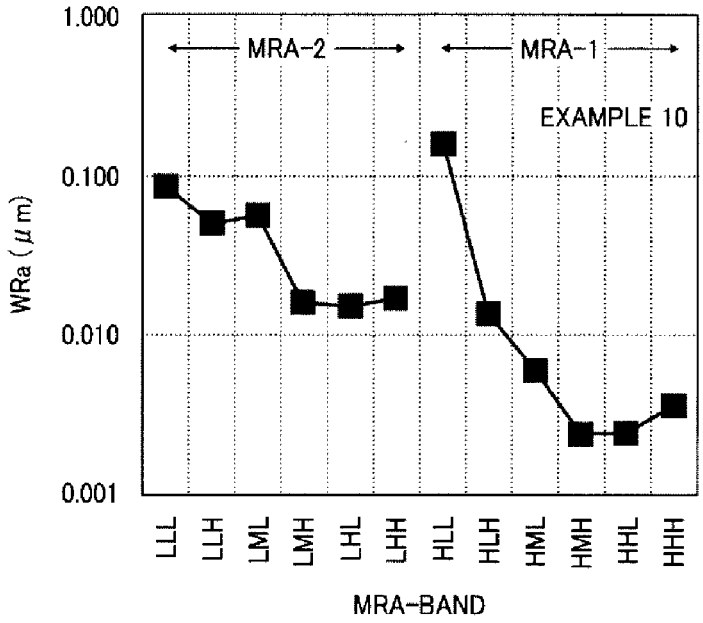
Figure 41:
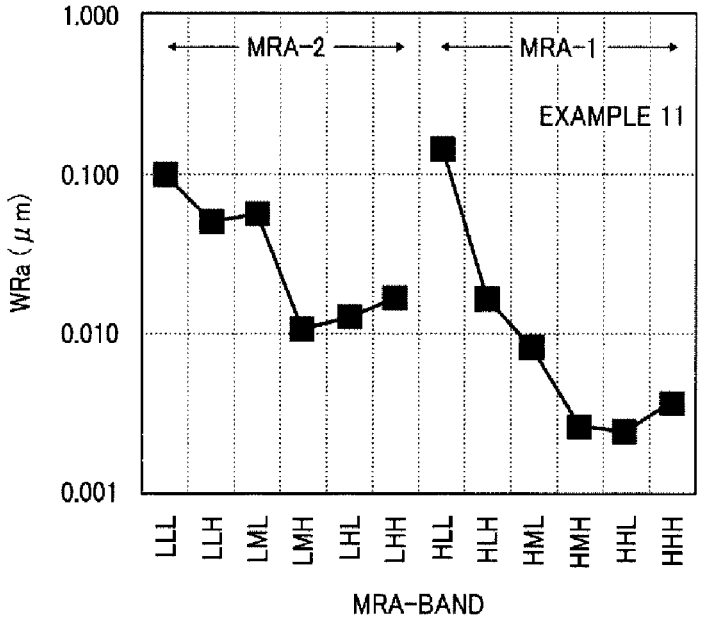
Figure 42:
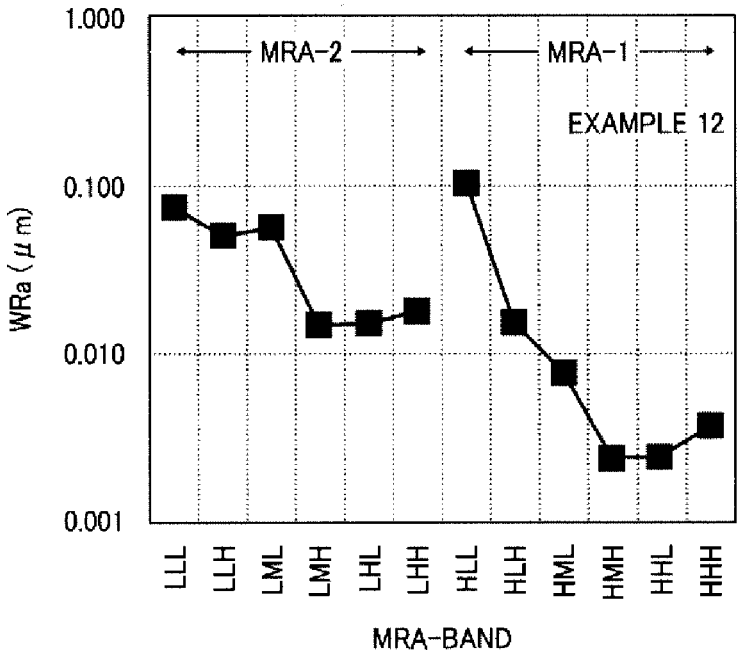
Figure 43:
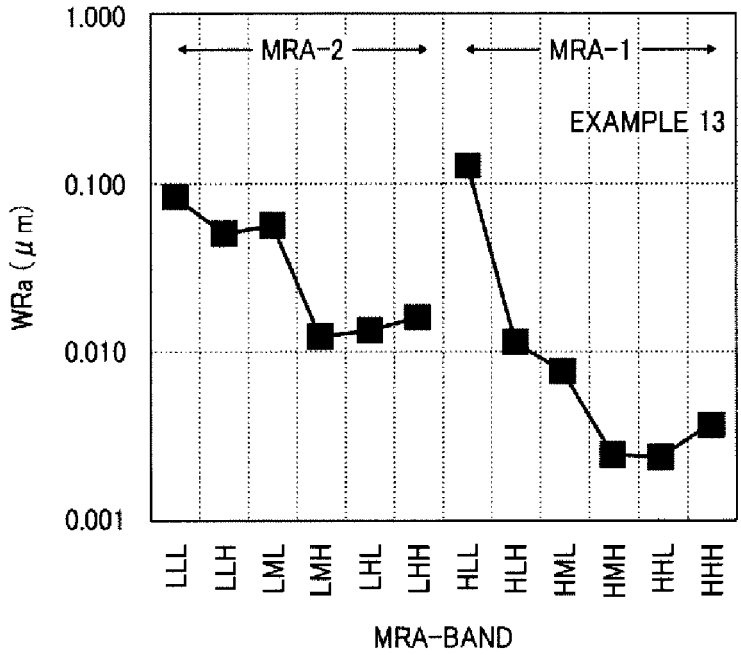
Figure 44:
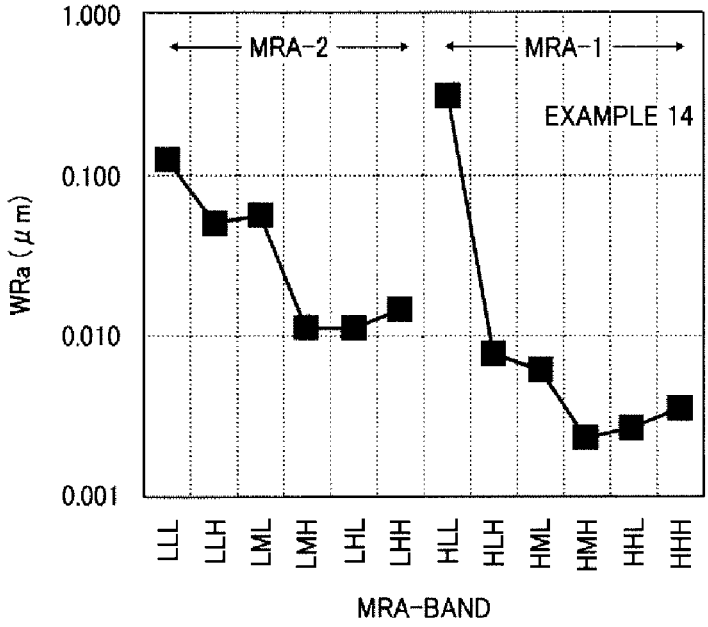
Figure 45:
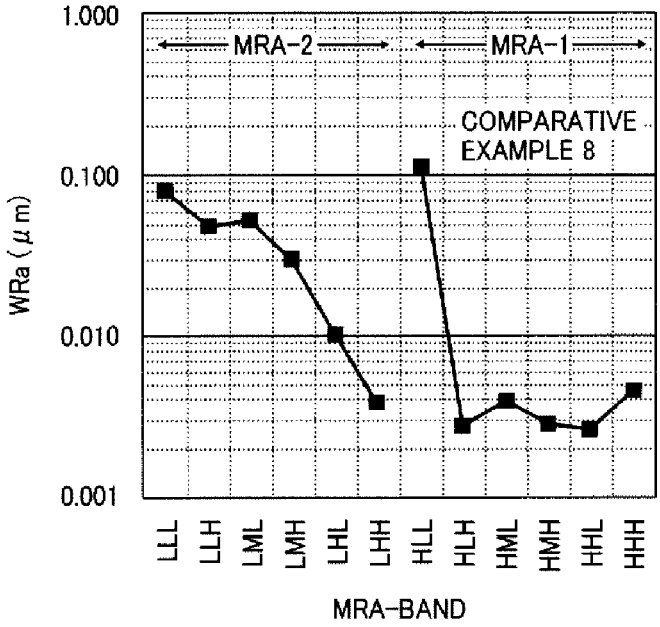
Figure 46:
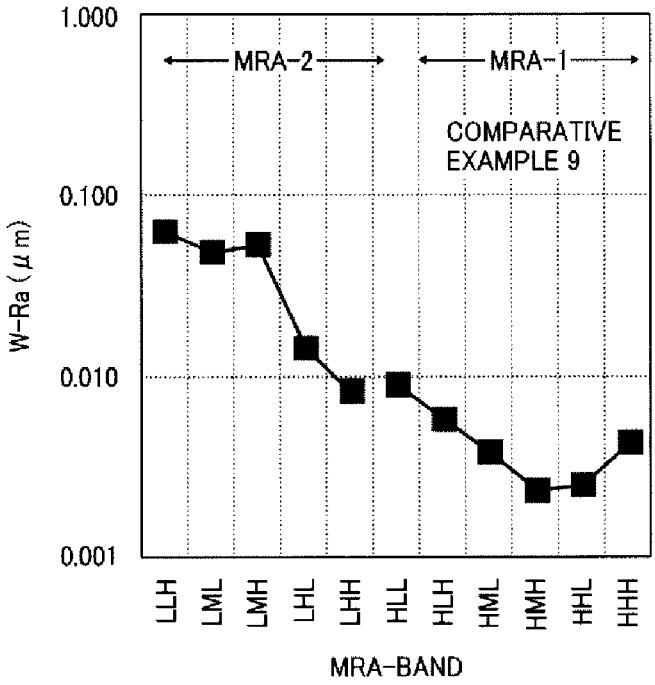
Figure 47:
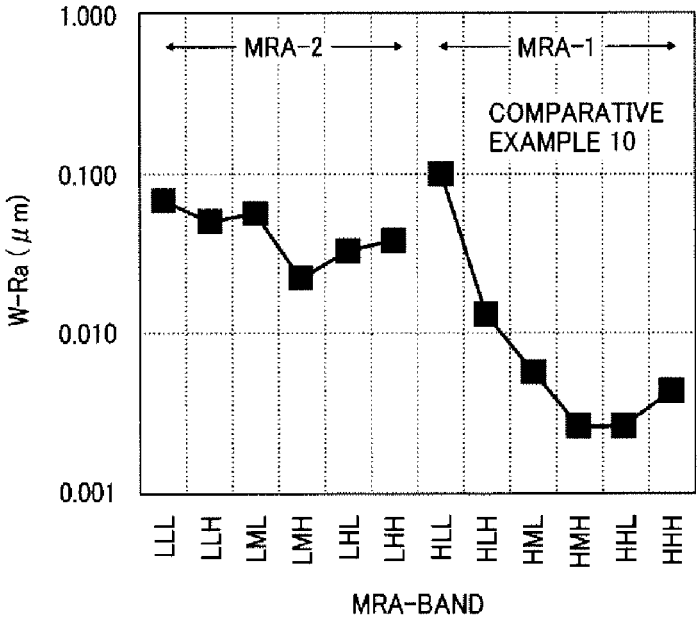

The image is subjected to an image analysis so that domains of zinc stearate remaining on the photoreceptor are distinguished and the size and the area occupancy of the domains are calculated with MEASURE and COUNT commands of an image analysis software program IMAGE PRO PLUS Ver 3.0 (from Media Cybernetics, Inc.). An example result of the image analysis is shown in FIG. 23. The solid lubricant receptivity is evaluated with the area occupancy of the domains of zinc stearate remaining on the photoreceptor after the 15-second idling.

(3) Image Evaluation

A halftone pattern with a pixel density of 600 dpi×600 dpi in which 4 dots×4 dots are formed on an 8×8 matrix and a blank pattern are alternately and independently produced on continuous 5 sheets of paper each. The blank pattern is visually observed to determine whether background is contaminated or not. The results are graded in the following 5 levels.

5: Very clean.

4: Clean.

3: No problem.

2: Slightly contaminated but no problem in practical use.

1: Contaminated.

Example 1

On each of an aluminum cylinder having a thickness of 0.8 mm, a length of 340 mm, and an outer diameter of 40 mm, and another aluminum cylinder having a thickness of 0.8 mm, a length of 340 mm, and an outer diameter of 30 mm, a undercoat layer coating liquid, a charge generation layer coating liquid, and a charge transport layer coating liquid are sequentially coated and dried in this order. Thus, an undercoat layer, a charge generation layer, and a charge transport layer having a thickness of 3.5 μm, 0.2 μm, and 24 μm, respectively, are formed on each of the aluminum cylinders.

Further, a cross-linked resin surface layer coating liquid is spray-coated on the aluminum cylinders having the undercoat layer, the charge generation layer, and the charge transport layer thereon, followed by drying for 10 minutes. The aluminum cylinders are put 120 mm away from a UV curing lamp so that the cross-linked resin surface layer coating liquid is subjected to UV curing while rotating. The illuminance at that position is 550 mW/cm$^2$ when measured with an accumulated UV meter UIT-150 from Ushio Inc. The aluminum cylinders rotate at a revolution of 25 rpm. The aluminum cylinders are exposed to UV ray for 4 minutes while circulating water having a temperature of 30° C. therein, followed by drying for 30 minutes at 130° C. Thus, photoreceptors having a cross-linked resin surface layer having a thickness of 6 μm are prepared.

The compositions of the coating layers are shown in Tables 2 to 5.

TABLE 2

Composition of Undercoat Layer Coating Liquid

| Components | Trade Name or Chemical Formula | Amount (parts) |
|---|---|---|
| Alykyd resin solution | BECKOLITE M6401-50 (from DIC Corporation) | 12 |
| Melamine resin solution | SUPER BECKAMINE G-821-60 (from DIC Corporation) | 8.0 |
| Titanium oxide | CR-EL (from Ishihara Sangyo Kaisha, Ltd.) | 40 |
| Methyl ethyl ketone | — | 200 |

TABLE 3

| Composition of Charge Generation Layer Coating Liquid | | |
|---|---|---|
| Components | Trade Name or Chemical Formula | Amount (parts) |
| Bisazo pigment | 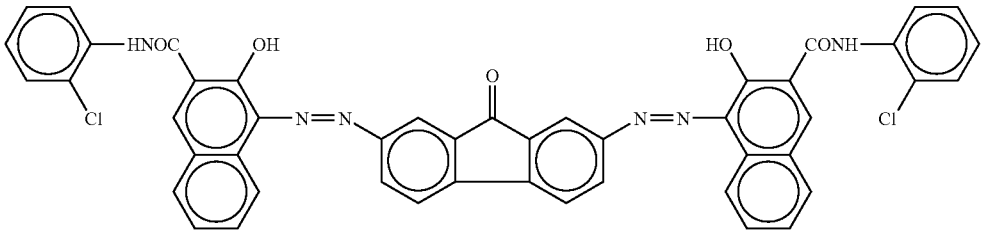 (from Ricoh Co., Ltd.) | 5.0 |
| Polyvinyl butyral | XYHL (from UCC) | 1 |
| Cyclohexanone | — | 200 |
| Methyl ethyl ketone | | 80 |

TABLE 4

| Composition of Charge Transport Layer Coating Liquid | | |
|---|---|---|
| Components | Trade Name or Chemical Formula | Amount (parts) |
| Z-type Polycarbonate | PANLITE ® TS-2050 (from Teijin Chemicals Ltd.) | 10 |
| Low-molecular-weight charge transport material | 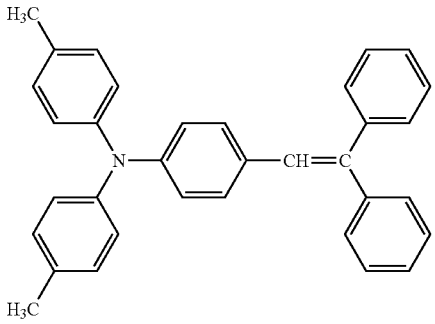 | 7.0 |
| Tetrahydrofuran | — | 100 |
| Silicone oil (in 1% THF solution) | KF50-100CS (from Shin-Etsu Chemical Co., Ltd.) | 1 |

TABLE 5

| Composition of Cross-linked Resin Surface Layer Coating Liquid | | |
|---|---|---|
| Components | Trade Name or Chemical Formula | Amount (parts) |
| Cross-linkable charge transport material | 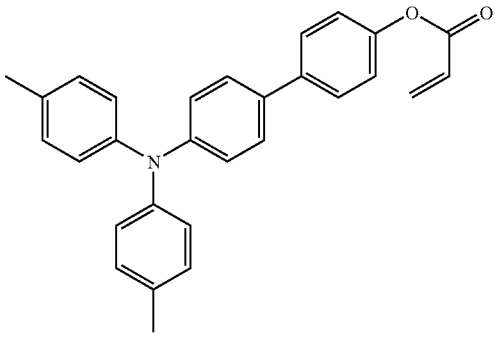 | 6.0 |
| Trimethylolpropane triacrylate | KAYARAD TMPTA (from Nippon Kayaku Co., Ltd.) | 3.0 |
| 50% THF solution of caprolactone-modified dipentaerythritol hexaacrylate | KAYARAD DPCA-120 (from Nippon Kayaku Co., Ltd.) | 6.0 |
| 5% THF solution of a mixture of polyester-modified polydimethylsiloxane having acryl group and propoxy-modified 2-neopentylglycol diacrylate | BYK-UV3571 (from BYK Japan KK) | 0.24 |
| 1-Hydroxycyclohexyl phenyl ketone | IRGACURE ® 184 (from Ciba) | 0.60 |
| Tris(2,4-di-tert-butylphenyl) phosphate | — | 0.12 |
| Tetrahydrofuran | | 68.92 |
| Cross-linkable silicone oil material | X-22-174DX (from Shin-Etsu Chemical Co., Ltd.) | 0.45 |
| Non-cross-linkable silicone oil material | KF-50-100CS (from Shin-Etsu Chemical Co., Ltd.) | 0.15 |

Example 2

The procedure in Example 1 is repeated except for changing the amount of the cross-Linkable silicone oil material to 0.75 parts.

Example 3

The procedure in Example 1 is repeated except for changing the amount of the non-cross-linkable silicone oil material to 0.45 parts.

Example 4

The procedure in Example 1 is repeated except for changing the amounts of the cross-linkable silicone oil material and the non-cross-linkable silicone oil material to 0.75 parts and 0.45 parts, respectively.

Example 5

The procedure in Example 1 is repeated except for changing the amounts of the cross-linkable silicone oil material and the non-cross-linkable silicone oil material to 0.15 parts and 0.75 parts, respectively.

Example 6

The procedure in Example 1 is repeated except for changing the amounts of the cross-linkable silicone oil material and the non-cross-linkable silicone oil material to 0.45 parts and 0.75 parts, respectively.

Example 7

The procedure in Example 1 is repeated except for changing the amounts of the cross-linkable silicone oil material and the non-cross-linkable silicone oil material to 0.75 parts and 0.75 parts, respectively.

Comparative Example 1

The procedure in Example 1 is repeated except for replacing the cross-linked resin surface layer coating liquid with another cross-linked resin surface layer coating liquid having the composition shown in Table 6.

TABLE 6

Composition of Cross-linked Resin Surface Layer Coating Liquid

| Components | Trade Name or Chemical Formula | Amount (parts) |
|---|---|---|
| Cross-linkable charge transport material | 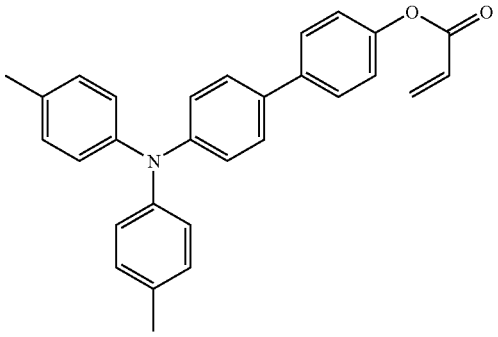 | 6.0 |
| Trimethylolpropane triacrylate | KAYARAD TMPTA (from Nippon Kayaku Co., Ltd.) | 3.0 |
| 50% THF solution of caprolactone-modified dipentaerythritol hexaacrylate | KAYARAD DPCA-120 (from Nippon Kayaku Co., Ltd.) | 6.0 |
| 5% THF solution of a mixture of polyester-modified polydimethylsiloxane having acryl group and propoxy-modified 2-neopentylglycol diacrylate | BYK-UV3571 (from BYK Japan KK) | 0.24 |
| 1-Hydroxycyclohexyl phenyl ketone | IRGACURE ® 184 (from Ciba) | 0.60 |
| Tris(2,4-di-tert-butylphenyl) phosphate | — | 0.12 |
| Tetrahydrofuran | | 68.92 |

Comparative Example 2

The procedure in Example 1 is repeated except for replacing the cross-linked resin surface layer coating liquid with another cross-linked resin surface layer coating liquid having the composition shown in Table 7.

TABLE 7

Composition of Cross-linked Resin Surface Layer Coating Liquid

| Components | Trade Name or Chemical Formula | Amount (parts) |
|---|---|---|
| Cross-linkable charge transport material | 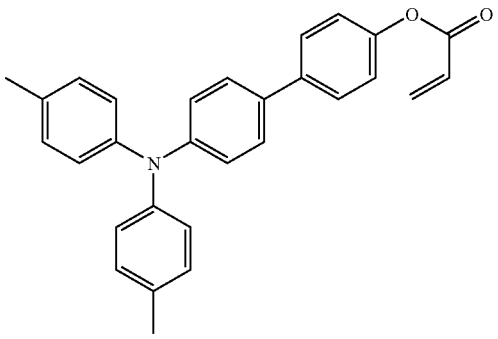 | 6.0 |
| Trimethylolpropane triacrylate | KAYARAD TMPTA (from Nippon Kayaku Co., Ltd.) | 3.0 |
| 50% THF solution of caprolactone-modified dipentaerythritol hexaacrylate | KAYARAD DPCA-120 (from Nippon Kayaku Co., Ltd.) | 6.0 |
| 5% THF solution of a mixture of polyester-modified polydimethylsiloxane having acryl group and propoxy-modified 2-neopentylglycol diacrylate | BYK-UV3571 (from BYK Japan KK) | 0.24 |

TABLE 7-continued

| Composition of Cross-linked Resin Surface Layer Coating Liquid | | |
|---|---|---|
| Components | Trade Name or Chemical Formula | Amount (parts) |
| 1-Hydroxycyclohexyl phenyl ketone | IRGACURE ® 184 (from Ciba) | 0.60 |
| Tris(2,4-di-tert-butylphenyl) phosphate | — | 0.12 |
| Filler | EPOSTAR S6 (from Nippon Shokubai Co., Ltd., having average diameter of 0.3 μm) | 0.67 |
| Tetrahydrofuran | | 68.9 |

Comparative Example 3

The procedure in Comparative Example 2 is repeated except for changing the amount of the filler to 1.4 parts.

Comparative Example 4

The procedure in Comparative Example 2 is repeated except for changing the amount of the filler to 3.2 parts.

Comparative Example 5

The procedure in Example 1 is repeated except for replacing the cross-linked resin surface layer coating liquid with a reinforced surface layer coating liquid having the composition shown in Table 8.

TABLE 8

| Composition of Reinforced Surface Layer Coating Liquid | | |
|---|---|---|
| Components | Trade Name or Chemical Formula | Amount (parts) |
| Z-type Polycarbonate | PANLITE ® TS-2050 (from Teijin Chemicals Ltd.) | 10 |
| Low-molecular-weight charge transport material | 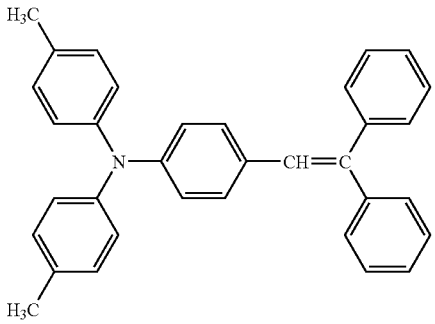 | 7.0 |
| α-Alumina | SUMICORUNDUM AA-03 (from Sumitomo Chemical Co., Ltd.) | 5.7 |
| Disperser | BYK-P104 (from BYK Japan KK) | 0.014 |
| Tetrahydrofuran | — | 280 |
| Cyclohexanone | — | 80 |

Comparative Example 6

The procedure in Example 1 is repeated except for changing the amounts of the cross-linkable silicone oil material and the non-cross-linkable silicone oil material to 0 part and 0.75 parts, respectively.

Comparative Example 7

The procedure in Example 1 is repeated except for changing the amounts of the cross-linkable silicone oil material and the non-cross-linkable silicone oil material to 0.75 parts and 0 part, respectively.

Each of the photoreceptors prepared in Examples 1 to 7 and Comparative Examples 1 to 7 each having a diameter of 40 mm is mounted on a yellow development station of an image forming apparatus IPSIO SP C811 (from Ricoh Co., Ltd.) to be subjected to the solid lubricant receptivity test. The linear speed of the photoreceptor is 205 mm/s. The zinc stearate and spring, which are genuine parts of the image forming apparatus, are used without modification.

The photoreceptor-developing device composite unit (i.e., PD unit) is also a genuine part. The voltage applied to the charging roller includes an AC component having a peak-to-peak voltage of 1.5 kV and a frequency of 0.9 kHz and a DC component including a bias which charges the photoreceptor to −700 Vat the beginning of the test. This charging condition is maintained throughout the test. No neutralization device is provided to the image forming apparatus.

Next, each of the photoreceptors prepared in Examples 1 to 7 and Comparative Examples 1 to 7 each having a diameter of 40 mm is mounted on a black development station of an image forming apparatus IPSIO SP C811 (from Ricoh Co., Ltd.). A printing job in which a halftone pattern with a pixel density of 600 dpi×600 dpi in which 4 dots×4 dots are formed on an 8×8 matrix and a blank pattern are alternately and independently produced on continuous 5 sheets of paper each is repeatedly executed, so that 50,000 sheets are produced in total. The paper is MY PAPER A4 (from NBS Ricoh) and the toner and developer are genuine parts of the image forming apparatus. The toner is a polymerization toner.

The photoreceptor unit is a genuine part. The voltage applied to the charging roller includes an AC component having a peak-to-peak voltage of 1.5 kV and a frequency of 0.9 kHz and a DC component including a bias which charges the photoreceptor to −700 V at the beginning of the test. This charging condition is maintained throughout the test. No neutralization device is provided to the image forming apparatus. The cleaning unit, which is a genuine part, is replaced with an unused one at every 50,000 sheets. After the test, a color test chart is produced on a PPC paper TYPE 6200A3. The test is performed at 25° C., 55% RH.

The measurement results of WRa in Examples 1 to 7 and Comparative Examples 1 to 7 are shown in FIGS. 24 to 37. The results of WRa's, the solid lubricant receptivity test, and the image evaluation in Examples 1 to 7 and Comparative Examples 1 to 7 are shown in Table 9.

TABLE 9

| | WRa (LLH) | WRa (LMH) | WRa (LHH) | WRa (LML) | Solid lubricant receptivity (Area occupancy (%) of zinc stearate on photoreceptor) | Image evaluation |
|---|---|---|---|---|---|---|
| Example 1 | 0.039 | 0.008 | 0.015 | 0.012 | 14.0 | 5 |
| Example 2 | 0.027 | 0.010 | 0.016 | 0.010 | 12.8 | 5 |
| Example 3 | 0.027 | 0.016 | 0.017 | 0.015 | 10.9 | 5 |
| Example 4 | 0.024 | 0.011 | 0.017 | 0.012 | 15.2 | 5 |
| Example 5 | 0.031 | 0.015 | 0.018 | 0.013 | 12.2 | 5 |
| Example 6 | 0.028 | 0.012 | 0.016 | 0.013 | 10.1 | 5 |
| Example 7 | 0.019 | 0.011 | 0.015 | 0.013 | 12.7 | 5 |
| Comparative Example 1 | 0.019 | 0.003 | 0.002 | 0.004 | 1.9 | 2 |
| Comparative Example 2 | 0.018 | 0.002 | 0.002 | 0.005 | 1.6 | 3 |
| Comparative Example 3 | 0.021 | 0.002 | 0.001 | 0.004 | 0.6 | 1 |
| Comparative Example 4 | 0.025 | 0.004 | 0.002 | 0.007 | 3.0 | 1 |
| Comparative Example 5 | 0.048 | 0.030 | 0.003 | 0.050 | 3.4 | 3 |
| Comparative Example 6 | 0.026 | 0.002 | 0.009 | 0.025 | 6.0 | 3 |
| Comparative Example 7 | 0.031 | 0.022 | 0.038 | 0.018 | 6.5 | 3 |

The photoreceptors of Examples 1 to 7 satisfy the inequations (i) to (v). They have better solid lubricant receptivity than the photoreceptor of Comparative Example 1, the surface of which is not roughened. However, it is clear from the results of Comparative Example 3 that roughening of the surface not always improves solid lubricant receptivity.

When the surface of a photoreceptor has a surface with an appropriate roughness, i.e., the inequations (i) to (v) are satisfied, a solid lubricant does not sideslip on the photoreceptor and an application blade causes appropriate variation in linear pressure, both of which may result in improvement of solid lubricant receptivity. The former is achieved by a high-frequency surface roughness and the latter is achieved by a low-frequency surface roughness.

Such a surface with an appropriate roughness can be obtained by adding a cross-linkable silicone material and a non-cross-linkable silicone material to a cross-linked resin surface layer coating liquid.

Example 8

On each of an aluminum cylinder having a thickness of 0.8 mm, a length of 340 mm, and an outer diameter of 40 mm, and another aluminum cylinder having a thickness of 0.8 mm, a length of 340 mm, and an outer diameter of 30 mm, a undercoat layer coating liquid, a charge generation layer coating liquid, and a charge transport layer coating liquid are sequentially coated and dried in this order. Thus, an undercoat layer, a charge generation layer, and a charge transport layer having a thickness of 3.5 μm, 0.2 μm, and 24 μm, respectively, are formed on each of the aluminum cylinders.

Further, a thermoplastic resin surface layer coating liquid is spray-coated on the aluminum cylinders having the undercoat layer, the charge generation layer, and the charge transport layer thereon, followed by drying for 10 minutes. The aluminum cylinders are put 120 mm away from a UV curing lamp so that the thermoplastic resin surface layer coating liquid is subjected to UV curing while rotating. The illuminance at that position is 550 mW/cm$^2$ when measured with an accumulated UV meter UIT-150 from Ushio Inc. The aluminum cylinders rotate at a revolution of 25 rpm. The aluminum cylinders are exposed to UV ray for 4 minutes while circulating water having a temperature of 30° C. therein, followed by drying for 30 minutes at 130° C. Thus, photoreceptors having a thermoplastic resin surface layer having a thickness of 6 μm are prepared.

The compositions of the coating layers are shown in Tables 10 to 13.

TABLE 10

Composition of Undercoat Layer Coating Liquid

| Components | Trade Name or Chemical Formula | Amount (parts) |
|---|---|---|
| Alkyd resin solution | BECKOLITE M6401-50 (from DIC Corporation) | 12 |
| Melamine resin solution | SUPER BECKAMINE G-821-60 (from DIC Corporation) | 8.0 |

TABLE 10-continued

Composition of Undercoat Layer Coating Liquid

| Components | Trade Name or Chemical Formula | Amount (parts) |
|---|---|---|
| Titanium oxide | CR-EL (from Ishihara Sangyo Kaisha, Ltd.) | 40 |
| Methyl ethyl ketone | — | 200 |

TABLE 11

Composition of Charge Generation Layer Coating Liquid

| Components | Trade Name or Chemical Formula | Amount (parts) |
|---|---|---|
| Bisazo pigment | 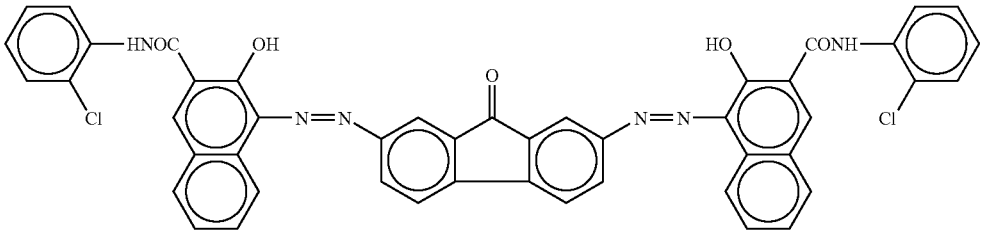 (from Ricoh Co., Ltd.) | 5.0 |
| Polyvinyl butyral | XYHL (from UCC) | 1 |
| Cyclohexa-none | — | 200 |
| Methyl ethyl ketone | | 80 |

TABLE 12

Composition of Charge Transport Layer Coating Liquid

| Components | Trade Name or Chemical Formula | Amount (parts) |
|---|---|---|
| Z-type Polycarbonate | PANLITE ® TS-2050 (from Teijin Chemicals Ltd.) | 10 |
| Low-molecular-weight charge transport material | 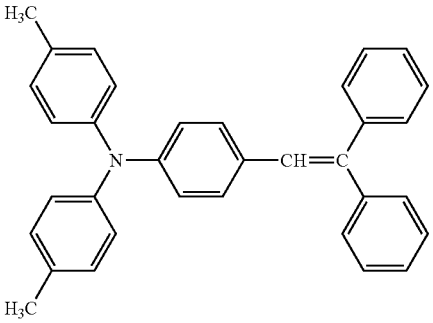 | 7.0 |
| Tetrahydrofuran | — | 100 |
| Silicone oil (in 1% THF solution) | KF50-100CS (from Shin-Etsu Chemical Co., Ltd.) | 1 |

TABLE 13

Composition of Thermoplastic Resin Surface Layer Coating Liquid

| Components | Trade Name or Chemical Formula | Amount (parts) |
|---|---|---|
| Z-type Polycarbonate | PANLITE ® TS-2050 (from Teijin Chemicals Ltd.) | 10 |
| Low-molecular-weight charge transport material | 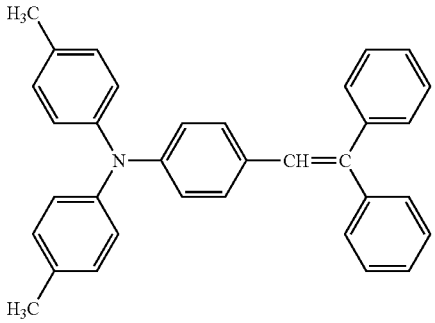 | 10.0 |
| Tetrahydrofuran | | 300 |
| Cyclohexanone | — | 100 |
| Cross-linkable silicone oil material | X-22-174DX (from Shin-Etsu Chemical Co., Ltd.) | 0.45 |
| Non-cross-linkable silicone oil material | KF-50-100CS (from Shin-Etsu Chemical Co., Ltd.) | 0.15 |

Example 9

The procedure in Example 8 is repeated except for changing the amount of the cross-linkable silicone oil material to 0.75 parts.

Example 10

The procedure in Example 8 is repeated except for changing the amount of the non-cross-linkable silicone oil material to 0.45 parts.

Example 11

The procedure in Example 8 is repeated except for changing the amounts of the cross-linkable silicone oil material and the non-cross-linkable silicone oil material to 0.75 parts and 0.45 parts, respectively.

Example 12

The procedure in Example 8 is repeated except for changing the amounts of the cross-linkable silicone oil material and the non-cross-linkable silicone oil material to 0.15 parts and 0.75 parts, respectively.

Example 13

The procedure in Example 8 is repeated except for changing the amounts of the cross-linkable silicone oil material and the non-cross-linkable silicone oil material to 0.45 parts and 0.75 parts, respectively.

Example 14

The procedure in Example 8 is repeated except for changing the amounts of the cross-linkable silicone oil material and the non-cross-linkable silicone oil material to 0.75 parts and 0.75 parts, respectively.

Comparative Example 8

The procedure in Example 8 is repeated except for replacing the thermoplastic resin surface layer coating liquid with another thermoplastic resin surface layer coating liquid having the composition shown in Table 14.

TABLE 14

Composition of Thermoplastic Resin Surface Layer Coating Liquid

| Components | Trade Name or Chemical Formula | Amount (parts) |
|---|---|---|
| Z-type Polycarbonate | PANLITE ® TS-2050 (from Teijin Chemicals Ltd.) | 10 |

TABLE 14-continued

| Composition of Thermoplastic Resin Surface Layer Coating Liquid | | |
|---|---|---|
| Components | Trade Name or Chemical Formula | Amount (parts) |
| Low-molecular-weight charge transport material | 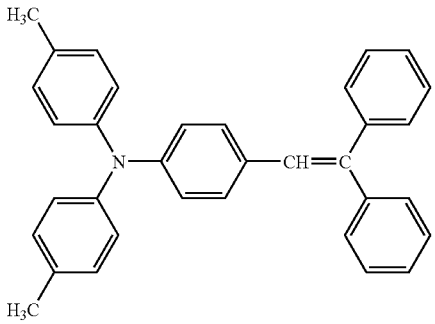 | 10.0 |
| Tetrahydrofuran | | 300 |
| Cyclohexanone | — | 100 |

Comparative Example 9

The procedure in Example 8 is repeated except for replacing the thermoplastic resin surface layer coating liquid with another thermoplastic resin surface layer coating liquid having the composition shown in Table 15.

TABLE 15

| Composition of Thermoplastic Resin Surface Layer Coating Liquid | | |
|---|---|---|
| Components | Trade Name or Chemical Formula | Amount (parts) |
| Z-type Polycarbonate | PANLITE ® TS-2050 (from Teijin Chemicals Ltd.) | 10 |
| Low-molecular-weight charge transport material | 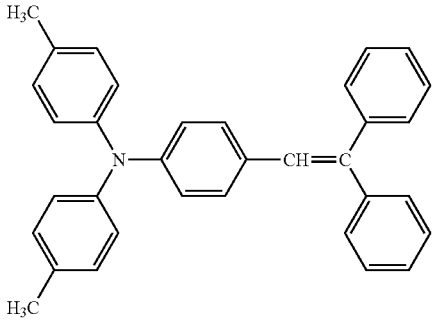 | 10.0 |
| Tetrahydrofuran | | 300 |
| Cyclohexanone | — | 100 |
| Non-cross-linkable silicone oil material | KF-50-100CS (from Shin-Etsu Chemical Co., Ltd.) | 0.15 |

Comparative Example 10

The procedure in Example 8 is repeated except for replacing the thermoplastic resin surface layer coating liquid with another thermoplastic resin surface layer coating liquid having the composition shown in Table 16.

TABLE 16

| Composition of Thermoplastic Resin Surface Layer Coating Liquid | | |
|---|---|---|
| Components | Trade Name or Chemical Formula | Amount (parts) |
| Z-type Polycarbonate | PANLITE ® TS-2050 (from Teijin Chemicals Ltd.) | 10 |
| Low-molecular-weight charge transport material | 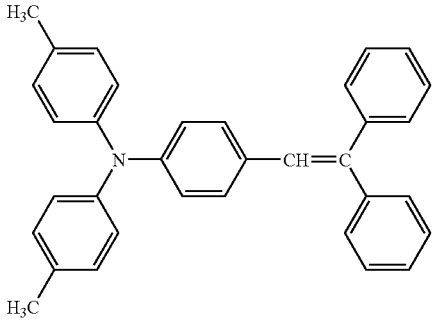 | 10.0 |
| Tetrahydrofuran | | 300 |
| Cyclohexanone | — | 100 |
| Cross-linkable silicone oil material | X-22-174DX (from Shin-Etsu Chemical Co., Ltd.) | 0.45 |

Each of the photoreceptors prepared in Examples 8 to 14 and Comparative Examples 8 to 10 each having a diameter of 40 mm is mounted on a yellow development station of an image forming apparatus IPSIO SP C811 (from Ricoh Co., Ltd.) to be subjected to the solid lubricant receptivity test in the same manner as Example 1.

Next, each of the photoreceptors prepared in Examples 8 to 14 and Comparative Examples 8 to 10 each having a diameter of 40 mm is mounted on a black development station of an image forming apparatus IPSIO SP C811 (from Ricoh Co., Ltd.) to be subjected to the image evaluation in the same manner as Example 1.

The measurement results of WRa in Examples 8 to 14 and Comparative Examples 8 to 10 are shown in FIGS. 38 to 47. The results of WRa's, the solid lubricant receptivity test, and the image evaluation in Examples 8 to 14 and Comparative Examples 8 to 10 are shown in Table 17.

The photoreceptors of Examples 8 to 14 satisfy the inequations (i) to (v). They have better solid lubricant receptivity than the photoreceptor of Comparative Example 8, the surface of which is not roughened. However, it is clear from the results of Comparative Examples 9 and 10 that roughening of the surface not always improves solid lubricant receptivity.

When the surface of a photoreceptor has a surface with an appropriate roughness, i.e., the inequations (i) to (v) are satisfied, a solid lubricant does not sideslip on the photoreceptor and an application blade causes appropriate variation in linear pressure, both of which may result in improvement of solid lubricant receptivity. The former is achieved by a high-frequency surface roughness and the latter is achieved by a low-frequency surface roughness.

TABLE 17

| | WRa (LLH) | WRa (LMH) | WRa (LHH) | WRa (LML) | Solid lubricant receptivity (Area occupancy (%) of zinc stearate on photoreceptor) | Image evaluation |
|---|---|---|---|---|---|---|
| Example 8 | 0.050 | 0.008 | 0.015 | 0.012 | 13.0 | 5 |
| Example 9 | 0.049 | 0.010 | 0.016 | 0.010 | 13.1 | 5 |
| Example 10 | 0.048 | 0.016 | 0.017 | 0.015 | 12.2 | 5 |
| Example 11 | 0.051 | 0.011 | 0.017 | 0.012 | 15.0 | 5 |
| Example 12 | 0.052 | 0.015 | 0.018 | 0.013 | 11.1 | 5 |
| Example 13 | 0.050 | 0.012 | 0.016 | 0.013 | 12.1 | 5 |
| Example 14 | 0.048 | 0.011 | 0.015 | 0.013 | 11.1 | 5 |
| Comparative Example 8 | 0.051 | 0.030 | 0.003 | 0.050 | 1.0 | 1 |
| Comparative Example 9 | 0.052 | 0.002 | 0.009 | 0.025 | 1.5 | 1 |
| Comparative Example 10 | 0.048 | 0.022 | 0.038 | 0.018 | 3.5 | 2 |

Such a surface with an appropriate roughness can be obtained by adding a cross-linkable silicone material and a non-cross-linkable silicone material to a thermoplastic resin surface layer coating liquid.

Additional modifications and variations of the present invention are possible in light of the above teachings. It is therefore to be understood that within the scope of the appended claims the invention may be practiced other than as specifically described herein.

What is claimed is:

1. An electrophotographic photoreceptor, comprising:

a conductive substrate;

a photosensitive layer located overlying the conductive substrate; and a surface layer located overlying the photosensitive layer, wherein the surface layer is a cross-linked resin surface layer formed by coating and curing a cross-linked resin surface layer coating liquid on the photosensitive layer, and the cross-linked resin surface layer coating liquid comprises a cross-linkable charge transport material, a trimethylolpropane triacrylate, a cross-linkable silicone material, and a non-cross-linkable silicone material, wherein the following inequations are satisfied:

$$0.005 < WRa(LMH) < 0.03 \quad \text{(i)}$$

$$0.010 < WRa(LHH) < 0.03 \quad \text{(ii)}$$

$$0.005 < WRa(LML) < 0.20 \quad \text{(iii)}$$

$$WRa(LLH) > WRa(LMH) \quad \text{(iv)}$$

$$WRa(LLH) > WRa(LHH) \quad \text{(v)}$$

wherein WRa (μm) represents a center-line average roughness of frequency components LHH, LHL, LMH, LML, LLH, and LLL that are obtained by a method comprising:

subjecting a one-dimensional data array of a surface profile of the electrophotographic photoreceptor, which is measured with a surface roughness & profile shape measuring instrument, to wavelet transformation multiresolution analysis so as to be separated into 6 frequency components each having a cycle length (μm) of 0 to 3, 1 to 6, 2 to 13, 4 to 25, 10 to 50, and 24 to 99;

thinning a one-dimensional data array of the lowest frequency component having a cycle length of from 24 to 99 (μm) so that the number of data array is reduced to 1/40; and subjecting the thinned one-dimensional data array to wavelet transformation multiresolution analysis so as to be separated into the 6 frequency components LHH, LHL, LMH, LML, LLH, and LLL each having a cycle length (μm) of 26 to 106, 53 to 183, 106 to 318, 214 to 551, 431 to 954, and 867 to 1,654, respectively.

2. The electrophotographic photoreceptor according to claim 1, wherein the cross-linked resin surface layer comprises a cross-linked body of a cross-linkable charge transport material having a triarylamine structure.

3. The electrophotographic photoreceptor according to claim 1, wherein the cross-linked resin surface layer comprises a cross-linked body of a cross-linkable charge transport material having the following formula (A) in an amount of 5% by weight or more and 60% by weight or less:

(A)

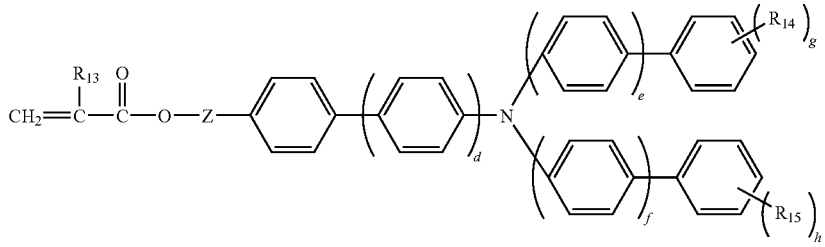

wherein each of d, e, and f independently represents an integer of 0 or 1; each of g and h independently represents an integer of from 0 to 3; $R_{13}$ represents a hydrogen atom or a methyl group; each of $R_{14}$ and $R_{15}$ independently represents an alkyl group having 1 to 6 carbon atoms, wherein multiple $R_{14}$ and $R_{15}$ may be, but need not necessarily be, the same; and Z represents a single bond, a methylene group, an ethylene group, —$CH_2CH_2O$—,

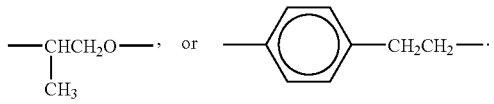

4. The electrophotographic photoreceptor according to claim 1, wherein the cross-linked resin surface layer comprises a cross-linked body of a trimethylolpropane triacrylate in an amount of 10% by weight or more and 50% by weight or less.

5. The electrophotographic photoreceptor according to claim 1, wherein the cross-linked resin surface layer coating liquid comprises the cross-linkable silicone material in an amount of from 1 to 5% by weight and the non-cross-linkable silicone material in an amount of from 1 to 5% by weight based on solid contents.

6. The electrophotographic photoreceptor according to claim 1, wherein the surface layer is a thermoplastic resin surface layer.

7. The electrophotographic photoreceptor according to claim 6, wherein the thermoplastic resin surface layer is formed by coating and curing a thermoplastic resin surface layer coating liquid on the photosensitive layer, the thermoplastic resin surface layer coating liquid comprising a charge transport material, a thermoplastic resin, a cross-linkable silicone material, and a non-cross-linkable silicone material.

8. The electrophotographic photoreceptor according to claim 7, wherein the thermoplastic resin surface layer coating liquid comprises the cross-linkable silicone material in an amount of from 1 to 5% by weight and the non-cross-linkable silicone material in an amount of from 1 to 5% by weight based on solid contents.

9. An image forming apparatus, comprising:

the electrophotographic photoreceptor according to claim 1 configured to bear an electrostatic latent image;

a brush roller configured to apply a solid lubricant to a surface of the electrophotographic photoreceptor;

a blade configured to extend the solid lubricant on the surface of the electrophotographic photoreceptor; and a developing device configured to develop the electrostatic latent image with a toner to form a toner image.

10. The image forming apparatus according to claim 9, wherein the toner is a polymerization toner.

11. The image forming apparatus according to claim 9, wherein the developing device is a tandem developing device which includes 2 or more developing stations each configured to form different-color toner images with different-color polymerization toners.

12. A process cartridge detachably mountable on image forming apparatus, comprising:

the electrophotographic photoreceptor according to claim 1 configured to bear an electrostatic latent image;

a brush roller configured to apply a solid lubricant to a surface of the electrophotographic photoreceptor; and a blade configured to extend the solid lubricant on the surface of the electrophotographic photoreceptor.

* * * * *

UNITED STATES PATENT AND TRADEMARK OFFICE

CERTIFICATE OF CORRECTION

PATENT NO. : 8,293,439 B2
APPLICATION NO. : 12/723058
DATED : October 23, 2012
INVENTOR(S) : Yukio Fujiwara et al.

It is certified that error appears in the above-identified patent and that said Letters Patent is hereby corrected as shown below:

Replace Item (54), Title, on the Title Page of the patent and Column 1, lines 1-6 in the specifications with the following:

-- ELECTROPHOTOGRAPHIC PHOTORECEPTOR, METHOD OF MANUFACTURING ELECTROPHOTOGRAPHIC PHOTORECEPTOR, IMAGE FORMING APPARATUS, AND PROCESS CARTRIDGE --

Signed and Sealed this
Fifth Day of March, 2013

Teresa Stanek Rea
*Acting Director of the United States Patent and Trademark Office*